US006304241B1

(12) United States Patent
Udo et al.

(10) Patent No.: US 6,304,241 B1
(45) Date of Patent: Oct. 16, 2001

(54) DRIVER FOR A LIQUID-CRYSTAL DISPLAY PANEL

(75) Inventors: Shinya Udo; Seiji Yamagata; Masatoshi Kokubun, all of Kasugai (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/206,491

(22) Filed: Dec. 7, 1998

(30) Foreign Application Priority Data

| | | |
|---|---|---|
| Jun. 3, 1998 | (JP) | 10-154810 |
| Jun. 30, 1998 | (JP) | 10-184175 |
| Jul. 10, 1998 | (JP) | 10-196233 |
| Nov. 17, 1998 | (JP) | 10-326419 |

(51) Int. Cl.[7] ..... G09G 3/36

(52) U.S. Cl. ..... 345/96; 345/209; 345/79; 345/98; 345/100

(58) Field of Search ..... 345/96, 87–90, 345/92, 94, 98–100, 208–209, 204, 79

(56) References Cited

U.S. PATENT DOCUMENTS 6,008,801 * 12/1999 Jeong ..... 345/204
6,049,321 * 4/2000 Sasaki ..... 345/99

FOREIGN PATENT DOCUMENTS 8179732 7/1996 (JP) .

OTHER PUBLICATIONS

Meinstein, K. et al. "A Low Voltage Source Driver for Column Inversion Applications" SID Digest, vol. XXVII pp. 255–258, May 1996.*

* cited by examiner

*Primary Examiner*—Richard Hjerpe
*Assistant Examiner*—Frances Nguyen
(74) *Attorney, Agent, or Firm*—Greer, Burns & Crain, Ltd.

(57) ABSTRACT

A liquid crystal display panel includes a driver having pairs of first and second D/A converters, corresponding pairs of first and second polarity changeover switches, and plural switching elements. Each of the first D/A converters receives a picture signal and outputs a positive-polarity voltage and each of the second D/A converters receives the picture signal and outputs a negative-polarity voltage. The first polarity changeover switches are connected to the outputs of the first and second D/A converters and alternately output the positive and negative polarity voltages. The second polarity changeover switches are also connected to the outputs of the first and second D/A converters and output a reverse polarity voltages. The switching elements are connected between the outputs of the first D/A converters and the first polarity switch and the output of the second D/A converters and the second polarity changeover switch. The switching elements are actuated until the voltages at the outputs of the first and second D/A converters become substantially equal.

38 Claims, 33 Drawing Sheets

DRIVER FOR A LIQUID-CRYSTAL DISPLAY PANEL

BACKGROUND OF THE INVENTION

The present invention generally relates to liquid crystal display panels and, more particularly to a driver for a liquid-crystal display panel, the driver having a reduced circuit area and power consumption and improving the picture quality of the liquid-crystal display panel.

To prolong the life of the liquid-crystal display panel, the driver has reversed the polarity of the picture voltage supplied to each pixel (picture element) cell of the liquid-crystal display panel (LCD panel).

FIG. 1 is a partial block circuit diagram of a data driver 11 for a conventional liquid-crystal display panel. The data driver 11 comprises a plurality of pairs of first and second digital-to-analog (D/A) converters 12 and 13, plural sets of output terminals P1, P2, P3, and P4, a plurality of pairs of polarity changeover switches 16 and 17, shift registers and latch circuits (neither are illustrated). The latch circuits latch digital picture signals supplied from external devices in accordance with latch control pulse signals from the shift registers.

A pair of the polarity changeover switches 16 and 17 are connected between the first and second D/A converters 12 and 13 and a pair of the output terminals, respectively. The changeover switch 16 selectively connects the output terminal of the first or second D/A converter 12 or 13 and the odd-numbered output terminal P1 (P3). The changeover switch 17 selectively connects the output terminal of the first or second D/A converter 12 or 13 and the even-numbered output terminal P2 (P4). Each of the polarity changeover switches 16 and 17 comprises first and second switches 18 and 19.

Each of the first and second D/A converters 12 and 13 comprises a selector 14 and an op amp 15. The selector 14 of the first D/A converter 12 receives the picture signal from the latch circuits as a first picture signal Vd1 (Vd3) and receives first gradation voltages Va1 to Va64. The selector 14 selects one of the first gradation voltages Va1 to Va64 in accordance with the first picture signal Vd1 (Vd3) and outputs the selection signal to the op amp 15. The op amp 15 outputs the selected voltage as a segment voltage. Thus, the first D/A converter 12 receives the first picture signal Vd1 (Vd3) and the first gradation voltages Va1 to Va64 and outputs a segment voltage (positive-polarity voltage) which is higher than a common voltage.

The selector 14 of the second D/A converter 13 receives the picture signal from the latch circuits as a second picture signal Vd2 (Vd4) and receives second gradation voltages Vb1 to Vb64. The selector 14 selects one of the second gradation voltages Vb1 to Vb64 in accordance with the second picture signal Vd2 (Vd4) and outputs the selected voltage to the op amp 15. The op amp 15 outputs the selected voltage as a segment voltage. Thus, the second D/A converter 13 receives the second picture signal Vd2 (Vd4) and the second gradation voltages Vb1 to Vb64 and outputs a segment voltage (negative-polarity voltage) which is lower than the common voltage.

The first switch 18 of the polarity changeover switch 16 is connected between the output terminal of the first D/A converter 12 and the odd-numbered output terminal P1 (P3). The first switch 18 of the polarity changeover switch 17 is connected between the output terminal of the second D/A converter 13 and the even-numbered output terminal P2 (P4).

The second switch 19 of the polarity changeover switch 16 is connected between the output terminal of the first D/A converter 12 and the even-numbered output terminal P2 or P4. The second switch 19 of the polarity change over switch 17 is connected between the output terminal of the second D/A converter 13 and the odd-numbered output terminal P1 or P3.

The first and second switches 18 and 19 complementarily turn on and off every one horizontal scanning period in response to a polarity switching signal FR. Accordingly, the positive-polarity segment voltage and the negative-polarity segment voltage are alternately supplied to each of the output terminals P1 to P4 every one horizontal scanning period.

For example, in response to the polarity switching signal FR, when the first switch 18 turns on and the second switch 19 turns off, the positive-polarity segment voltage from the first D/A converter 12 is applied to the odd-numbered output terminal P1 (P3) and the negative-polarity segment voltage from the second D/A converter 13 is applied to the even-numbered output terminal P2 (P4).

During the next horizontal period, when the first switch 18 turns off and the second switch 19 turns on, the positive-polarity segment voltage from the first D/A converter 12 is applied to the even-numbered output terminal P2 (P4) and the negative-polarity segment voltage from the second D/A converter 13 is applied to the odd-numbered output terminal P1 (P3).

The segment voltage applied to each output terminal is supplied to the pixel cell of the liquid-crystal display panel through a data line. The display level (brightness) of the pixel cell changes depending on the potential difference between the common voltage and a segment voltage Vs. Because the pixel cell comprises a liquid crystal cell and an auxiliary storage capacitor, the liquid-crystal display panel has a capacitive load on the data driver. Hence, the first D/A converter 12 charges the pixel cell through the data line and the second D/A converter 13 discharges a stored electric charge from the pixel cell through the data line. This charge/discharge operation increases the power consumption of the liquid crystal display panel as the number of horizontal pixel cells increases.

FIG. 2 is a partial block diagram of an improved data driver 21 for preventing the increase of power consumption. The data driver 21 comprises D/A converters 22 that correspond to the number of output terminals. Each of the D/A converters 22 comprises a selector 23 and an op amp 24, receives a picture signal Vd and gradation voltages V1 to V128, and alternately outputs the positive-polarity segment voltage Vs1 and the negative-polarity segment voltage Vs2. The gradation voltages V65 to V128 are positive-polarity segment voltages higher than the common voltage applied to each of the pixel cells, and the gradation voltages V1 to V64 are positive-polarity segment voltages lower than the common voltage. Accordingly, each of the D/A converters 13 alternately outputs one of the gradation voltages V65 to V128 and one of the graduation voltages V1 and V64 as the segment voltage Vs. During the same horizontal scanning period, the polarities of the gradation voltages selected by adjacent D/A converters 13 differ each other.

For example, as shown in FIG. 3*a*, the first D/A converter 22 alternately outputs a positive-polarity segment voltage Vsa and a negative-polarity segment voltage Vsb every one horizontal scanning period. The second D/A converter 23, adjacent to the first D/A converter 22, as shown in FIG. 3*b*, alternately outputs the negative-polarity segment voltage Vsb and the positive-polarity segment voltage Vsa every one horizontal scanning period.

Switches 25 are connected between the adjacent odd-numbered output terminal P1 (P3) and the even-numbered output terminal P2 (P4). Each of the switches 25 turns on for a predetermined period (for example, a retrace period which is a nonselective period of the pixel cell) in response to a control signal ER, and an electric charge moves from the data line charged to the positive-polarity voltage to the data line discharged to the negative-polarity voltage through the switches 25. In this case, the D/A converters 22 are maintained in the high impedance state. This charge/discharge allows the voltages of the data lines connected to the output terminals P1 to P4 to move to the vicinity of the common voltage. The D/A converters 22 are charged/discharged so as to change to a desired voltage from the common voltage. Because the charge/discharge operations of these converters 22 are performed centered around the common voltage, the power consumption is reduced.

However, the data driver 21 of FIG. 2 requires a signal generation circuit for generating the control signal ER of the switches 25, and so the circuit area of the data driver 21 is increased. The D/A converters 22 output the positive-polarity/negative-polarity segment voltage, and so they have about the same circuit area as the first and second D/A converters 12 and 13 of FIG. 1. This makes it difficult to increase the number of display pixels in a limited area.

FIG. 4 is a schematic block circuit diagram of another conventional data driver 111. The data driver 111 is equipped with a digital section 112 and the digital-to-analog (D/A) converters 22. The digital section 112 comprises latch circuits 114 and shift registers (not illustrated).

The shift registers sequentially transfer a latch control pulse signal and supply the latch control pulse signal to each of the latch circuits 114.

The latch circuits 114 correspond to the D/A converters 22. FIG. 4 shows only one of the latch circuits 114. Each of the latch circuits 114 latches a picture signal DD in accordance with the latch control pulse signal from the shift registers and supplies the latched signal to the corresponding D/A converter 22 as the picture signal Vd.

Each of the D/A converters 22 is connected to an external output terminal P. Accordingly, when the number of pixels of the liquid-crystal display panel increases, the number of D/A converters 22 increases and the circuit area of the data driver 111 increases.

FIG. 5 is a schematic block diagram of another conventional data driver 210. The data driver 210 is equipped with first to fourth digital-to-analog (D/A) converters 211 to 214, input switching circuits 215*a* and 215*b*, output switching circuits 216*a* and 216*b*, and shift registers and latch circuits (not illustrated). The adjacent first and second D/A converters 211 and 212 and the adjacent third and fourth D/A converters 213 and 214 form a pair, respectively.

The input switching circuit 215*a* receives n-bit picture signals D1n and D2n from the latch circuits. Then, in response to a polarity switching signal S1, the circuit 215*a* selectively outputs one of the picture signals D1n and D2n to the first D/A converter 211 and the other of the picture signals D1n and D2n to the second D/A converter 212.

The input switching circuit 215*b* receives n-bit picture signals D3n and D4n from the latch circuits. Then, in response to the polarity switching signal S1, the circuit 215*b* selectively outputs one of the picture signals D3n and D4n to the third D/A converter 213 and the other of the picture signals D3n and D4n to the fourth D/A converter 214.

The first D/A converter 211 selects the gradation voltage in accordance with the picture signal from the input switching circuit 215*a* and outputs the positive-polarity segment voltage Vs1 that is higher than the common voltage to the output switching circuit 216*a*.

The second D/A converter 212 selects the gradation voltage in accordance with the picture signal from the input switching circuit 215*a* and outputs the negative-polarity segment voltage Vs2 that is lower than the common voltage to the output switching circuit 216*a*.

The third D/A converter 213 selects the gradation voltage in accordance with the picture signal from the input switching circuit 215*b* and outputs a positive-polarity segment voltage Vs3 that is higher than the common voltage to the output switching circuit 216*b*.

The fourth D/A converter 214 selects the gradation voltage in accordance with the picture signal from the input switching circuit 215*b* and outputs a negative-polarity segment voltage Vs4 that is lower than the common voltage to the output switching circuit 216*b*.

The output switching circuit 216*a*, in accordance with the polarity switching signal S1, selectively outputs the positive-polarity voltage Vs1 from the first D/A converter 211 and the negative-polarity voltage Vs2 from the second D/A converter 212 to the output terminals P1 and P2.

The output switching circuit 216*b*, in accordance with the polarity switching signal S1, selectively outputs the positive-polarity voltage Vs3 from the third D/A converter 213 and the negative-polarity voltage Vs4 from the fourth D/A converter 214 to the output terminals P3 and P4.

FIG. 6 is a circuit diagram of an output switching circuit 216*a*. The output switching circuit 216*a* comprises four CMOS type transfer gates 217*a* to 217*d* and an inverter circuit 218.

The output terminal of the first D/A converter 211 is connected to the output terminals P1 and P2 through the transfer gates 217*a* and 217*c*. The output terminal of the second D/A converter 212 is connected to the output terminals P1 and P2 through the transfer gates 217*b* and 217*d*.

The NMOS transistor gates of the transfer gates 217*a* and 217*d* and the PMOS transistor gates of the transfer gates 217*b* and 217*c* receive the polarity switching signal S1. The PMOS transistor gates of the transfer gates 217*a* and 217*d* and the NMOS transistor gates of the transfer gates 217*b* and 217*c* receive the polarity switching signal S1 reversed by the inverter circuit 218. Because the output switching circuit 216*b* has the same configuration as the output switching circuit 216*a*, a detailed description thereof is omitted. Further, the input switching circuits 215*a* and 215*b* also have the same configuration as the output switching circuit 216*a*.

For example, as shown in FIG. 7, the input switching circuit 215*a*, in response to the polarity switching signal S1 having a H(high) level, supplies the picture signal D1n to the first D/A converter 211 and supplies the picture signal D2n to the second D/A converter 212. The transfer gates 217*a* and 217*d* of the output switching circuit 216*a*, in response to the polarity switching signal S1 having a H level, are conductively connected, and the transfer gates 217*b* and 217*c* are not conductively connected. Thus, the positive-polarity voltage Vs1 is supplied to the output terminal P1 through the transfer gate 217*a* and the negative-polarity voltage Vs2 is supplied to the output terminal P2 through the transfer gate 217*d*. The level of the polarity switching signal S1 is switched every one horizontal scanning period.

Further, as shown in FIG. 8, the input switching circuit 215*a*, in response to the polarity switching signal S1 having a L(low) level, supplies the picture signal D1n to the second D/A converter 212 and supplies the picture signal D2n to the first D/A converter 211. The input switching circuit 215*b* also operates in the same way as the input switching circuit 215*a*. The transfer gates 217*b* and 217*c* of the output switching circuit 216*a*, in response to the polarity switching signal S1 having a L level, are conductively connected and the transfer gates 217*a* and 217*d* are not conductively connected. Thus, the positive-polarity voltage Vs1 is supplied to the output terminal P2 through the transfer gate 217*c*, and the negative-polarity voltage Vs2 is supplied to the output terminal P1 through the transfer gate 217*b*.

As described above, the data driver 210 reverses the polarity of the picture voltage supplied to each pixel cell of the liquid-crystal display panel to prolong the life of each pixel cell. However, if the reverse operation of each pixel cell is delayed, a flicker may occur in the picture displayed on the liquid-crystal display panel. In particular, reversing the polarity of every pixel cell increases the brightness unevenness of every adjacent picture cell and, as a result, increases picture flickering.

It is an object of the present invention to provide a driver for liquid-crystal display panels with low power consumption.

A second object of the present invention is to provide a driver for liquid-crystal display panels with a reduced circuit area.

A third object of the present invention is to provide a driver for liquid-crystal display panels whose picture flickering is reduced.

SUMMARY OF THE INVENTION

Briefly stated, the present invention provides a driver for a display panel including a plurality of pairs of first and second D/A converters, a plurality of pairs of first and second polarity changeover switches and a plurality of switching elements. Each of the first and second D/A converters has an output terminal. Each of the first D/A converters receives a picture signal and outputs a positive-polarity voltage, and each of the second D/A converters receives the picture signal and outputs a negative-polarity voltage. Each of the first polarity changeover switches is connected to the output terminals of the first and second D/A converters and alternately outputs the positive-polarity voltage and negative-polarity voltage in response to a polarity changeover signal. Each of the second polarity changeover switches is connected to the output terminals of the first and second D/A converters and alternately outputs a reverse polarity voltage in contrast with the first polarity changeover switch in response to the polarity changeover signal. Each of the plurality of switching elements is respectively connected between a first node, located between the output terminal of the first D/A converter and the first polarity changeover switch, and a second node located between the output terminal of the second D/A converter and the second polarity changeover switch. Each of the switching elements is actuated until the voltages at the first and second nodes become substantially equal.

The present invention provides a driver for a display panel including a plurality of pairs of first and second D/A converters and a plurality of pairs of first and second switching circuits. Each of the first and second D/A converters has output terminals. Each of the first D/A converters receives a picture signal and alternately outputs a positive-polarity voltage and a negative-polarity voltage. Each of the second D/A converters receives the picture signal and alternately outputs the negative-polarity voltage and the positive-polarity voltage in contrast with the first D/A converter. Each of the first and second switching circuits is connected between the output terminals of the first and second D/A converters. Each of the first and second switching circuits is conductively connected so that the voltages of the output terminals of the first and second D/A converters become substantially equal to each other based on the output voltage of the first D/A converter. Each of the first and second circuits is connected between the output terminals of the first and second D/A converters and conductively connected so that the voltages of the output terminals of the first and second D/A converters become substantially equal to each other based on the output voltage of the second D/A converter.

The present invention provides a liquid crystal display device including a liquid crystal display panel having a plurality of pairs of first and second data lines and a driver connected to the plurality of pairs of the first and second data lines. The driver includes a plurality of pairs of first and second D/A converters having output terminals, a plurality of pairs of first and second polarity changeover switches, and a plurality of switching elements. Each of the first D/A converters receives a picture signal and outputs a positive-polarity voltage and each of the second D/A converters receives the picture signal and outputs a negative-polarity voltage. Each of the first polarity changeover switches is connected between the output terminals of the first and second D/A converters and the first data line and alternately outputs positive-polarity and negative-polarity voltages to the first data line in response to a polarity switching signal. Each of the second polarity changeover switches is connected between the output terminals of the first and second D/A converters and the second data line and alternately outputs a reverse voltage in contrast with the first polarity changeover switch to the second data line in response to the polarity switching signal. Each of the plurality of switching elements is connected between a first node, located between the output terminals of the first D/A converter and the first data line, and a second node located between the output terminals of the second D/A converter and the second polarity changeover switch. Each switching element is actuated until the voltages of the first and second nodes become substantially equal with each other.

The present invention provides a driver of a display panel including a plurality of D/A converters for receiving picture signals and outputting display voltages, a plurality of groups of output terminals assigned to the plurality of the D/A converters, and a plurality of time-division switches. The switches are respectively connected between the D/A converters and the groups of output terminals. The switches are actuated by a time-division control signal such that the switches time divisionally supply the display voltage from the D/A converter to the groups of the output terminals.

The present invention provides a system for supplying a timing signal to a plurality of display panel drivers including first and second drivers. Each driver includes a semiconductor integrated circuit. The system includes a wire that connects the first and second drivers in series. The first driver includes a plurality of D/A converters that receive a picture signal and output a display voltage, a plurality of groups of output terminals assigned to the plurality of D/A converters, and a plurality of time-division switches. Each of the switches is connected between each D/A converter and each group of output terminals and time divisionally supplies the display voltage from the D/A converter to each group of the output terminals in accordance with a time-division control circuit. The first driver further includes a time-division setting circuit that generates a timing signal in response to a latch control pulse signal and supplies the timing signal to the wire and a control circuit that receives the timing signal and generates the time-division control signal. The second driver includes a plurality of D/A converters that receive the picture signal and output the display voltage, a plurality of groups of output terminals assigned to the plurality of D/A converters, and a plurality of time-division switches. Each of the switches is connected between each D/A converter and each group of the output terminals and time divisionally supplies the display voltage from the D/A converter to each of the output terminals of each group in accordance with the time-division control signal. The second driver further includes a control circuit that receives the timing signal from the first driver by way of the wire and generates the time-division control signal.

The present invention provides a driver for a display panel including a first plurality of D/A converters that receive picture signals and output positive-polarity display voltages, and a second plurality of D/A converters that receive picture signals and output negative-polarity display voltages. A first plurality of pairs of intermediate terminals are assigned to the first plurality of D/A converters, and a second plurality of pairs of intermediate terminals are assigned to the second plurality of D/A converters. The driver further includes a first plurality of time-division switches and a second plurality of time-division switches. Each of the first plurality of time-division switches is connected between each of the first plurality of D/A converters and each pair of the first plurality of pairs of intermediate terminals and time divisionally supplies the positive-polarity display voltage from the D/A converters to each pair of the first plurality of pairs of intermediate terminals in accordance with a time-division control signal. Each of the second plurality of time-division switches is connected between each of the second plurality of D/A converters and each pair of the second plurality of pairs of intermediate terminals and time divisionally supplies the negative-polarity display voltage from the D/A converters to each pair of the second plurality of pairs of intermediate terminals in accordance with the time-division control signal. The driver further includes a plurality of pairs of output terminals including first and second pairs of output terminals assigned to the first and second plurality of pairs of intermediate terminals, a first plurality of pairs of polarity changeover switches and a second plurality of pairs of polarity changeover switches. Each of the first plurality of pairs of polarity changeover switches selectively connects a pair of the first plurality of pairs of intermediate terminals and the first and second pairs of the plurality of pairs of output terminals in accordance with a polarity switching signal. Each of the second plurality of pairs of polarity changeover switches selectively connects a pair of the second plurality of pairs of intermediate terminals and the first and second pairs of the plurality of output terminals in accordance with the polarity switching signal.

The present invention provide a liquid crystal display device including a liquid crystal display panel having a plurality of groups of data lines and a driver that drives the liquid crystal display panel. The driver includes a plurality of D/A converters that receive picture signals and output display voltages, a plurality of groups of output terminals assigned to the plurality of D/A converters and connected to the plurality of groups of data lines, respectively, and a plurality of time-division switches. Each of the switches is connected between each D/A converter and the output terminals of each group and time divisionally supplies the display voltage from the D/A converter to the output terminals of each group in accordance with a time-division control signal.

The present invention provides a driver for a display panel including a plurality of pairs of first and second D/A converters, a plurality of pairs of first and second input switching circuits, a plurality of pairs of first and second output terminals that correspond to the plurality of pairs of the first and second D/A converters, a plurality of pairs of first and second output switching circuits, and a plurality of control circuits. Each first D/A converter receives a picture signal and outputs a positive-polarity voltage and each second D/A converter receives the picture signal and outputs a negative-polarity voltage. Each switching circuit is connected to each pair of the first and second D/A converters, respectively and selectively provides the picture signal to the first and second D/A converters Each switching circuit is connected between each pair of the first and second D/A converters and each pair of the first and second output terminals and selectively supplies the positive-polarity and negative-polarity voltages from the first and second D/A converters to the first and second output terminals. Each control circuit is provided in the respective first input and first output switching circuits, for controlling the plurality of first input and output switching circuits so that voltages having different polarities are supplied to adjacent output terminals of adjacent pairs of output terminals in a first mode, and voltages having identical polarities are supplied to adjacent output terminals of adjacent pairs of output terminals in a second mode.

The present invention provides a liquid crystal display device including a liquid crystal display panel having a plurality of pairs of first and second data lines, and a driver that drives the liquid crystal display panel. The driver includes a plurality of pairs of first and second D/A converters, a plurality of pairs of first and second input switching circuits, a plurality of pairs of first and second output terminals, connected to the plurality of pairs of the first and second data lines, and corresponding to the plurality of pairs of first and second D/A converters, a plurality of pairs of first and second output switching circuits, and a plurality of control circuits. Each first D/A converter receives a picture signal and outputs a positive-polarity voltage, and each second D/A converter receives the picture signal and outputs a negative-polarity voltage. Each switching circuit is connected to each pair of the first and second D/A converters and selectively provides the picture signal to the first and second D/A converters. Each output switching circuit is connected between each pair of the first and second D/A converters and each pair of the first and second output terminals and selectively supplies the positive-polarity and negative-polarity voltages from the first and second D/A converters to the first and second output terminals. Each control circuit is provided in a respective one of the first input and first output switching circuits and controls the plurality of first input and output switching circuits so that voltages having different polarities are supplied to adjacent output terminals of adjacent pairs of output terminals in a first mode, and voltages having the same polarity are supplied to adjacent output terminals of adjacent pairs of output terminals in a second mode.

The present invention provides a method for driving a display panel. First, a plurality of pairs of first and second D/A converters are provided. Each first D/A converter receives a picture signal and outputs a positive-polarity voltage and each second D/A converter receives the picture signal and outputs a negative-polarity voltage. Then, a plurality of pairs of the first and second input switching circuits are provided. Each switching circuit is connected to each pair of the first and second D/A converters and selectively provides the picture signal to the first and second D/A converters. Then, a plurality of pairs of first and second output terminals that correspond to the plurality of pairs of first and second D/A converters are provided. Then, a plurality of pairs of the first and second output switching circuits are provides. Each switching circuit is between each pair of the first and second D/A converters and each pair of the first and second output terminals and selectively supplies the positive-polarity and negative-polarity voltages from the first and second D/A converters to the first and second output terminals. The respective first input and output switching circuits are controlled so that voltages having different polarities are supplied to the adjacent output terminals of adjacent pairs of the output terminals in a first mode. The respective first input and output switching circuits are controlled so that voltages having the same polarity are supplied to adjacent output terminals of adjacent pairs of output terminals in a second mode.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

Figure 1:
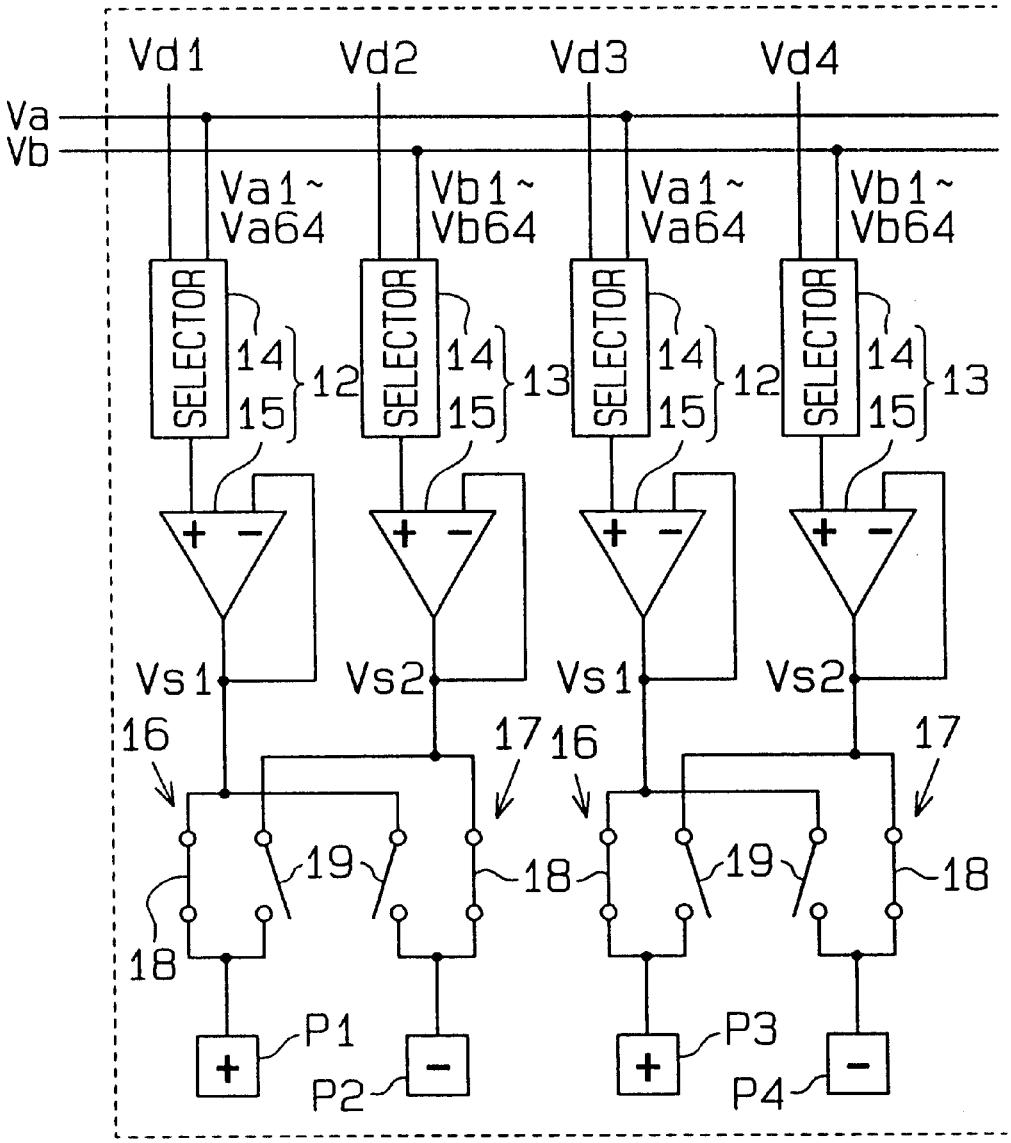
Fig.1 (Prior Art)
FIG. 1 is a partial block circuit diagram of a first conventional data driver for a liquid crystal display panel.

In the drawings, like elements have the same reference numerals.

Figure 9:
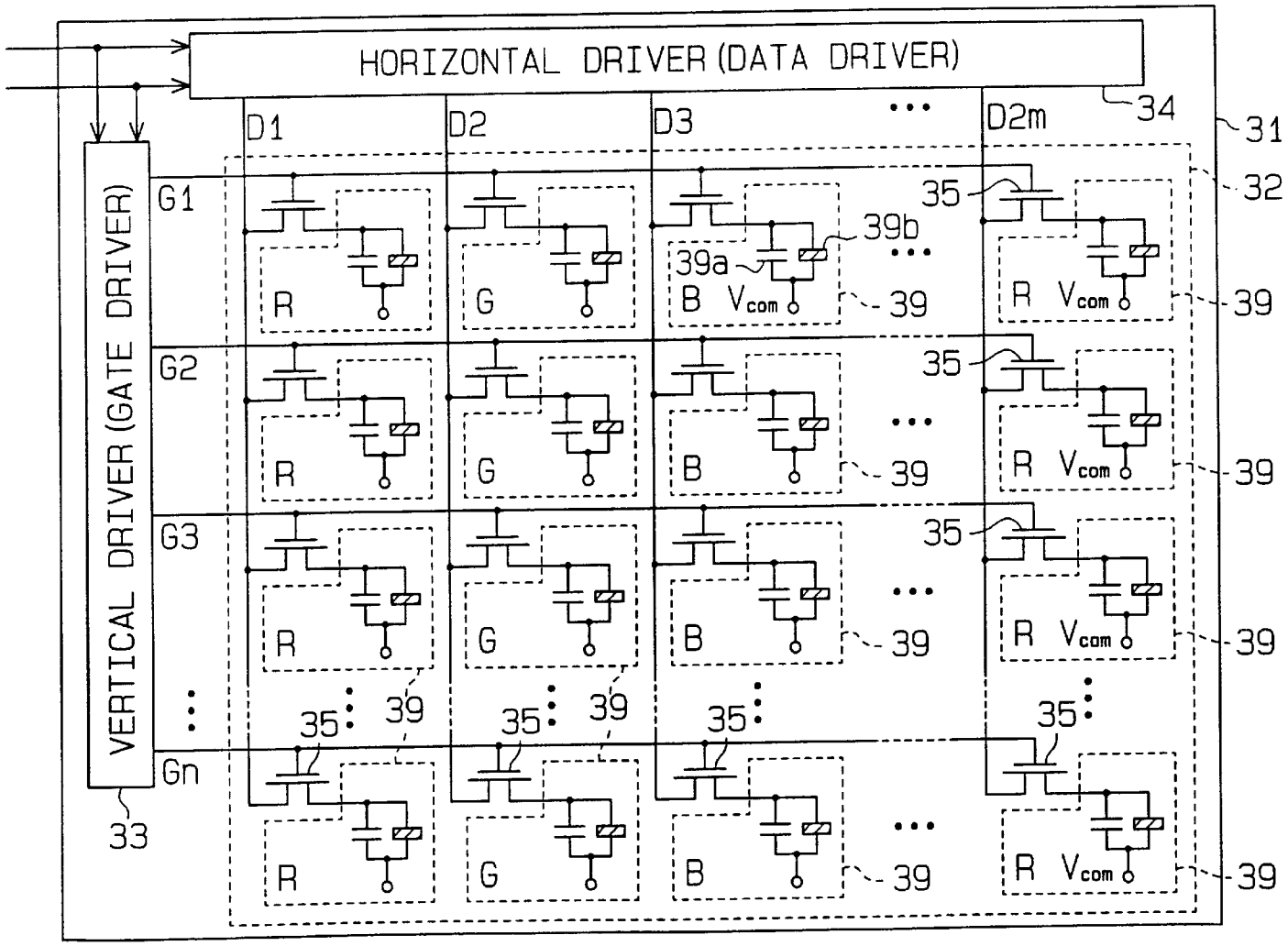
FIG. 9 is a block circuit diagram of a liquid crystal display device.

FIG. 9 is a block circuit diagram of a liquid crystal display device 31. The liquid crystal display device 31 comprises a liquid-crystal display panel (LCD panel) 32, a vertical driver (gate driver) 33, and a horizontal driver (data driver) 34. The liquid-crystal display panel 32 is equipped with mutually intersected scan lines (gate wirings) G1 to Gn and data lines (drain wirings) D1 to D2m (n and m are integers).

Pixel cells 39 are connected to the intersections between the respective scanning lines G1 to Gn and the respective data lines D1 to D2m. Each of the pixel cells 39 comprises an auxiliary (storage) capacitor 39*a* as a signal storage element and a liquid crystal cell 39*b*. Thin film transistors (TFTs) 35 are connected between the pixel cells 39 and the data lines D1 to D2m, and the gates of the TFTs 35 are connected to the scanning lines G1 to Gn.

Each of the liquid crystal cells 39 has a first electrode (display electrode) connected to the source of the related TFT 35 and a second electrode (common electrode) for receiving a common voltage Vcom. The auxiliary capacitor 39*a* is connected in parallel with the liquid crystal cell 39*b*.

The gate driver 33 is connected to each of the scan lines G1 to Gn and applies scanning signals (gate signals) to the scan lines G1 to Gn in accordance with control signals. The data driver 34 is connected to each of the data lines D1 to D2m and applies a segment voltage to each of the data lines D1 to D2m in accordance with the control signals and picture signals. The gate driver 33 and data driver 34, in accordance with the control signals, perform horizontal and vertical scanning and display a picture on the liquid-crystal display panel 32.

Figure 10:
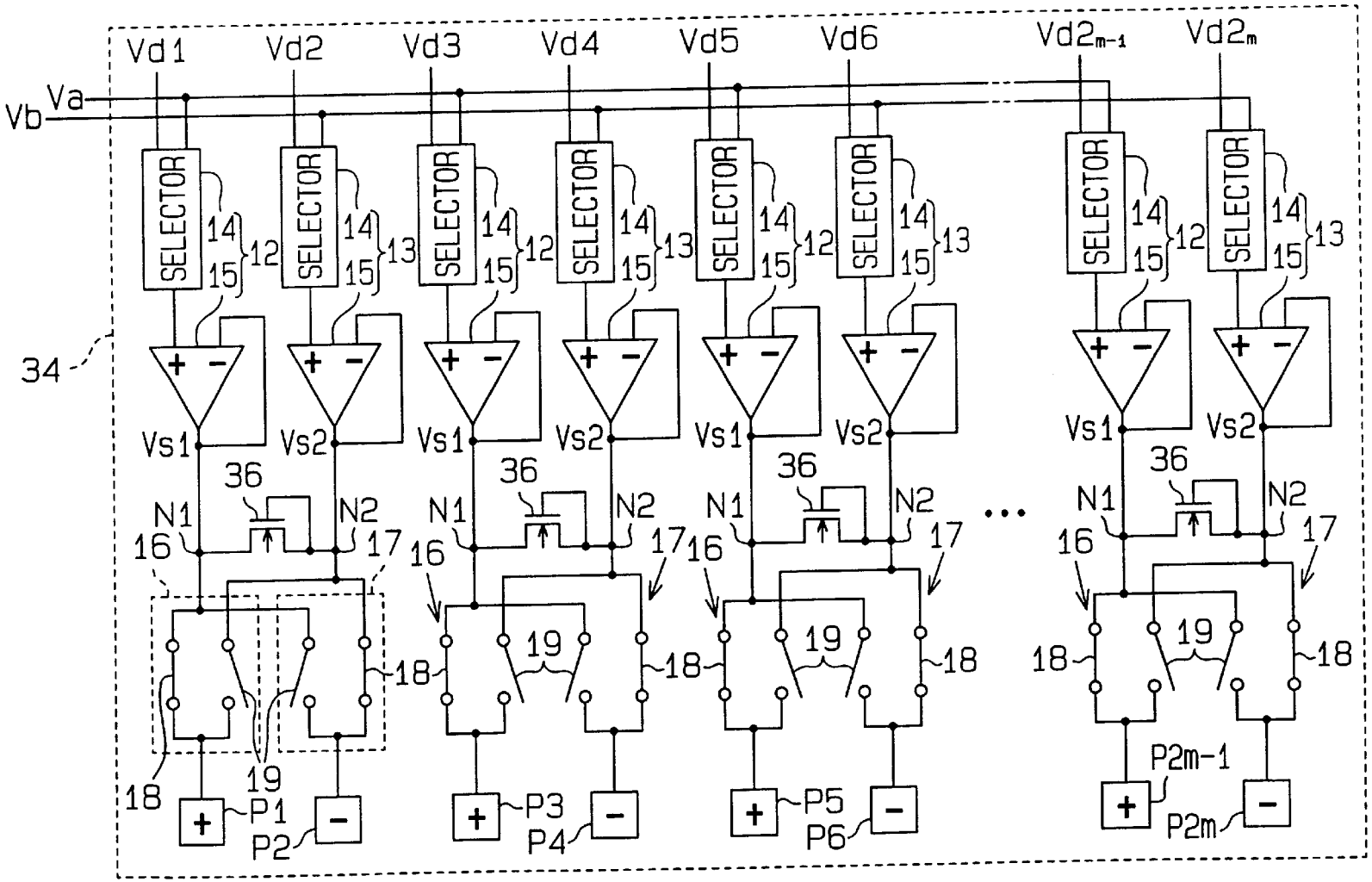
FIG. 10 is a block circuit diagram of a data driver according to a first embodiment of the present invention.

FIG. 10 is a block circuit diagram of a data driver 34. The data driver 34 comprises first and second digital-to-analog (D/A) converters 12 and 13, first and second polarity changeover switches 16 and 17, and shift registers and latch circuits (not illustrated). m pairs of first and second D/A converters 12 and 13 which are provided correspond to the data lines D1 to D2m.

A pair of the first and second polarity changeover switches 16 and 17 is connected between a pair of the first and second D/A converters 12 and 13 and a pair of the odd-numbered and the even-numbered output terminals P1, P3, . . . , and P2m−1 and P2, P4, . . . , and P2m.

Each of the first and second D/A converters 12 and 13 comprises the selector 14 and the op amp 15. The selector 14 of each first D/A converter 12 selects one of the first gradation voltages Va1 to Va64 supplied from the latch circuits in accordance with the first picture signal Vd1, Vd3, . . . , and Vd2m and outputs the selection voltage to the op amp 15. The op amp 15 receives the selection voltage and outputs the first segment voltage (positive-polarity voltage) which is VS1 higher than the common voltage.

The selector 14 of each second D/A converter 13 selects one of the second gradation voltages Vb1 to Vb64 supplied from the latch circuits in accordance with the second picture signals Vd2, Vd4, . . . , and Vd2m and outputs the selection voltage to the op amp 15. The op amp 15 receives the selection voltage and outputs the second segment voltage (negative-polarity voltage) VS2 which is lower than the common voltage.

The first polarity changeover switch 16 comprises the first switch 18 connected between the output terminal of the first D/A converter 12 and the odd-numbered output terminals P1, P3, . . . , and P2m−1 and the second switch 19 connected between the output terminal of the second D/A converter 13 and the odd-numbered output terminals P1, P3, . . . , and P2m−1. The second polarity changeover switch 17 comprises the first switch 18 connected between the output terminal of the second D/A converter 13 and the even-numbered output terminals P2, P4, . . . , and P2m and the second switch 19 connected between the output terminal of the first D/A converter 12 and the even-numbered output terminals P2, P4, . . . , and P2m.

The first and second switches 18 and 19 complementarily turn on and off every one horizontal scanning period in response to the switching control signal FR. This ON and OFF operation allows the positive-polarity segment voltage and the negative-polarity segment voltage to alternately be applied to each of the output terminals P1 to P2m every one horizontal scanning period.

A MOS transistor 36 as a switching element is connected like a diode between a node N1, located between the first D/A converter 12 and the first polarity changeover switch 16, and a node N2, located between the second D/A converter 13 and the second polarity changeover switch 17. The transistor 36 preferably comprises N-channel MOS transistors. The transistor 36 has a source connected to the node N2, a drain connected to the node N1, and a gate connected to the source (i.e. node N2) of the transistor 36. By this connection, the transistor 36 functions as a rectifier element (diode element) that is equipped with an anode connected to the output terminal of the second D/A converter 13 and a cathode connected to the output terminal of the first D/A converter 12. Accordingly, a diode may be used instead of the transistor 36. Further, a P-channel MOS transistor may be also used. In this case, the gate of the P-channel MOS transistor is connected to the output terminal of the first D/A converter 12.

For example, when the first switch 18 is turned on and the second switch 19 is turned off, the first segment voltage Vs1 is applied to the odd-numbered output terminals P1, P3, . . . , and P2m−1 and the second segment voltage Vs2 is applied to the even-numbered output terminals P2, P4, . . . , and P2m. Consequently, the odd-numbered data lines D1, D3, . . . , D2m−1 are charged to the first positive-polarity segment voltage VS1 and the even-numbered data lines D2, D4, . . . , and D2m are discharged to the second negative-polarity segment voltage VS2.

During the next horizontal scanning period, when the first switch 18 is turned off and the second switch 19 is turned on, the voltage of the odd-numbered data wirings D1, D3, . . . , and D2m−1 (i.e. the first positive-polarity segment voltage VS1) is applied to the gate of the transistor 36 and the transistor 36 goes on. Then, current flows from the odd-numbered output terminals P1, P3, . . . , and P2m−1 to the even-numbered output terminals P2, P4, . . . , and P2m through the transistor 36. In other words, the electric charge discharged from the odd-numbered output terminals P1, P3, . . . , and P2m−1 charges to the even-numbered output terminals P2, P4, . . . , and P2m. The transistor 36 goes on until the voltages of both at the nodes N1 and N2 (i.e. the voltages of the output terminals of the first and second D/A converters 12 and 13) become substantially equal. In other words, the voltages of the data lines connected to both the output terminals P2, P4, . . . , and P2m, and P1, P3, . . . , and P2m−1 are charged/discharged until the voltages reach the vicinity of the common voltage.

Subsequently, the gate voltage of the transistor 36 becomes lower than the drain voltage by the second segment voltage VS2 output from the second D/A converter 13. As a result, the transistor 36 goes off, and the flow of current from the node N1 to the node N2 is interrupted.

During the next horizontal scanning period, when the first and second polarity changeover switches 16 and 17 are switched, the positive-polarity segment voltage is applied to the gate of the transistor 36 from the even-numbered output terminals P2, P4, . . . , and P2m, and the transistor 36 goes on. Thus, the electric charge discharged from the even-numbered output terminals P2, P4, . . . , and P2m charges to the odd-numbered output terminals P1, P3, . . . , and P2m−1. Because the transistor 36 turns on and off and the voltage of the data line is charged/discharged up to the vicinity of the common voltage as described above, the first and second D/A converters 12 and 13 are charged/discharged up to the polarity-positive or negative-polarity voltage centered around the common voltage. Accordingly, the amount of charge/discharge is reduced, and the power consumption is reduced.

Figure 2:
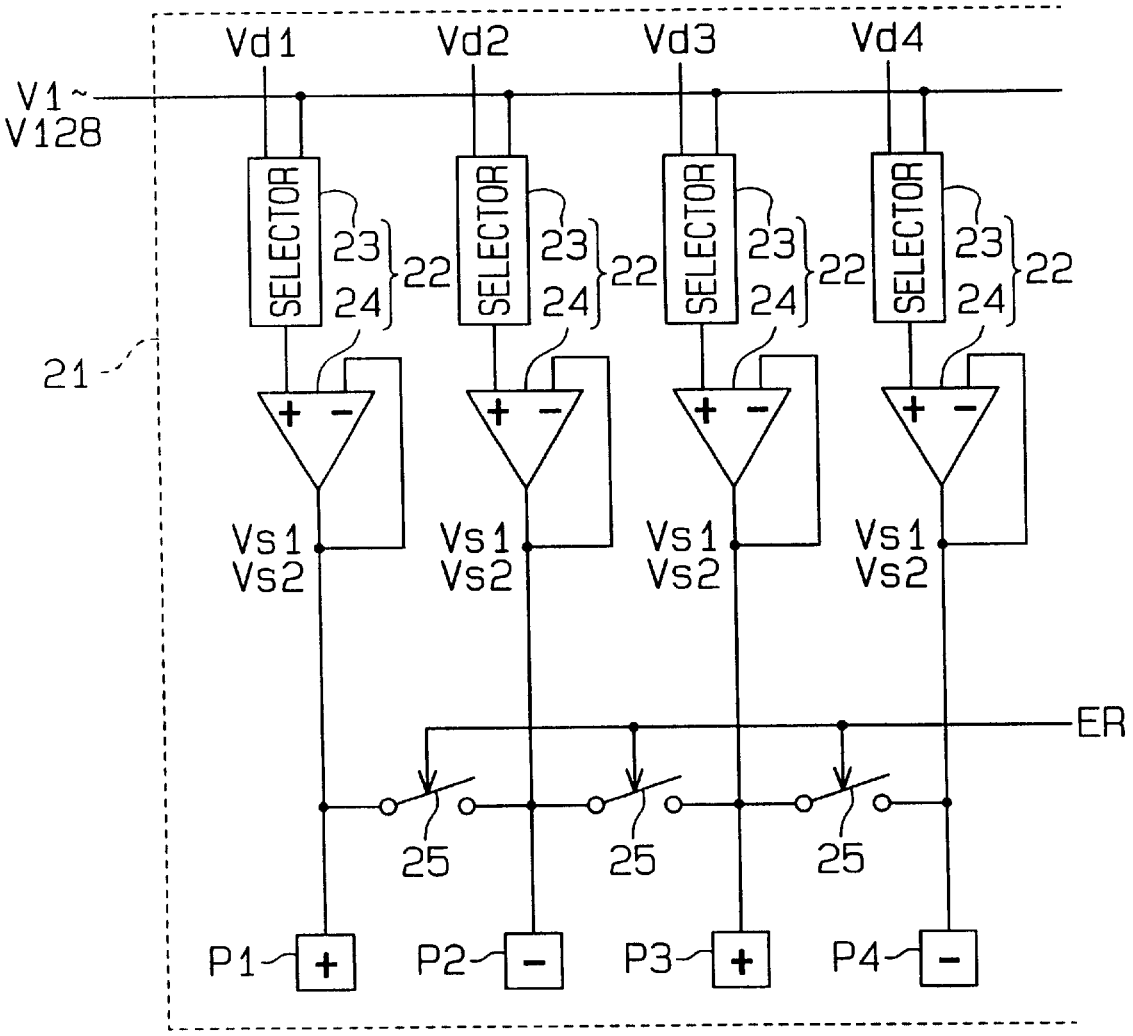
Fig.2(Prior Art)
FIG. 2 is a partial block diagram of a second conventional data driver.
Figures 3A, 3B:
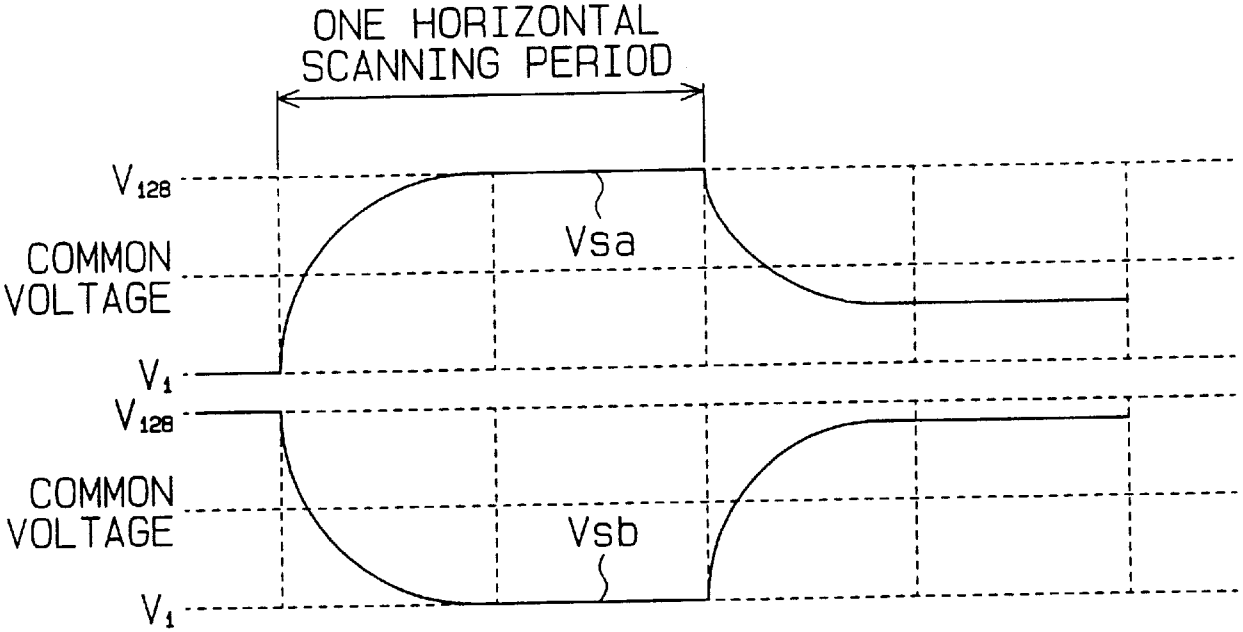
Fig.3a (Prior Art)
Fig.3b (Prior Art)
FIGS. 3*a* and 3*b* are waveform diagrams of a voltage output of a D/A converter of the data driver of FIG. 2.
Figure 4:
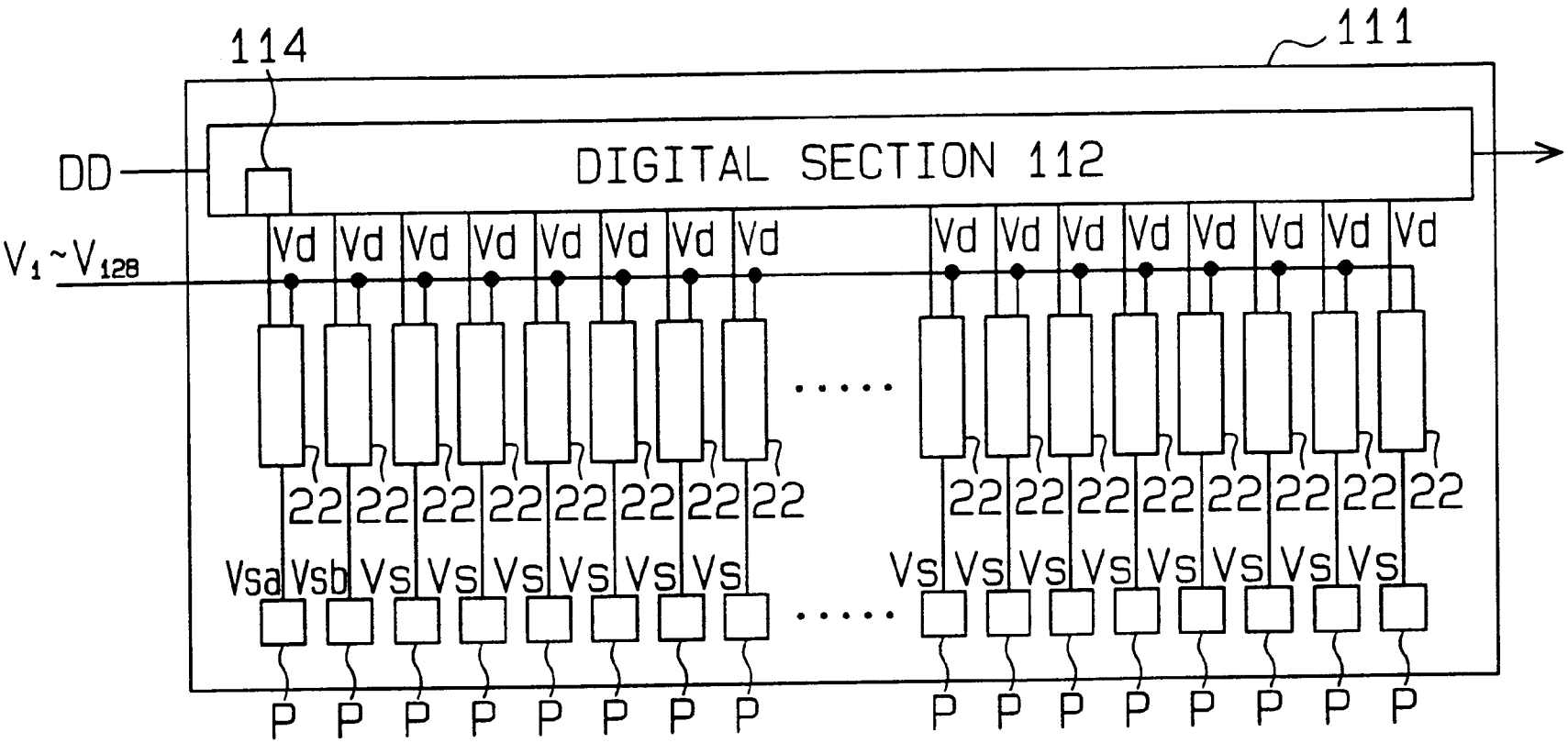
Fig.4 (Prior Art)
FIG. 4 is a schematic block circuit diagram of a third conventional data driver.

Further, because a control signal generation circuit for turning on and off the switch 25 is not required as shown in the conventional data driver 21 of FIG. 2, an increase in the circuit area is avoided.

The data driver 34 of the present invention may be modified as shown in the following seven examples.

Figure 11:
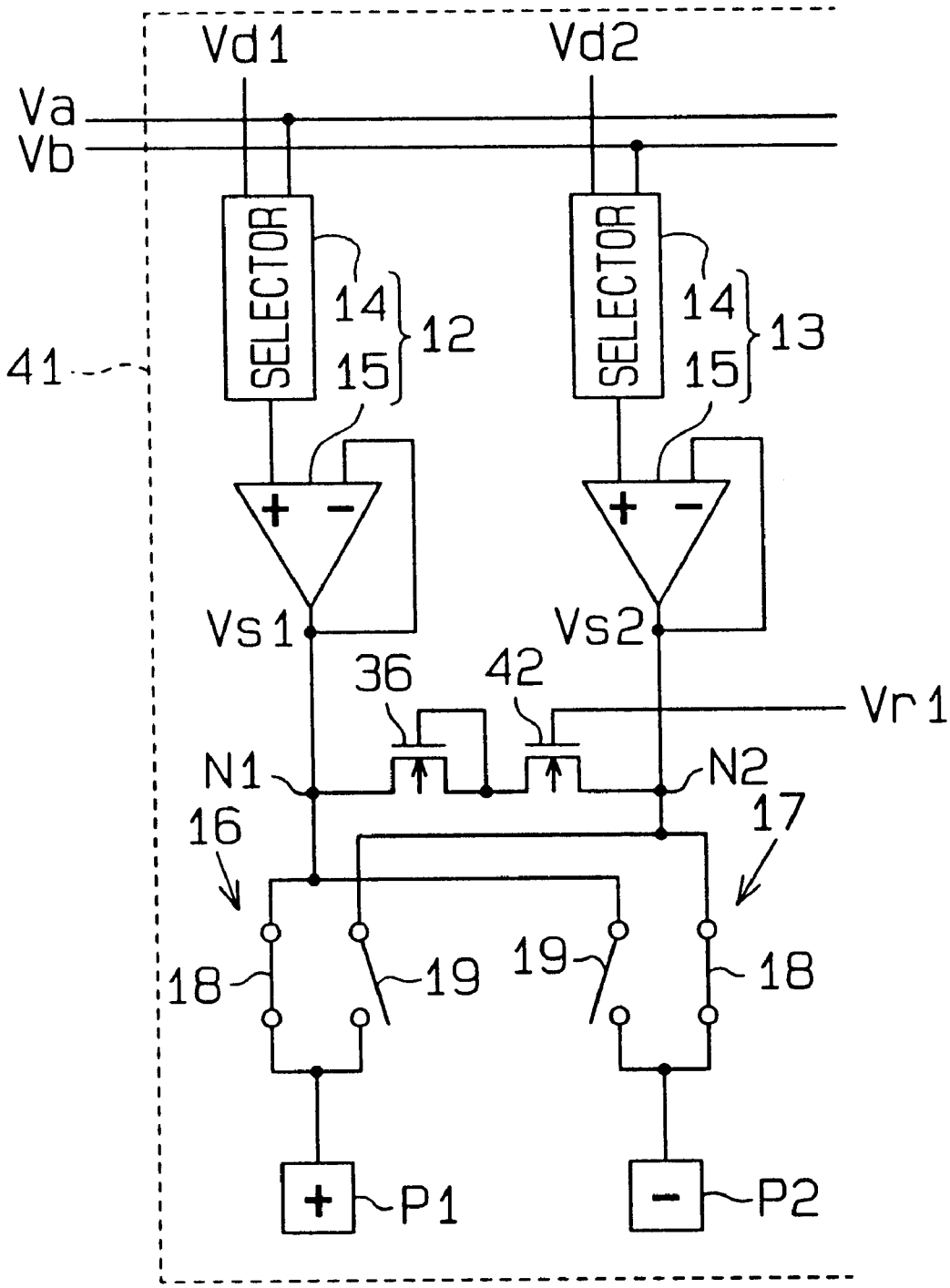
FIG. 11 is a block diagram of a first modification example of the data driver of FIG. 10

FIG. 11 is a block diagram of a first modification example of a data driver 41. Two N-channel MOS transistors 36 and 42 are connected in series between the output terminals of the first and second D/A converters 12 and 13. Specifically, the transistor 42 is connected between the transistor 36 and the node N2. A predetermined voltage Vr1 is applied to the gate of the transistor 42. The transistor 42 goes off when the voltage at the node N2 drops to the predetermined voltage Vr1. Accordingly, the voltage at the node N2 is discharged until the voltage reaches the predetermined voltage Vr1.

Figure 12:
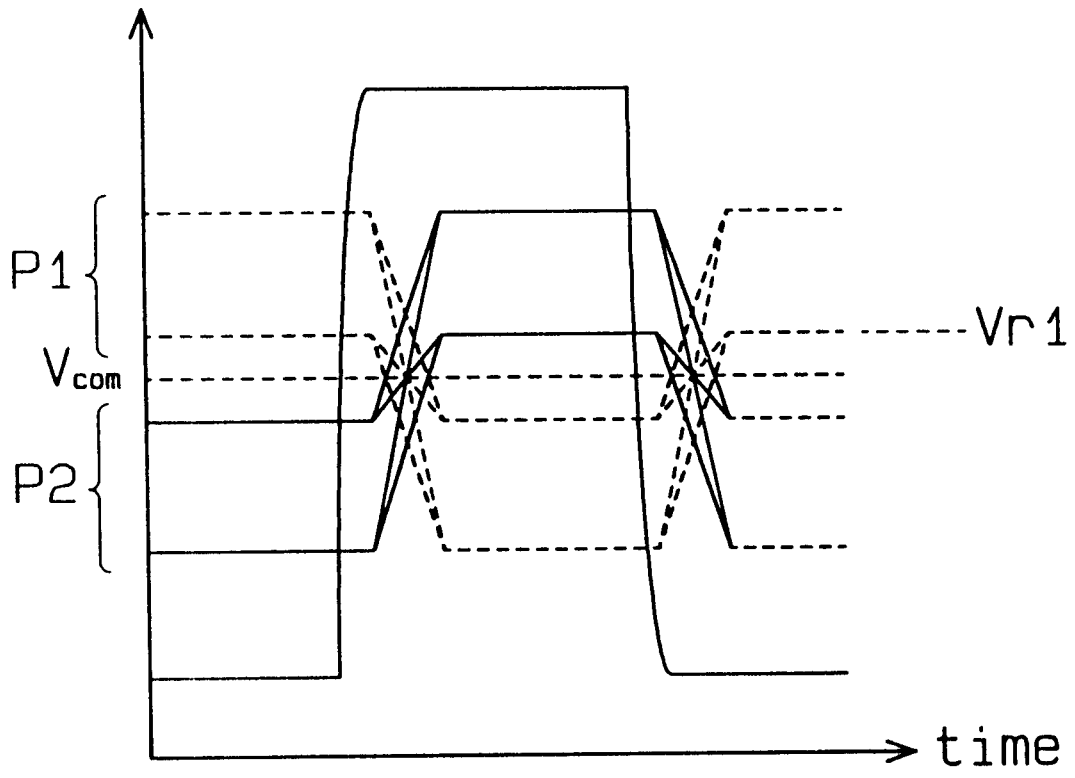
FIG. 12 is a waveform diagram of a voltage output of the data driver of FIG. 11.

It is preferable that the predetermined voltage Vr1 is set to the minimum of the first positive-polarity segment voltage VS1 supplied to the output terminals P1 and P2. The minimum voltage is a voltage higher than the common voltage Vcom, as shown in FIG. 12. Accordingly, the first D/A converter 12 supplies only the remaining charge amount from which the charge amount that corresponds to the difference voltage between the predetermined voltage Vr1 and the common voltage Vcom is subtracted. As a result, the time to charge up to the desired positive-polarity segment voltage is decreased, and the power consumption is reduced.

Furthermore, when the transistor 42 is turned off, the output terminal (node N2) of the second D/A converter 13 is set to the maximum of the second negative-polarity segment voltage VS2. This allows the second D/A converter 13 to surely discharge the data line connected to the output terminal P2 to one of the second gradation voltages vb1–Vb64.

Figure 13:
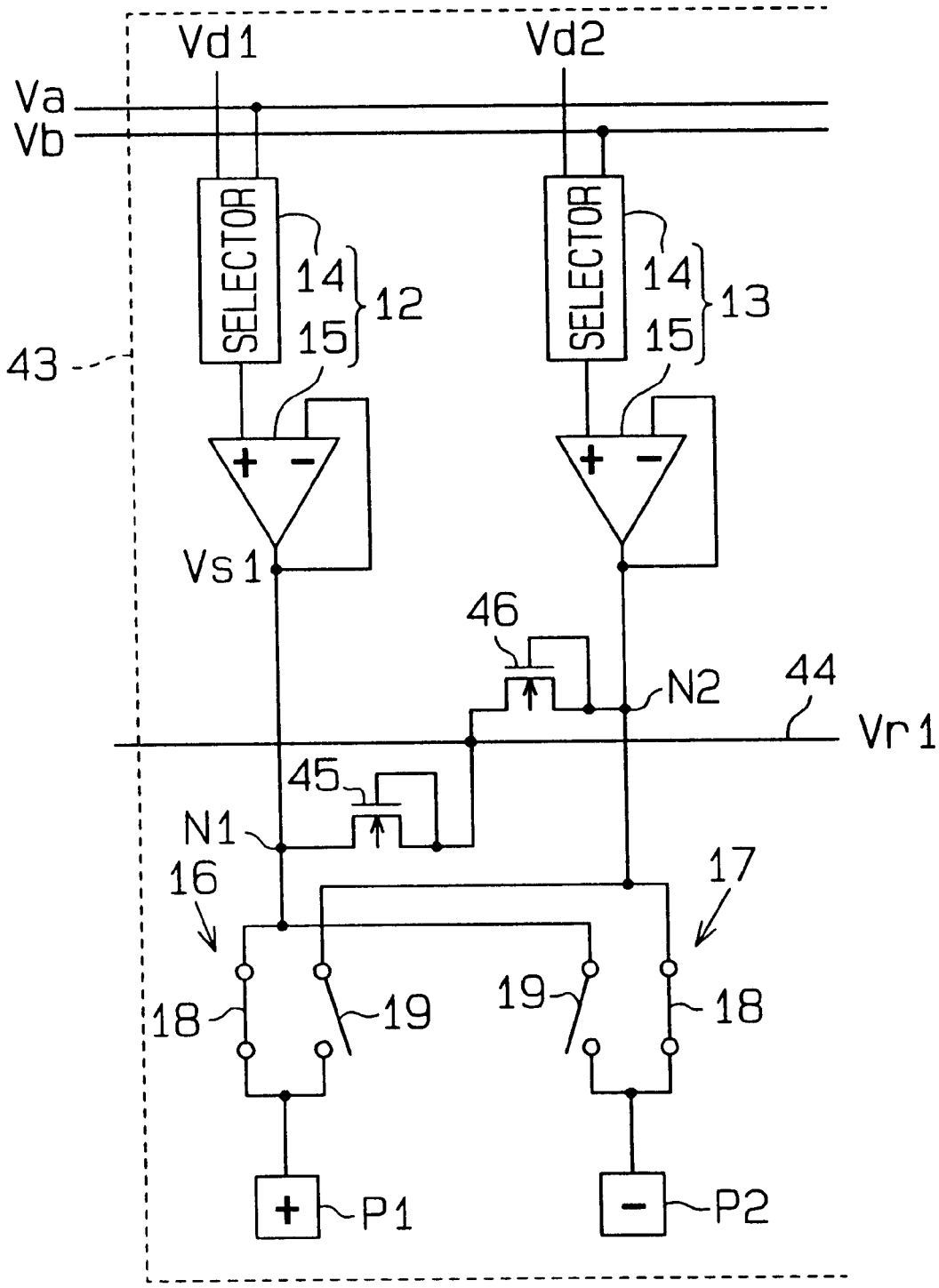
FIG. 13 is a block diagram of a data driver in a second modification example.

FIG. 13 is a block diagram of a second modification example of a data driver 43. The data driver 43 is equipped with a wire 44 to which the predetermined voltage Vr1 is applied, a first N-channel MOS transistor 45 connected between the node N1 and the wire 44, and a second N-channel MOS transistor 46 connected between the node N2 and the wire 44. The first N-channel transistor 45 operates in the same way as the transistor 36. The second transistor 46 goes off when the voltage at the node N2 drops to the predetermined voltage Vr1. Accordingly, the voltage at the node N2 is discharged until the voltage reaches the predetermined voltage Vr1. As a result, the time to charge up to the desired positive-polarity segment voltage is shortened and the power consumption is reduced.

It is preferable that the predetermined voltage Vr1 is set to be equal or smaller than the minimum of the first positive-polarity segment voltage VS1 when the first transistor 45 is turned off and to be equal or greater than the maximum of the second negative-polarity segment voltage VS2 when the second transistor 46 is turned off. This allows the first and second D/A converters 12, 13 to surely charge and discharge the data lines connected to the output terminals P1, P2 to the first and second gradation voltages Va1–Va64, Vb1–Vb64.

Figure 14:
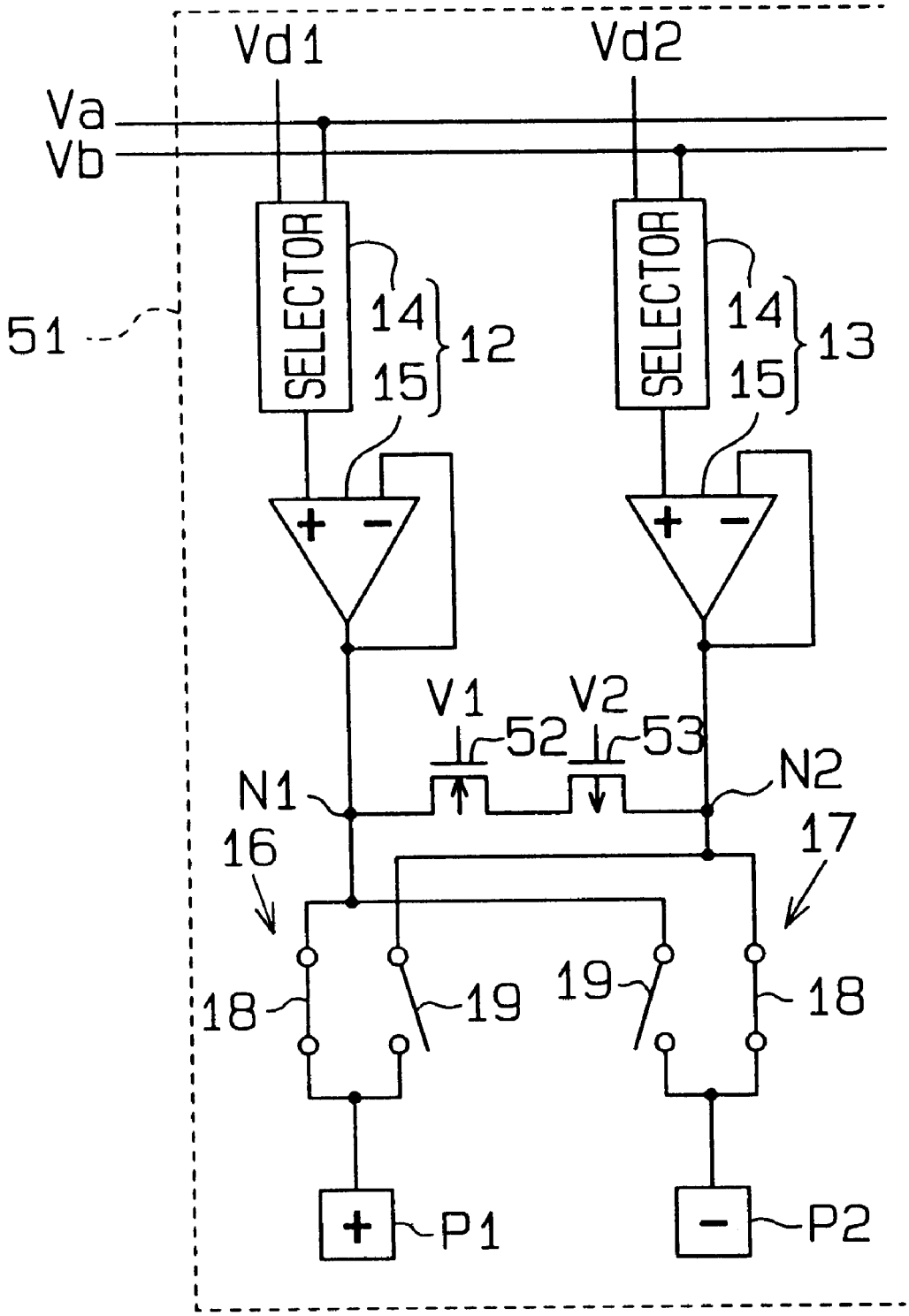
FIG. 14 is a block diagram of a third modification example of the data driver of FIG. 10.

FIG. 14 is a block diagram of a third modification example of a data driver 51. The data driver 51 is equipped with an N-channel MOS transistor 52 and a P-channel MOS transistor 53 connected in series between the output terminals (i.e., nodes N1 and N2) of the first and second D/A converters 12 and 13. The first voltage V1 is supplied to the gate of the N-channel MOS transistor 52, and the second voltage V2 is supplied to the gate of the P-channel MOS transistor 53. The N-channel MOS transistor 52 goes off when the voltage at the node N1 rises to the first voltage V1. The P-channel transistor 53 goes off when the voltage at the node N2 drops to the second voltage V2. In other words, charge/discharge is performed until either the transistor 52 or 53 goes off first. Accordingly, the amount of charge/discharge may be adjusted by setting the first and second voltages V1 and V2. In addition, the first and second voltages V1 and V2 may be set to the same voltage.

It is preferable that the first voltage V1 is set to the minimum of the first positive-polarity segment voltage VS1, and the second voltage V2 is set to the maximum of the second negative-polarity segment voltage VS2. When the transistor 52 is turned off, the output terminal (node N1) of the first D/A converter 12 is charged up to the first voltage V1. Accordingly, the first D/A converter 12 surely charges the data line connected to the node N1 to one of the first gradation voltages Va1 to Va64. When the transistor 53 is turned off, the output terminal (node N2) of the second D/A converter 13 is charged up to the second voltage V2. Accordingly, the first D/A converter 13 surely discharges the data line connected to the node N2 to one of the second gradation voltages Vb1 to Vb64.

Figure 15:
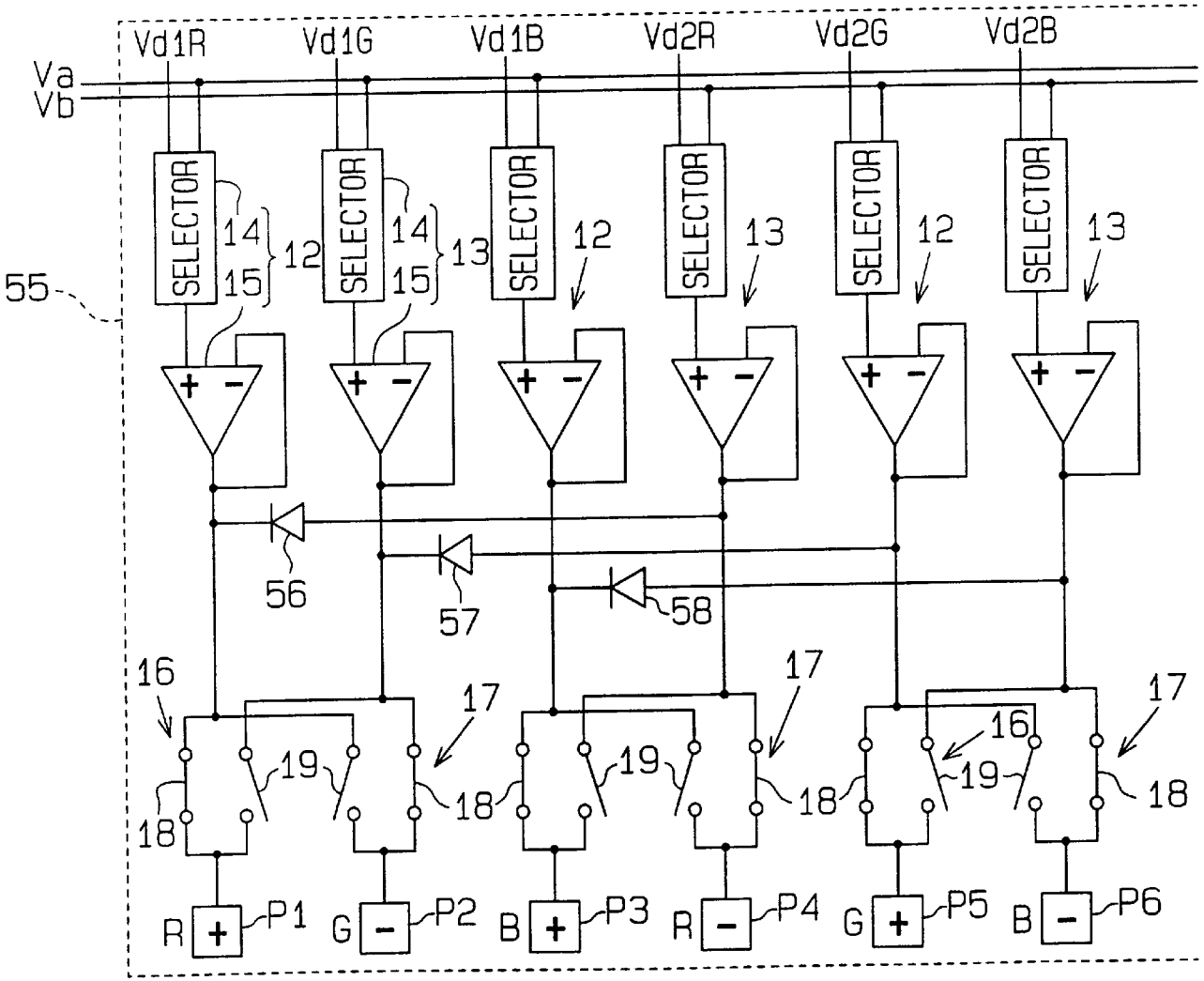
FIG. 15 is a block diagram of a fourth modification example of the data driver of FIG. 10.

FIG. 15 is a block diagram of a fourth modification example of a data driver 55 suitable for a color liquid crystal display device. The data driver 55 is equipped with a diode 56 connected between the output terminals of the first and second D/A converters 12 and 13 that correspond to a pair of output terminals (for example, P1 and P4) connected to a pixel displaying the same color (for example, red). A diode 57 connects the green D/A converters, and a diode 58 connects the blue D/A converters. Instead of diodes, the transistors of FIGS. 10, 11, 13, 14, and 37 may be used. The diodes are connected as described above because the pixel cell with the same color displays the tone with the same degree. In other words, the potential difference between the common voltage Vcom and the positive (or negative) segment voltage resulting from a red picture signal Vd1R and the potential difference between the common voltage Vcom and the negative (or positive) segment voltage resulting from a red picture signal Vd2R are frequently almost the same. Accordingly, the charge/discharge efficiency for the output terminals P1 and P2 with the same color is improved by the diodes, and the power consumption is reduced.

Figure 16:
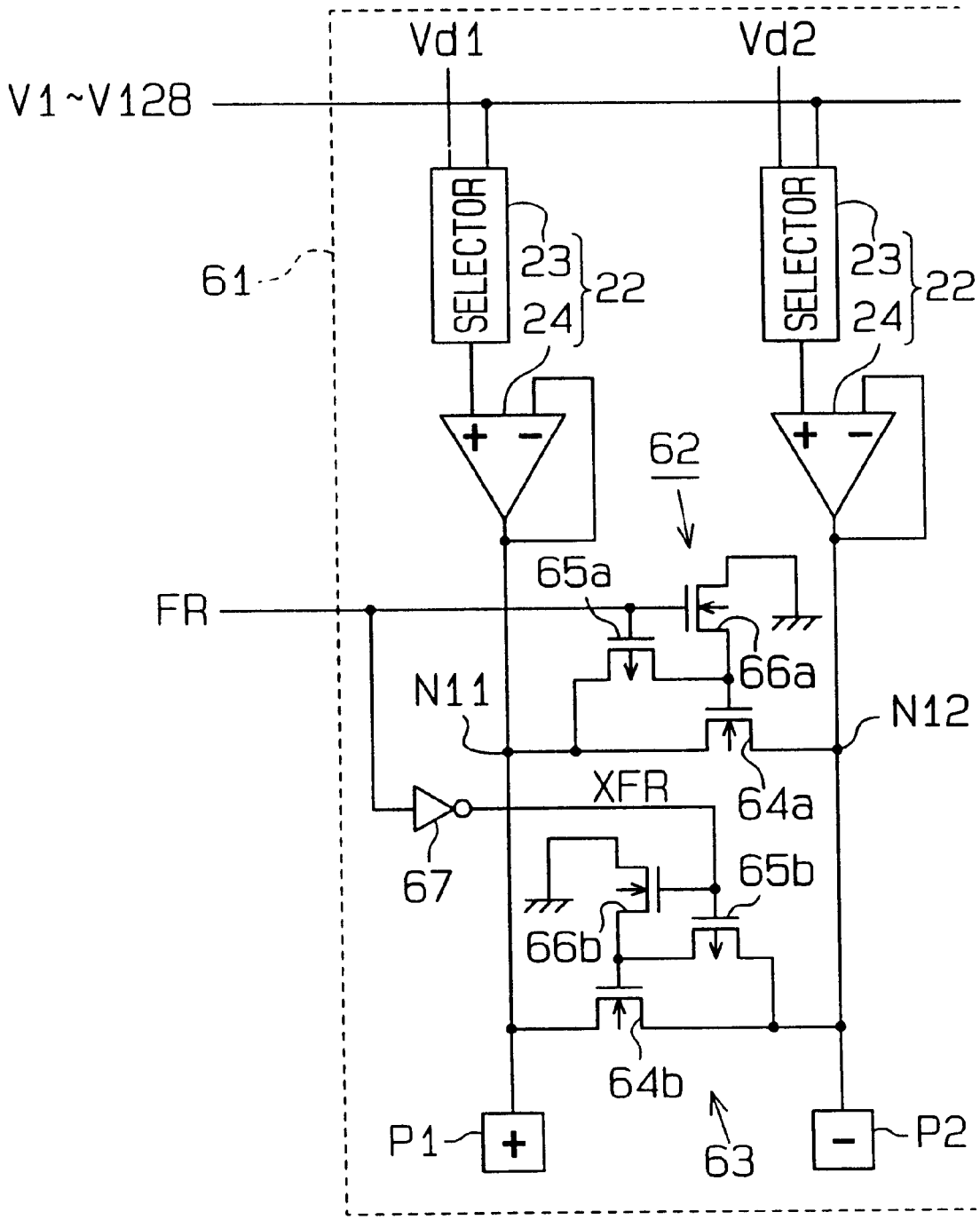
FIG. 16 is a block diagram of a fifth modification example of the data driver of FIG. 10.

FIG. 16 is a block diagram of a fifth modification example of a data driver 61 having the conventional D/A converters 22 of FIG. 2. The D/A converters 22 alternately output the positive-polarity and negative-polarity segment voltages. The data driver 61 is equipped with first and second switching circuits 62 and 63. The first and second switching circuits 62 and 63 are connected between a node N11, located between the odd-numbered output terminal P1 and the D/A converter 22, and a node N12, located between the even-numbered output terminal P2 and the D/A converter 22.

The first switching circuit 62 comprises an N-channel MOS transistor 64*a*, a P-channel MOS transistor 65*a*, and N-channel MOS transistor 66*a*. The N-channel MOS transistor 64*a* is connected between the nodes N11 and N12. The P-channel MOS transistor 65*a* is connected between the gate of the first transistor 64*a* and the node N11 and has a gate for receiving the polarity switching signal FR. The N-channel MOS transistor 66*a* is connected between the gate of the first transistor 64*a* and a low potential power supply and has a gate for receiving the polarity switching signal FR.

The second switching circuit 63 is equipped with an N-channel MOS transistor 64*b*, a P-channel MOS transistor 65*b*, and an N-channel MOS transistor 66*b*. The N-channel MOS transistor 64*b* is connected between the nodes N11 and N12. The P-channel MOS transistor 65*b* is connected between the gate of the first transistor 64*b* and the node N11 and has a gate for receiving a reverse polarity switching signal VFR reversed by an inverter circuit 67. The third transistor 66*b* is connected between the gate of the first transistor 64*b* and a low potential power supply and has a gate for receiving a reverse polarity switching signal XFR.

The first and second switching circuits 62 and 63 operate in the same way as the transistor 36 of FIG. 10. Accordingly, the power consumption is also reduced in the data driver 61 with the D/A converters 22.

Figure 17:
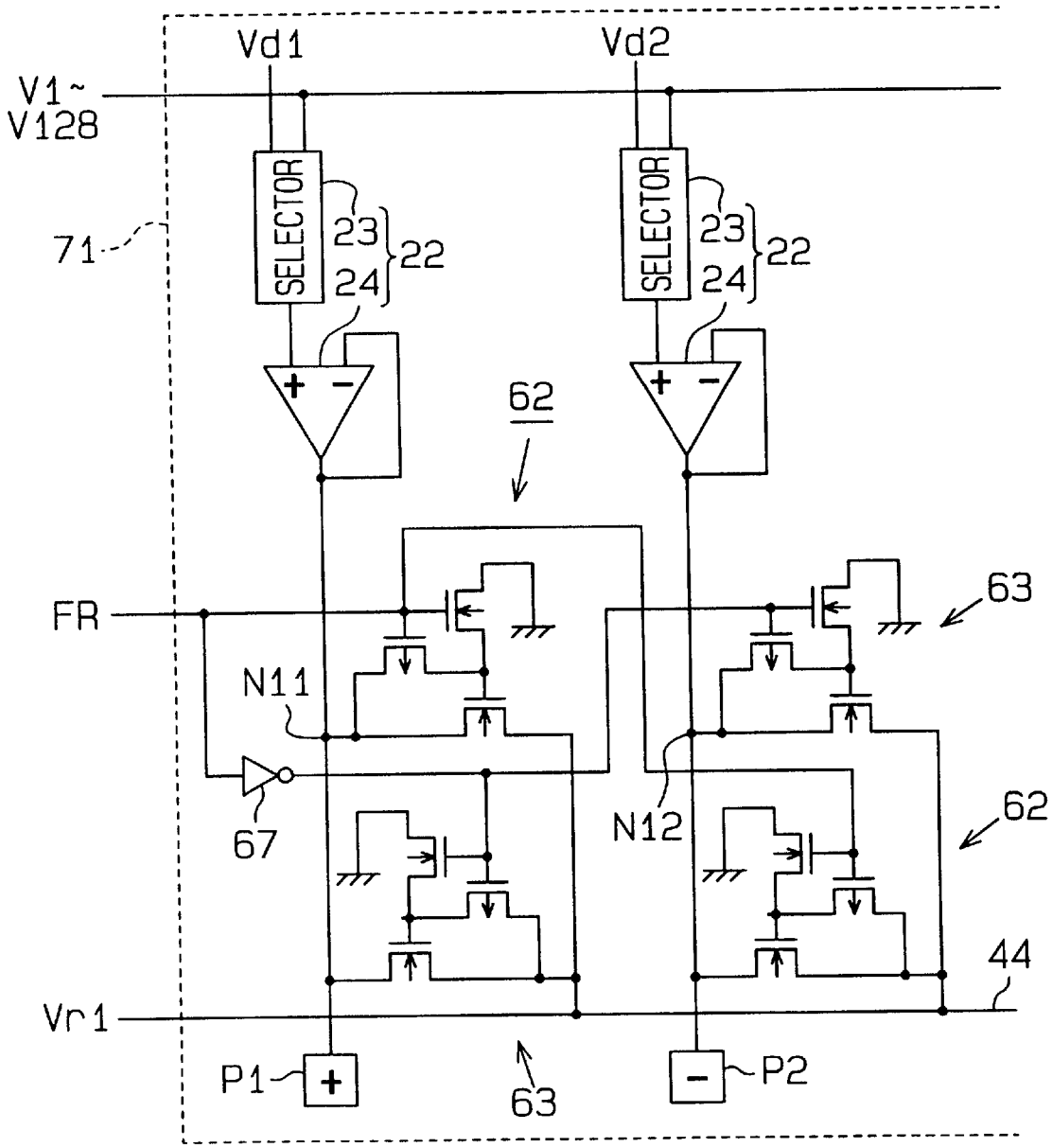
FIG. 17 is a block diagram of a sixth modification example of the data driver of FIG. 10.

FIG. 17 is a block diagram of a sixth modification example of a data driver 71 wherein the first and second switching circuits 62 and 63 are connected to the nodes N11 and N12 and the wire 44 that supplies the predetermined voltage Vr1.

Figure 7:
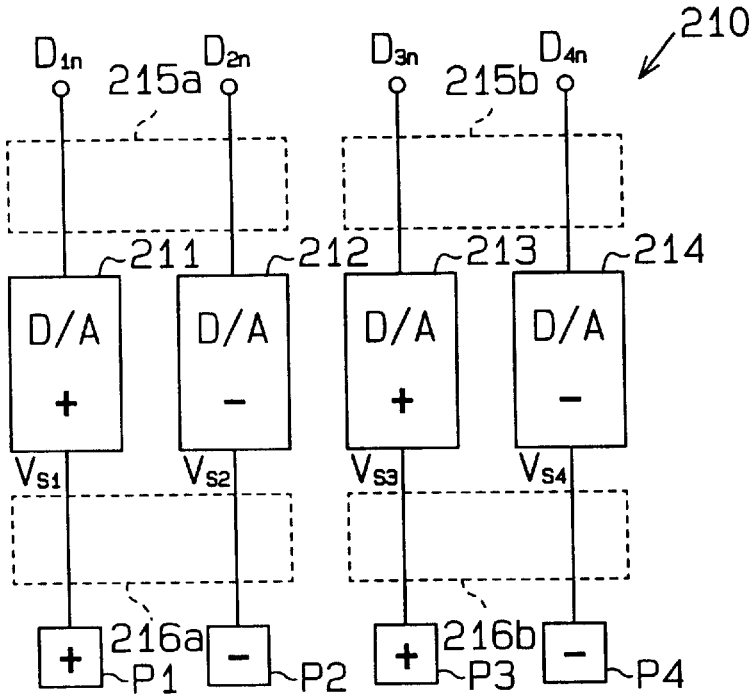
Fig.7 (Prior Art)
FIGS. 7 and 8 are diagrams illustrating the operation of the data driver of FIG. 5.
Figure 8:
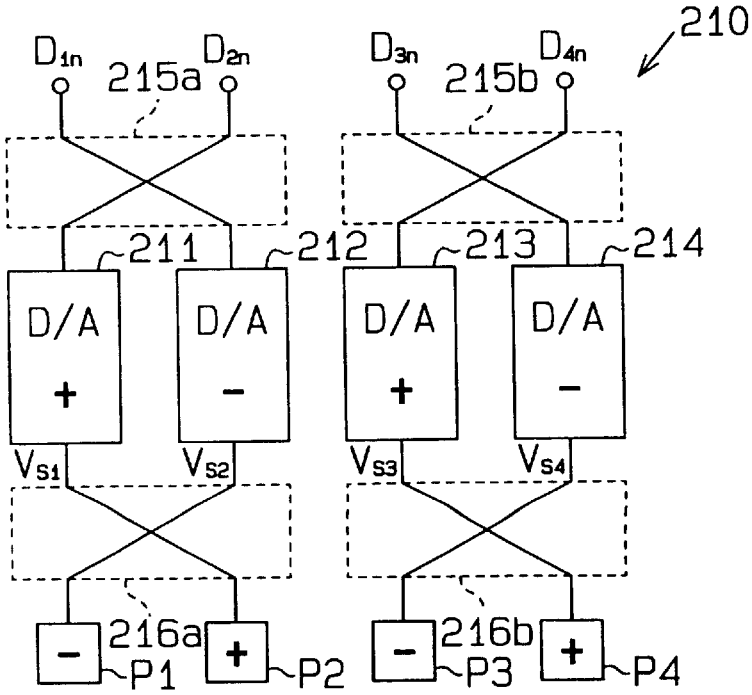
Fig.8 (Prior Art)
Figure 18:
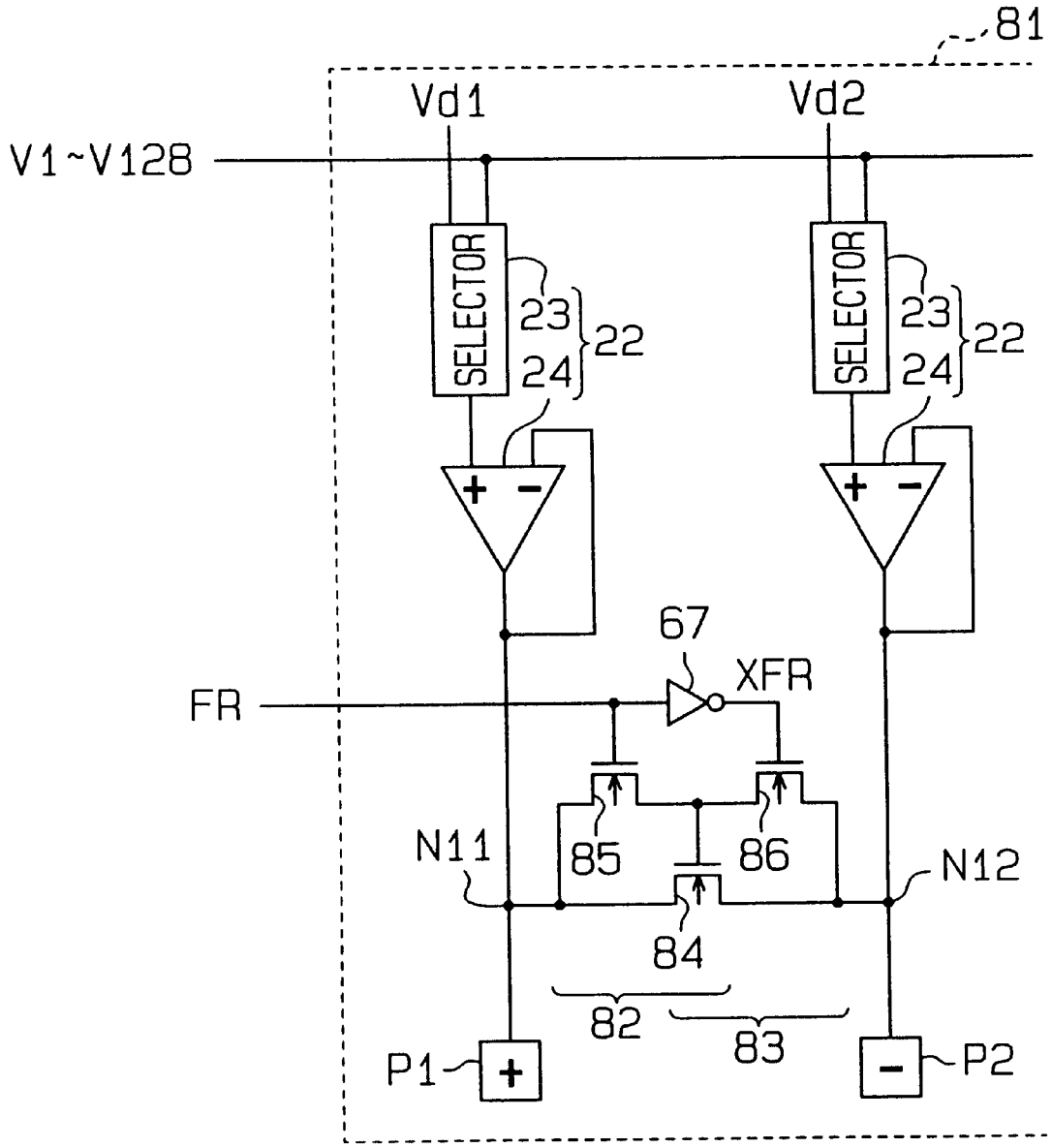
FIG. 18 is a block diagram of a seventh modification example of the data driver of FIG. 10.

FIG. 18 is a block diagram of a seventh modification example of a data driver 81 of FIG. 7. The data driver 81 is equipped with first and second switching circuits 82 and 83 connected to the nodes N11 and N12. The first switching circuit 82 comprises N-channel MOS transistors 84 and 85. The N-channel MOS transistor 84 is connected between the nodes N11 and N12 and the N-channel MOS transistor 85 is connected between the gate of the N-channel MOS transistor 84 and the node N11 and has a gate for receiving the polarity switching signal FR.

The second switching circuit 83 comprises N-channel MOS transistors 84 and 86. The N-channel MOS transistor 84 is shared by the first and second switching circuits 82 and 83. The N-channel MOS transistor 86 is connected between the gate of the N-channel MOS transistor 84 and the node N12 and has a gate for receiving the reverse polarity switching signal XFR reversed by the inverter circuit 67.

The first and second switching circuits 82 and 83 operate in the same way as the transistor 36 of FIG. 10. Accordingly, the power consumption is also reduced in the data driver 81 equipped with the D/A converters 22. Because the first and second switching circuits 82 and 83 share the first transistor 84, the circuit area is reduced.

Figure 19:
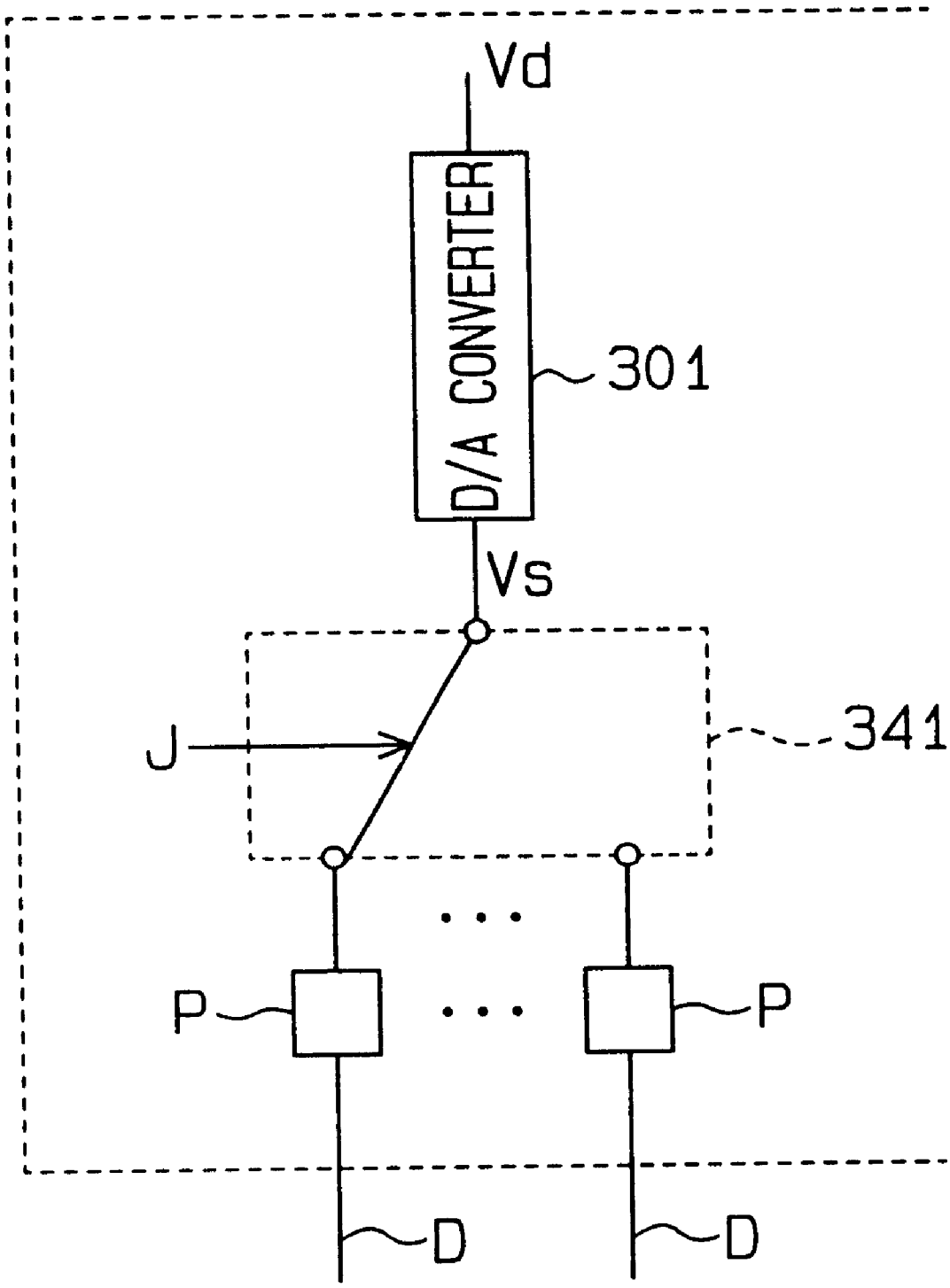
FIG. 19 is a general block diagram of a driver of the present invention.

FIG. 19 is a block diagram illustrating an outline of the driver of the present invention. The driver is equipped with a plurality of external output terminals P connected to the data lines D of the display panel, a D/A converter 301, and a time-division switch 341. The D/A converter 301 receives the picture signal Vd and outputs the display voltage Vs. The time division switch 341 is connected between the D/A converter 301 and a plurality of the external output terminals P and time divisionally outputs the display voltage Vs from the D/A converter 301 to a plurality of the external output terminals P according to a time-division control signal J.

Second Embodiment

Figure 20:
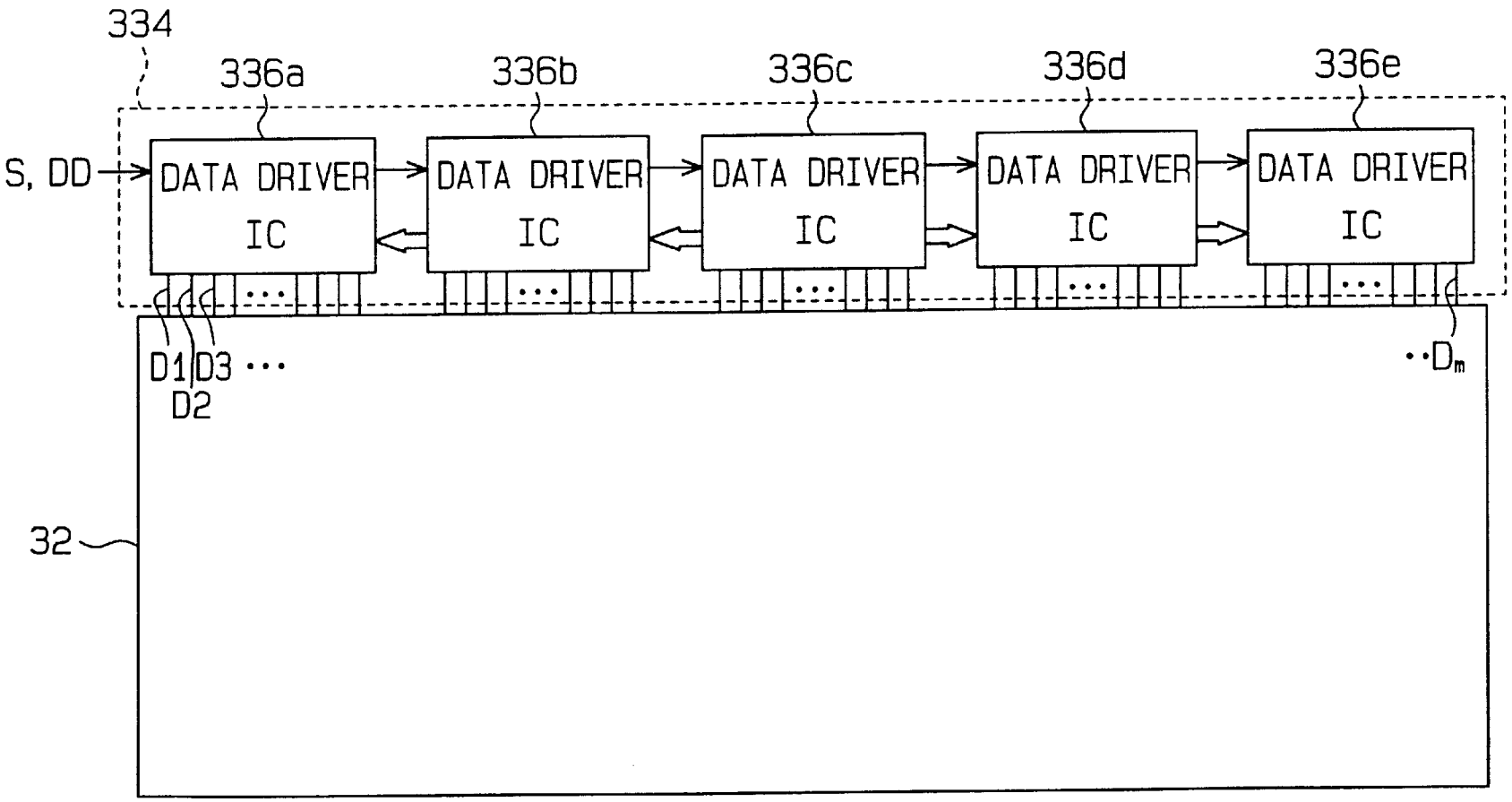
FIG. 20 is a block diagram of a data driver and a liquid-crystal display panel according to a second embodiment of the present invention.

As shown in FIG. 20, a data driver 334 connected to the liquid crystal display panel 32 is equipped with a plurality of (five in this case) integrated circuits devices or IC chips 336*a* to 336*e* connected in series. The IC chip 336*a* inputs a picture signal DD and a control signal S and outputs the control signal S to the next stage IC chip 336*b* in accordance with the clock signal contained in the control signal. The control signal also comprises a latch control pulse signal. Each of the IC chips 336*b* to 336*e* operates in the same way as the first stage IC chip 336*a* and transfers the control signal S.

Figure 21:
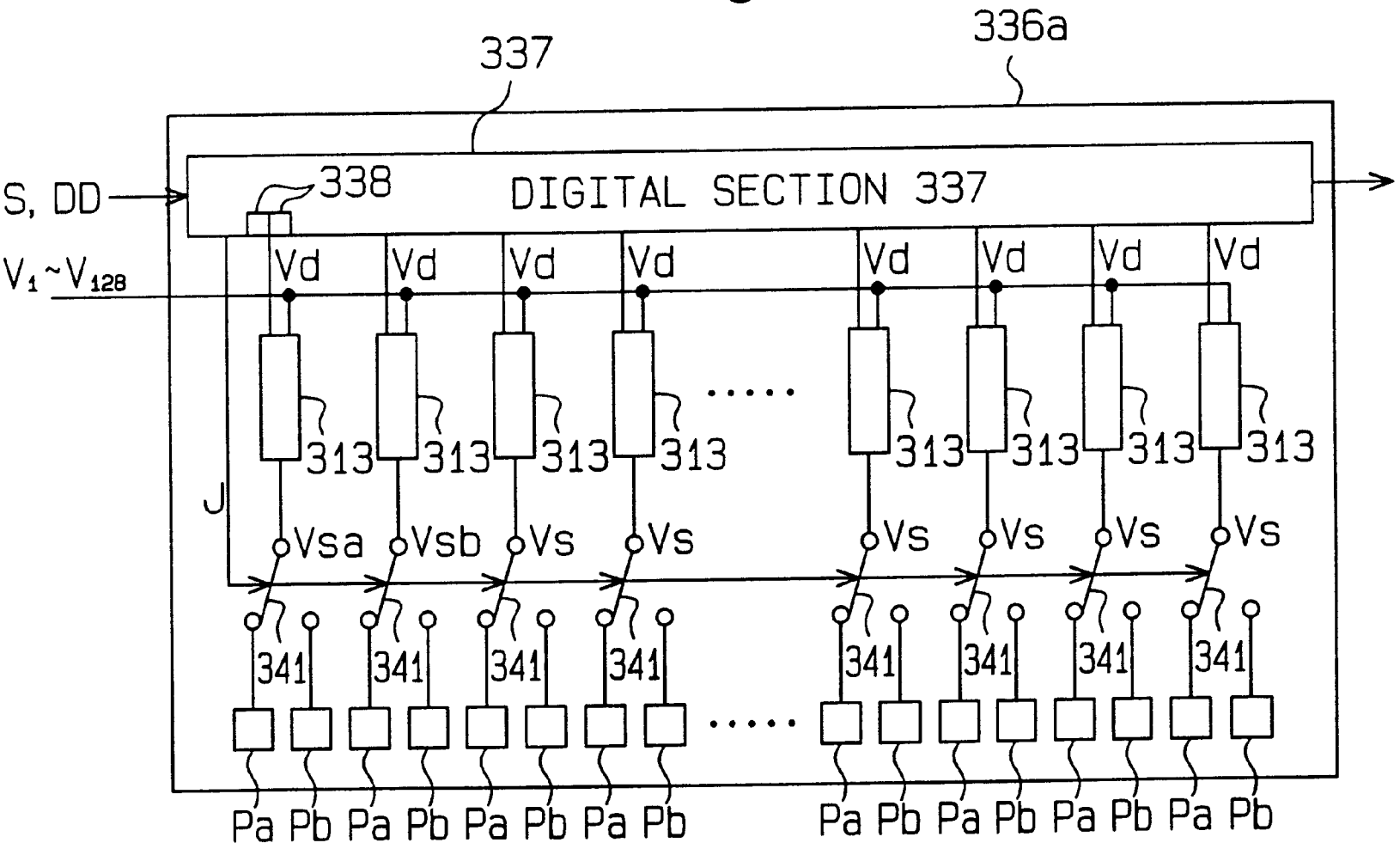
FIG. 21 is a schematic block circuit diagram of one of the data driver IC chips of FIG. 20.

FIG. 21 is a schematic block circuit diagram of the IC chip 336*a*. Each of the other IC chips 336*b* to 336*e* has the same structure as the IC chip 336*a*.

The IC chip 336*a* comprises a digital section 337, a plurality of digital-to-analog (D/A) converters 313, a plurality of time-division switches 341, and external output terminals (pads) Pa and Pb. The digital section 337 comprises latch circuits 338, shift registers (not illustrated), time-division drive control circuits (FIGS. 22 and 23) 339, and a control circuit (FIG. 23) 340. A pair of latch circuits 338 is connected to each one of the D/A converters 313. FIG. 21 illustrates only one pair of the latch circuits 338. The shift registers are used to transfer the latch control pulse signal.

Figures 24A, 24B:
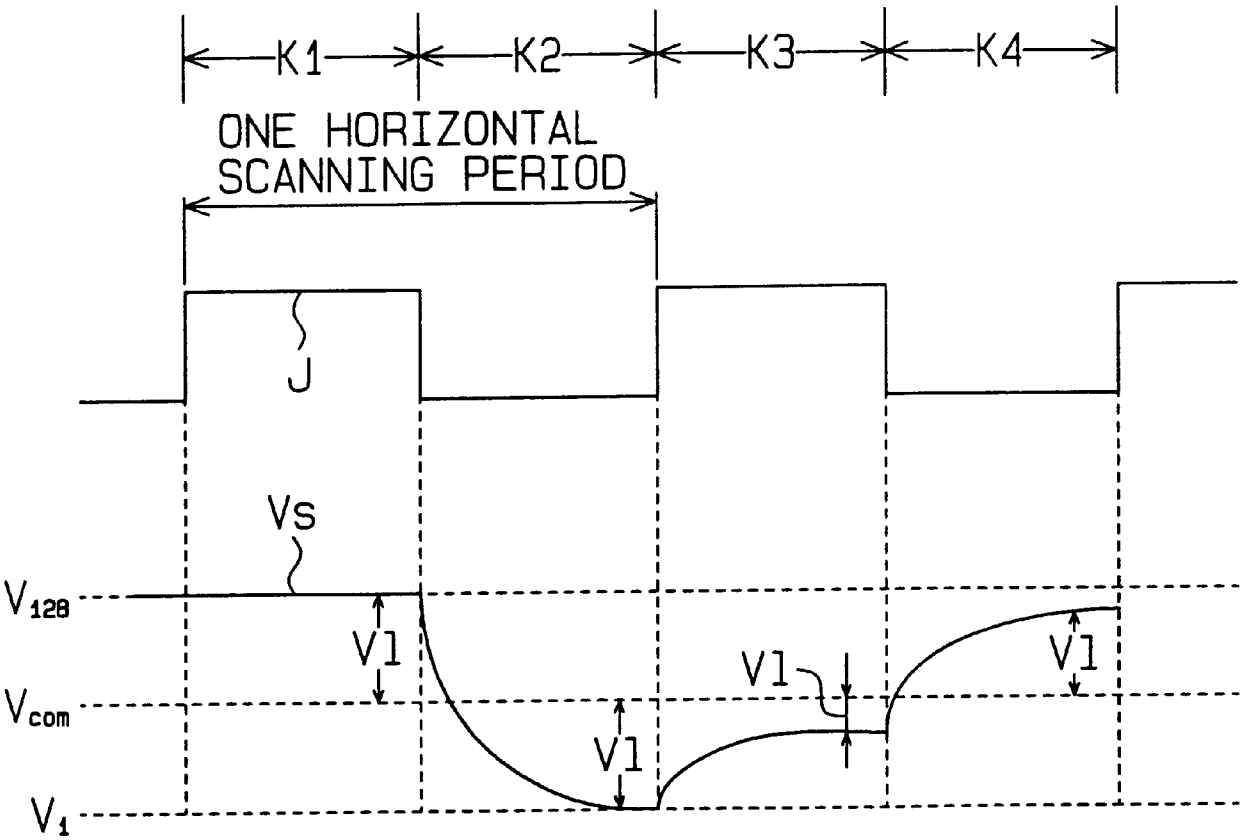
FIG. 24A is a waveform diagram of a time-division control signal.
FIG. 24B is a waveform diagram of the voltage output of the D/A converter of the IC chip of FIG. 21.

The control circuit 340 generates a time-division control signal J, which has a pulse width in one half of one horizontal scanning period shown in FIG. 24A, and supplies the time-division control signal J to the latch circuits 338 and the time-division switches 341. In other words, the time-division control signal J is a pulse signal that repeats the rising and falling edges every time in one horizontal scanning period. The time-division control signal J may be supplied from an external device.

The odd-numbered latch circuits 338 output the latched picture signal Vd to the D/A converter 313 in response to the rising edge of the time-division control signal J. The even-numbered latch circuits 338 output the latched picture signal Vd to the D/A converter 313 in response to the falling edge of the time-division control signal J.

Each of the D/A converters 313 alternately selects one of the positive gradation voltages V65 to V128 or the negative gradation voltages V1 to V64 and outputs the selection segment voltage Vs every time the time-division control signal J falls. Further, as shown in FIG. 24B, the D/A converter 313 reverses the polarity of the segment voltage Vs every half period of the horizontal scanning period.

Returning to FIG. 21, each of the time-division switches 341 is connected between the output terminal of one of the D/A converters 313 and a pair of the even-numbered and odd-numbered pads Pa and Pb.

Each of the time-division switches 341 connects the output terminal of one of D/A converters 313 and the even-numbered pad Pa in response to the rising edge of the time-division control signal J and connects the output terminal of the D/A converter 313 and the even-numbered pad Pa in response to the falling edge of the time-division control signal J. In other words, as shown in FIGS. 24A and 24B, during the periods K1 and K3 when the time-division control signal J has the H level, the segment voltages Vs from the D/A converters 313 are supplied to the odd-numbered pads Pa. During the periods K2 and K4 when the time-division control signal J has the L level, the segment voltages Vs are supplied to the even-numbered pads Pb. Thus, every horizontal scanning period, the positive-polarity and negative-polarity segment voltages Vs are alternately applied to each of the odd-numbered pads Pa and to each of the even-numbered pads Pb. The potential difference V1 between the common voltage Vcom and the segment voltage Vs corresponds to the display level (brightness) of the pixel cell.

Figure 22:
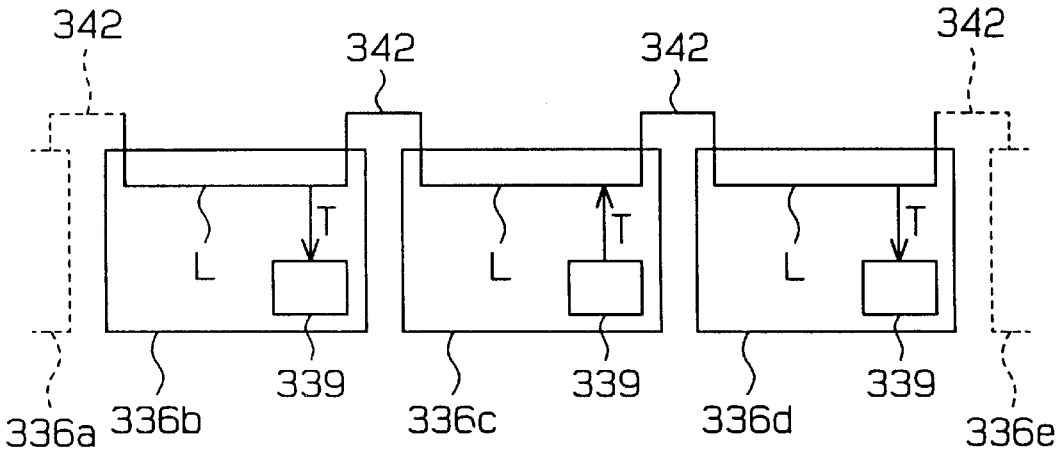
FIG. 22 is a schematic block circuit diagram of the IC chips of FIG. 21 having a time-division drive control circuit.

As shown in FIG. 22, each of the time-division drive control circuits 339 is connected to an internal wire L of each of the IC chips 336*a* to 336*e*, respectively. Each of the internal wires L are mutually connected by external wires 342 located between the respective IC chips 336*a* and 336*e*.

Figure 23:
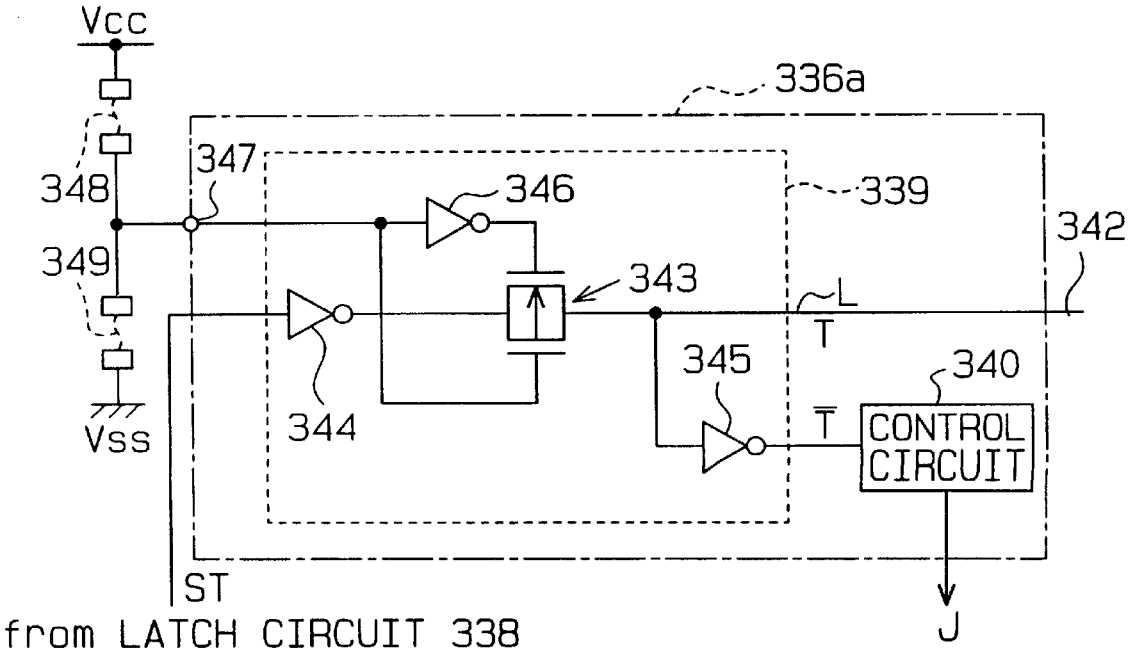
FIG. 23 is a more detailed block diagram of the time-division drive control circuit.

FIG. 23 is a block diagram of the time-division drive control circuit 339. The time-division drive control circuit 339 includes a CMOS type transfer gate 343 and three inverter circuits 344 to 346. The inverter circuit 344 has an input terminal for receiving a latch control pulse signal (start pulse signal) ST, which is transferred from the shift registers (not illustrated), and an output terminal connected to the internal wire L through the transfer gate 343. The control circuit 340 is connected to the output of the inverter circuit 345, and the input of the inverter 345 is connected to the internal wire L.

The P-channel MOS transistor gate of the transfer gate 343 is connected to an external terminal 347 of the IC chip 336*c*, and the N-channel MOS transistor gate of the transfer gate 343 is connected to the external terminal 347 through the inverter circuit 346. The external terminal 347 is connected to a high potential power supply Vcc through a high potential fuse 348 and connected to a low potential power supply Vss through a low potential fuse 349.

In the IC chip 336*c* located at the center of the IC chips 336*a* to 336*e*, the high potential fuse 348 is blown, and the low potential power supply voltage is supplied to the external terminal 347. Accordingly, the transfer gate 343 in the IC chip 336*c* is maintained in a conductive state. The time-division drive control circuit 339 of the IC chip 336*c* outputs a timing signal T to the external wire 342 in response to the latch control pulse signal ST from the shift registers. The control circuit 340 receives a timing signal /T from the inverter circuit 345 and generates the time-division control signal J in accordance with the timing signal /T.

In this embodiment, the latch control pulse signal ST is sequentially transmitted by the shift registers of the IC chips 336*a* to 336*e*. When the latch control pulse signal ST arrives at the input terminal of the shift register of the center IC chip 336*c*, half of one horizontal scanning period has elapsed. The transfer gate 343 is maintained in the conductive state so that a reference time-division control signal J is generated by the control circuit 340 of the center IC chip 336*c*. However, when the IC chip located at the intermediate point during the one horizontal scanning period is the IC chip 336*b* or IC chip 336*d*, the transfer gate 343 inside that IC chip may be maintained in the conductive state. Further, the number of IC chips may be changed to less than four or six or more. For example, when the number of IC chips is set to eight, the fifth stage-IC chip is located at the intermediate point of one horizontal scanning period. Accordingly, the transfer gate 343 of the fifth stage IC chip is maintained in the conductive state.

A counter may be used instead of the control circuit 340 of the center IC chip 343 to generate the time-division control signal J. As soon as the latch control pulse signal ST arrives at the shift register of the IC chip 336*c*, the counter counts the number of clock pulses of the latch control panel signal ST. When the number of clock pulses reaches the predetermined count, the counter outputs the time-division control signal J.

In the remaining IC chips 336*a*, 336*b*, 336*d*, and 336*e*, the low potential fuse 349 is blown, and the high potential power supply voltage is supplied to the external terminal 347. Accordingly, the transfer gate 343 in the IC chips 336*a*, 336*b*, 336*d*, and 336*e* is maintained in the conductive state. The time-division drive control circuits 339 in the IC chips 336*a*, 336*b*, 336*d*, and 336*e* receive the timing signal T from the time-division drive control circuit 339 of the center IC chip 336*c* through the external wire 342. The control circuit 340 receives the timing signal T through the inverter circuit 345 and generates the time-division control signal J. Thus, the time-division switches 341 of the IC chips 336*a*, 336*b*, 336*d*, and 336*e* synchronize with the time-division switch 341 of the center reference IC chip 336*c*.

The second embodiment has the following advantages.

(1) Because the time-division control signal J is supplied to the time-division switch 341 and the output terminal of the D/A converter 313 and the pads Pa and Pb are selectively connected, the number of the D/A converters is half the number of pads Pa and Pb. Accordingly, the circuit area of the data driver 334 (i.e., the size of the IC chips 336*a* to 336*e*) is reduced. In other words, the number of pixels for the liquid crystal display panel may be increased with a limited increase in circuit area.

(2) The IC chips 336*a* to 336*e* of the data driver 334 are equipped with circuits for generating the time-division control signal J. Accordingly, an external device does not require its own circuit.

(3) The time-division control signal J is supplied to the data driver 334 every horizontal scanning period and is easily generated in accordance with the latch control pulse signal.

(4) The center IC chip 336*c* generates the time-division control signal J matching the timing when the latch control pulse signal arrives at the input terminal of the shift register. Hence, no timing signal is required for synchronizing the time-division control signal J of all the chips 336*a* to 336*e*. Consequently, the circuit configuration of the data driver 34 is simplified.

(5) The remaining IC chips 336*a*, 336*b*, 336*d*, and 336*e* generate the time-division control signal J in accordance with the timing signal T output from the center IC chip 336*c*. Accordingly, the timing of the time-division control signal J of the IC chip 336*c* and the timing of the time-division control signals J of the remaining chips are accurately synchronized.

(6) The timing signal T is supplied from the center IC chip 336*c* to the adjacent IC chips 336*b* and 336*d* through the external wire 342 and is also supplied from the IC chips 336*b* and 336*d* to the adjacent IC chips 336*a* and 336*e* through the external wire 342. Because the IC chips 336*a* to 336*e* are linearly arranged, the external wire 342 is relatively short. Further, the total length of the external wire 342 is shorter than the common wire extending from the IC chip 336*a* to the IC chip 336*e*.

(7) The IC chip 336*c* which generates the reference timing signal T has an open high potential fuse 348, and the remaining IC chips which receive the timing signal T have an open low potential fuse 349. Accordingly, each of the IC chips 336*a* to 336*e* may be equipped with the time-division setting circuit 339 having the same configuration. As a result, the development and manufacturing costs of the IC chips 336*a* to 336*e* are reduced. Also, because the remaining IC chips do not generate the time-division control signal J in accordance with the latch control pulse signal, the time-division setting circuit 339 of the remaining IC chips may be omitted.

Third Embodiment

Figure 25:
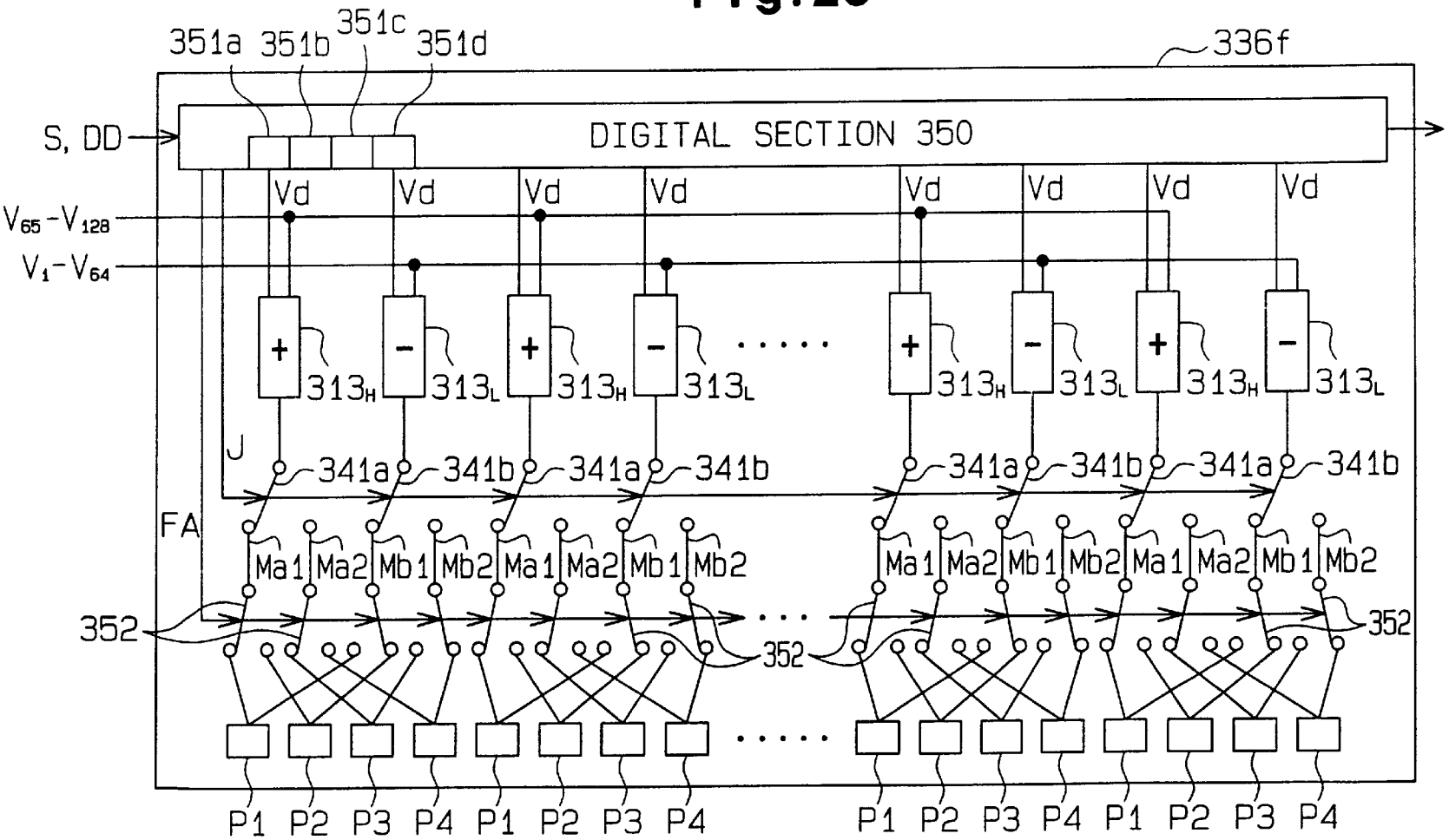
FIG. 25 is a schematic block circuit diagram of a first example of a data driver according to a third embodiment of the present invention.

FIG. 25 is a schematic block circuit diagram of an IC chip 336*f* of the data driver 334 according to a third embodiment of the present invention. The IC chip 336*f* comprises a digital section 350, a plurality of pairs of first and second D/A converters 313H and 313L, a plurality of pairs of time-division switches 341*a* and 341*b*, a plurality of pairs of first intermediate terminals Ma1 and Ma2, a plurality of pairs of second intermediate terminals Mb1 and Mb2, a plurality of polarity changeover switches 352, and a plurality of first to fourth pads P1 to P4. The digital section 350 comprises a plurality of first to fourth latch circuits 351*a* to 351*d*, shift registers (not illustrated), the time-division drive control circuit 339 (FIG. 23), and the control circuit 340 (FIG. 23). A pair of the first and second latch circuits 351*a* and 351*b* corresponds to the first D/A converter 313H, and a pair of the third and fourth latch circuits 351*c* and 351*d* corresponds to the second D/A converter 313L. FIG. 25 shows only the four first to fourth latch circuits 351*a* to 351*d* for one of the D/A converter pairs 313H, 313L.

The first to fourth latch circuits 351*a* to 351*d* latch the picture signal DD in response to the latch control pulse signal supplied from the shift registers.

During first horizontal scanning period, the first latch circuit 351*a* supplies the first latched picture signal Vd to the first D/A converter 313H, and the second latch circuit 351*b* supplies the second latched picture signal Vd to the second D/A converter 313L. The third latch circuit 351*c* supplies the third latch picture signal Vd to the third D/A converter 313H and the fourth latched circuit supplies the fourth latched picture signal Vd to the fourth D/A converter 313L. Note that the third and fourth D/A converters mentioned above is a pair of the first and second D/A converters 313H, 313L.

During next second horizontal scanning period, the second latch circuit 351*b* supplies the second latched picture signal Vd to the first D/A converter 313H, and the first latch circuit 351*a* supplies the first latched picture signal Vd to the second D/A converter 313L. The fourth latch circuit 351*d* supplies the fourth latched picture signal Vd to the third D/A converter 313H, and the third latch circuit 351*c* supplies the third latched picture signal to the fourth D/A converter 313L.

Accordingly, during the first and second horizontal scanning periods, the first and third D/A converter 313H respectively sequentially receive the first latched picture signal and the third latched picture signal and then the second latched picture signal, and the fourth latched picture signal. The second and fourth D/A converters 313L respectively sequentially receive the second latched picture signal and the fourth latched picture signal and the first latched picture signal, and the third latched picture signal.

Each first D/A converter 313H (i.e., the first and third converters here) selects one of the positive gradation voltages V65 to V128 in accordance with the picture signal Vd and outputs the positive-polarity segment voltage Vs. Each second D/A converter 313L (i.e., the second and fourth converters here) selects one of the negative gradation voltages V1 and V64 in accordance with the picture signal Vd and outputs the negative-polarity segment voltage Vs. Hereafter, the third and fourth D/A converters are referred to as first and second D/A converters, since the third and fourth D/A converter converters comprises a pair of first and second D/A converters. However, one of ordinary skill in the art will still readily be able to understood this embodiment.

The first time-division switch 341*a* is connected between the output terminal of the first D/A converter 313H and a pair of the first intermediate terminals Ma1 and Ma2. The first time-division switch 341*a* connects the output terminal of the first D/A converter 313H and the first intermediate terminal Ma1 in response to the rising edge of the time-division control signal J and connects the output terminal of the first D/A converter 313H and the first intermediate terminal Ma2 in response to the falling edge of the time-division control signal J.

The second time-division switch 341*b* is connected between the output terminal of the second D/A converter 313L and a pair of the second intermediate terminals Mb1 and Mb2. The second time-division switch 341*b* connects the output terminal of the second D/A converter 313L to the second intermediate terminal Mb1 in response to the rising edge of the time-division control signal J and connects the output terminal of the second D/A converter 313L to the second intermediate terminal Mb2 in response to the falling edge of the time-division control signal J.

The first polarity changeover switch 352 is connected between the first intermediate terminal Ma1 and the first and second pads P1 and P2, and the second polarity changeover switch 352 is connected between the first intermediate terminal Ma2 and the third and fourth pads P3 and P4. The third polarity changeover switch 352 is connected between the second intermediate terminal Mb1 and the first and second pads P1 and P2, and the fourth polarity changeover switch 352 is connected between the second intermediate terminal Mb2 and the third and fourth pads P3 and P4.

During the odd-numbered horizontal scanning periods, the first polarity changeover switch 352 connects the first intermediate terminal Ma1 and the first pad P1, and the second polarity changeover switch 352 connects the first intermediate terminal Ma2 and the third pad P3. The third polarity changeover switch 352 connects the second intermediate terminal Mb2 and the second pad P2, and the fourth polarity changeover switch 352 connects the second intermediate terminal Mb2 and the fourth pad P4. Accordingly, the positive-polarity segment voltage Vs is supplied from the first D/A converter 313H to the first and third pads P1 and P3, and the negative-polarity segment voltage Vs is supplied from the second D/A converter 313L to the second and fourth pads P2 and P4.

During the even-numbered horizontal scanning periods, the first polarity changeover switch 352 connects the first intermediate terminal Ma1 and the second pad P2, and the second polarity changeover switch 352 connects the first intermediate terminal Ma2 and the fourth pad P4. The third polarity changeover switch 352 connects the second intermediate terminal Mb1 and the first pad P1, and the fourth polarity changeover switch 352 connects the second intermediate terminal Mb2 and the third pad P3. Accordingly, the positive-polarity segment voltage Vs is supplied from the first D/A converter 313H to the second and fourth pads P2 and P4, and the negative-polarity segment voltage Vs is supplied from the second D/A converter 313L to the first and third pads P1 and P3.

The third embodiment has the following advantages.

(1) The first and second time-division switches 341*a* and 341*b* supply the segment voltage Vs from the first and second D/A converters 313H and 313L to the first to fourth pads P1 to P4 during one horizontal scanning period. Accordingly, the number of first and second D/A converters 313H and 313L is one-fourth the number of first to fourth pads P1 to P4. Consequently, the size of the IC chip 336*f* is reduced and the number of pixels for the liquid crystal display panel is increased.

(2) The first and second D/A converters 313H and 313L have a simpler structure than the D/A converter 313 of FIG. 21 and the circuit area is smaller.

(3) The positive-polarity and negative-polarity segment voltages Vs from the first and second D/A converters 313H and 313L are selectively supplied to the first to fourth pads P1 to P4 by the polarity changeover switch 352. Thus, the potential difference between the common voltage Vcom and segment voltage Vs is stably supplied every one horizontal scanning period, and screen flickering is reduced.

Figure 26:
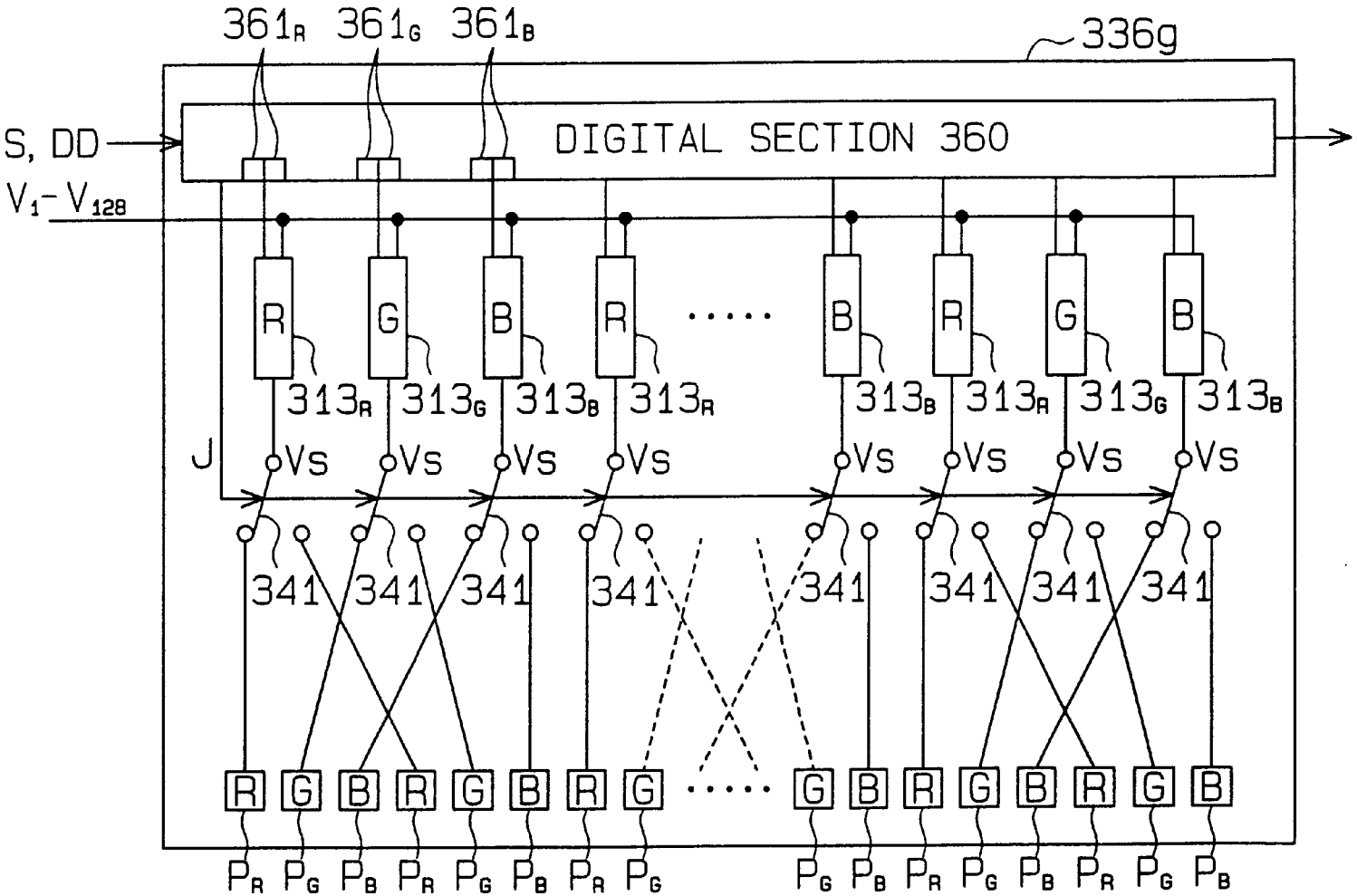
FIG. 26 is a block diagram of a second example of the data driver of the third embodiment.

FIG. 26 is a block diagram of an IC chip 336*g* of the data driver that drives a color liquid crystal display panel in the modification example according to the second embodiment. The IC chip 336*g* has three pad groups PR, PG, and PB that correspond to the display colors (red, green, and blue). The pad PR for red, the pad PG for green, and the pad PB for blue are arranged sequentially.

A digital section 360 comprises 3-system shift registers (not illustrated) that correspond to the three colors (red, green, and blue), latch circuits 361R, 361G, and 361B, three system D/A converters 313R, 313G, and 313B, and a plurality of time-division switches 341. FIG. 26 shows three of the system latch circuits 361R, 361G, and 361B.

The first time-division switch 341 selectively switches the connection between the output terminal of the D/A converter 313R for red and the two pads PR for red in response to the time-division control signal J. The second time-division switch 341 selectively switches the connection between the output terminal of the D/A converter 313G and two pads PG for green in response to the time-division control signal J. The third time-division switch 341 selectively switches the connection between the output terminal of the D/A converter 313B for blue and the two pads for blue. Thus, the segment voltage Vs is supplied from the D/A converters 313R, 313G, and 313B to the selected pads PR, PG, and PB during the one horizontal scanning period, respectively. Accordingly, the number of D/A converters 313R, 313G, and 313B is half the number of pads PR, PG, and PB. Further, the interconnect wire patterns connecting the three-system latch circuits 361R, 361G, and 361B and three-system D/A converters 313R, 313G, and 313B are simplified.

The modification example of FIG. 26 may also be applied to the IC chip 336*f* according to the third embodiment. In this case, a group of first to fourth pads P1 to P4 is arranged at the position of the pads PR, PG, and PB.

In the second and third embodiments, the number of pads connected to one time-division switch may be two or more. For example, when the time-division switch is connected to three pads, the time-division control signal J must be generated when the horizontal scanning period is divided by three. In this configuration, the number of D/A converters is one-third the number of pads.

Fourth Embodiment

Figure 5:
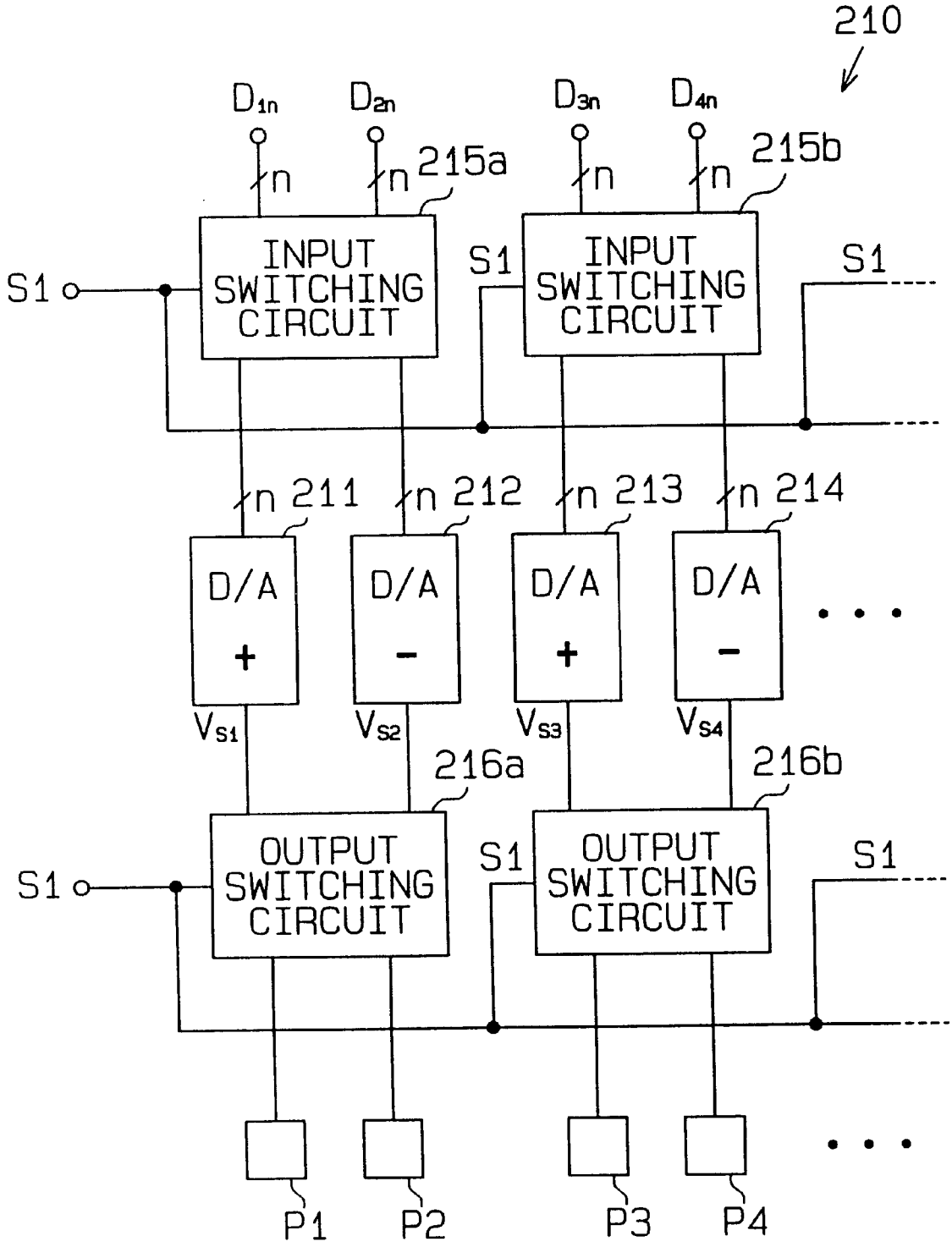
Fig.5(Prior Art)
FIG. 5 is a schematic block diagram of a fourth conventional data driver.
Figure 6:
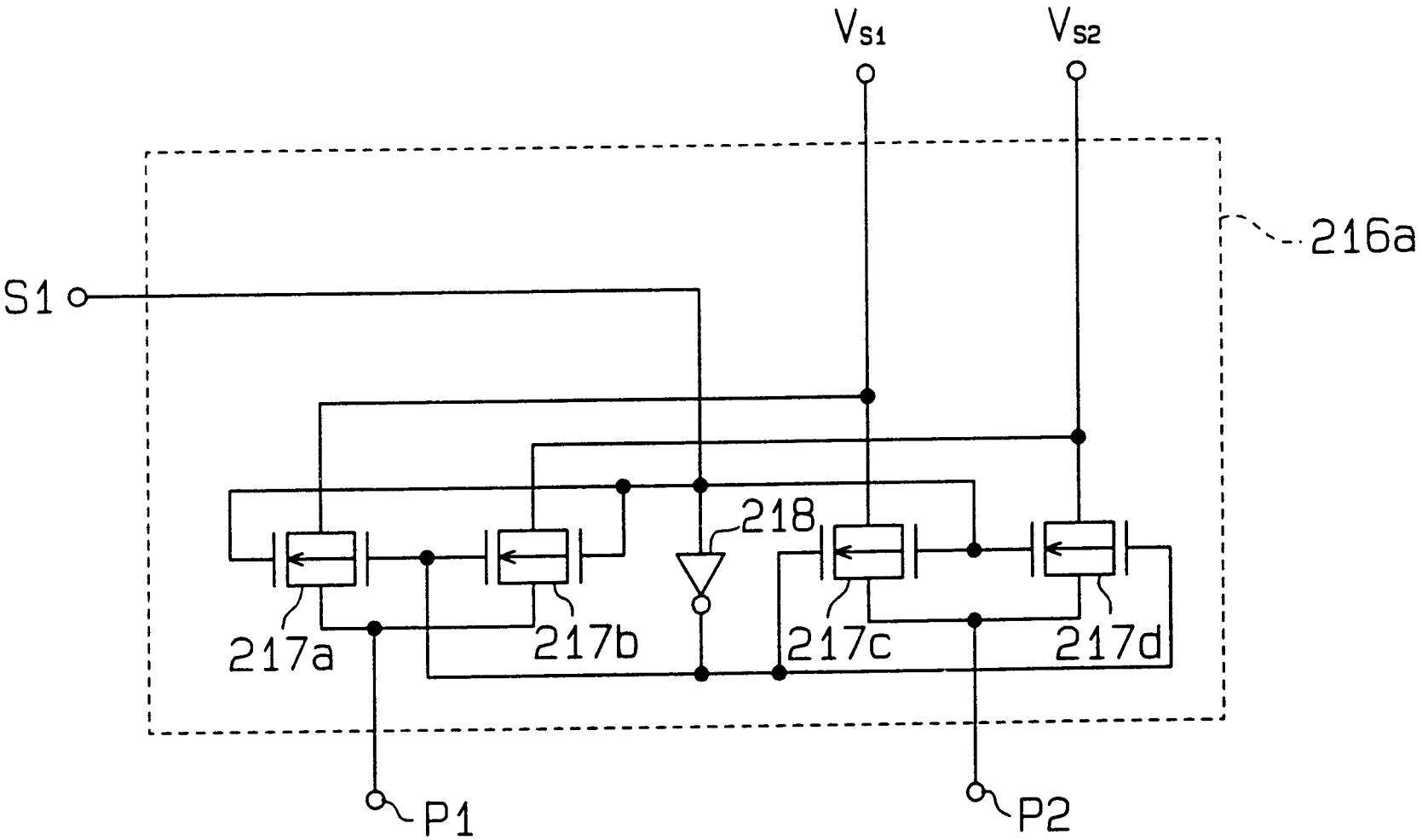
Fig.6(Prior Art)
FIG. 6 is a circuit diagram of an output switching circuit of the data driver of FIG. 5.
Figure 27:
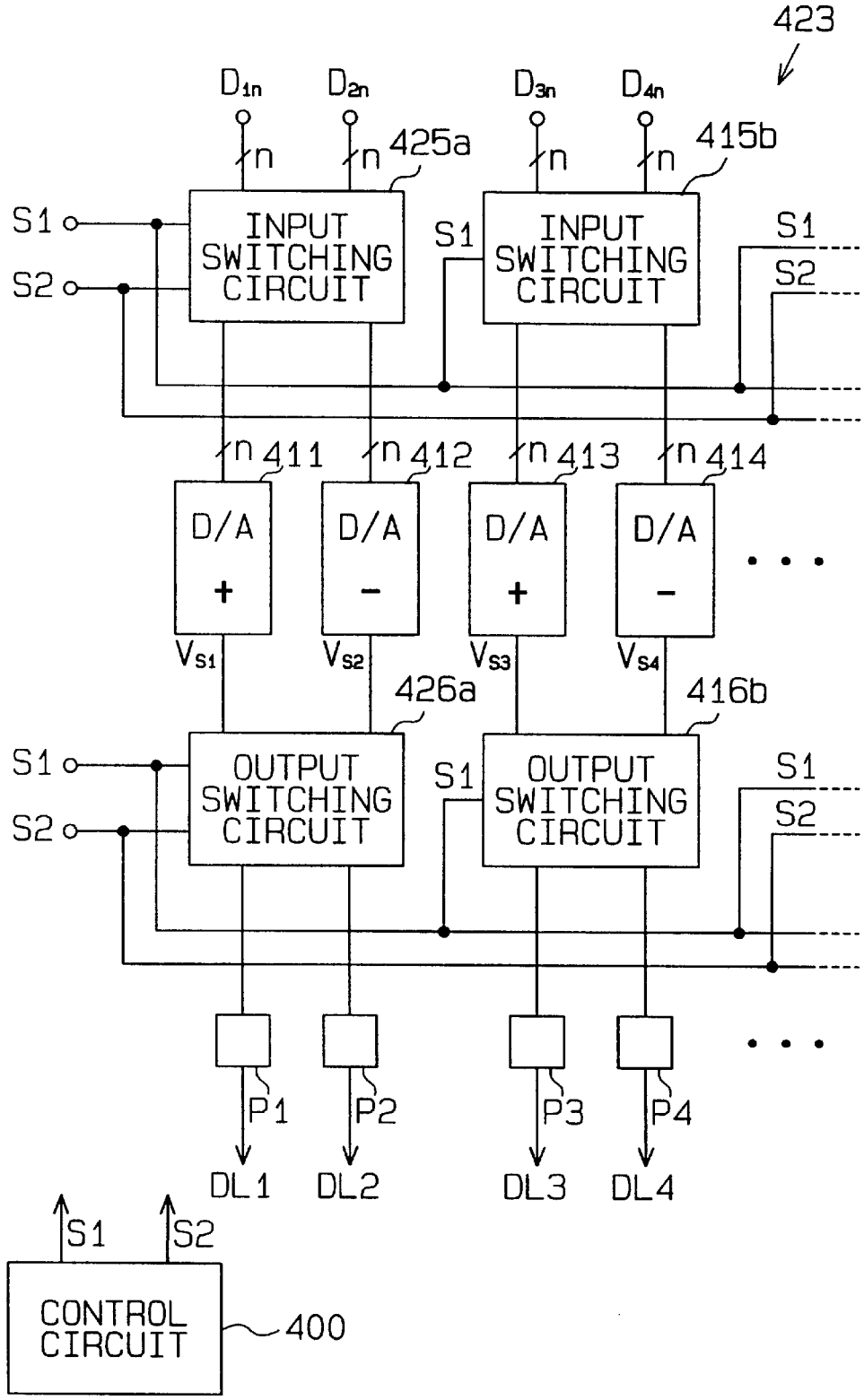
FIG. 27 is a block diagram of a data driver according to a fourth embodiment of the present invention.

FIG. 27 is a block diagram of a data driver 423 according to a fourth embodiment of the present invention. The data driver 423 is equipped with a plurality of groups of first to fourth digital-to-analog (D/A) converters 411 to 414, a plurality of pairs of first and second input switching circuits 425*a* and 415*b*, a plurality of pairs of first and second output switching circuits 426*a* and 416*b*, shift registers and latch circuits (neither are illustrated). The second input switching circuit 415*b* and the second output switching circuit 416*b* have the same configuration as the input switching circuit 215*b* and output switching circuit 216*b* in the conventional example of FIG. 5. FIG. 27 shows only the four first to fourth D/A converters 411 to 414 related to four data lines DL1 to DL4.

The first input switching circuit 425*a* selects either the picture signal D1n or D2n supplied from the latch circuits in accordance with a polarity switching signal S1 and a number of pixels selection signal S2, and the selected picture signal is supplied to the first D/A converter 411. The first input switching circuit 425*a* also selects the remaining other of the picture signal D1n or D2n and outputs the selected picture signal to the second D/A converter 412. The polarity switching signal S1 and the number of pixels selection signal S2 are output from a control circuit 400.

The second input switching circuit 415*b* supplies a picture signal D3n to the third D/A converter 413 and a picture signal D4n to the fourth D/A converter 414 in response to the polarity switching signal S1 having a H level. The input switching circuit 415*b* also supplies the picture signal D3n to the fourth D/A converter 414 and the picture signal D4n to the third D/A converter 413 in response to the polarity switching signal S1 having a L level.

The first output switching circuit 426*a* selects either the positive-polarity voltage Vs1 from the D/A converter 411 or the negative-polarity voltage Vs2 from the second D/A converter 412 in accordance with the polarity switching signal S1 and the number of pixels selection signal S2 and supplies the selected polarity voltage to the output terminal P1. The output switching circuit 426*a* also supplies the remaining other of the positive-polarity voltage Vs1 or negative-polarity voltage Vs2 to the output terminal P2. The details of the output switching circuit 426*a* are described later.

The second output switching circuit 416*b* supplies the positive-polarity voltage Vs3 from the third D/A converter 413 to the output terminal P3 and the negative-polarity voltage Vs4 from the fourth D/A converter 414 to the output terminal P4 in response to the polarity switching signal S1 having a H level. The output switching circuit 416*b* also supplies the positive-polarity voltage Vs3 to the output terminal P4 and supplies the negative-polarity voltage Vs4 to the output terminal P3 in response to the polarity switching signal S1 having a L level.

Figure 28:
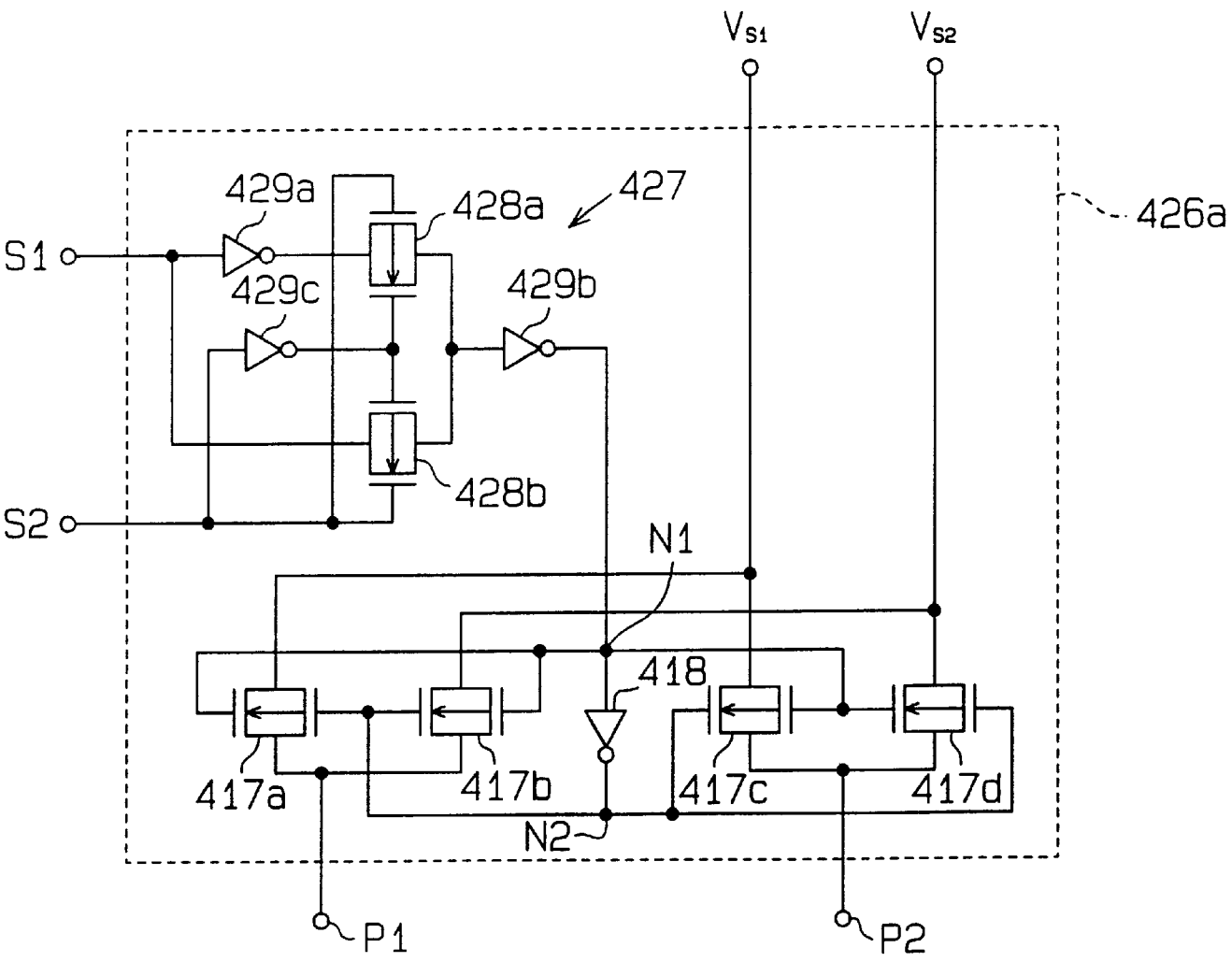
FIG. 28 is a block diagram of an output switching circuit of the data driver of FIG. 27.

FIG. 28 is a block diagram of the output switching circuit 426*a*. The output switching circuit 426*a* includes four CMOS type transfer gates 417*a* to 417*d*, an inverter circuit 418, and an exclusive-OR (EOR) circuit 427.

The transfer gates 417*a* and 417*c* are connected between the output terminal of the first D/A converter 411 and the output terminals P1 and P2. The transfer gates 417*b* and 417*d* are connected between the output terminal of the second D/A converter 412 and the outputs terminals P1 and P2.

The inverter circuit 418 has an input terminal (i.e. node N1), connected to the NMOS transistor gates of the transfer gates 417*a* and 417*d* and the PMOS transistor gates of the transfer gates 417*b* and 417*c*, and an output (i.e. node N2) connected to the PMOS transistor gates of the transfer gates 417*a* and 417*d* and the NMOS transistor gates of the transfer gates 417*b* and 417*c*.

The EOR circuit 427 includes two CMOS type transfer gates 428*a* and 428*b* and three inverter circuits 429*a* to 429*c*. The PMOS transistor gate of the transfer gate 428*a* and the NMOS transistor gate of the transfer gate 428*b* receive the number of pixels selection signal S2. The NMOS transistor gate of the transfer gate 428*a* and the PMOS transistor gate of the transfer gate 428*b* receive the number of pixels selection signal S2 inverted by the inverter circuit 429*c*.

When the number of pixels selection signal S2 has a L level, the transfer gate 428*a* is conductively connected and the transfer gate 428*b* is not conductively connected. In this case, the polarity switching signal S1 is supplied to the node N1 through the transfer gate 428*b* and the inverter circuit 429*b*. Then, when the polarity switching signal S1 has a H level, the transfer gates 417*a* and 417*d* are conductively connected and the transfer gates 417*b* and 417*c* are not conductively connected. Accordingly, the positive-polarity voltage Vs1 from the first D/A converter 411 is supplied to the output terminal P1 through the transfer gate 417*a*, and the negative-polarity voltage Vs2 from the second D/A converter 412 is supplied to the output terminal P2 through the transfer gate 417*d*.

Further, when the polarity switching signal S1 has a L level, the transfer gates 417*b* and 417*c* are conductively connected and the transfer gates 417*a* and 417*d* are not conductively connected. Accordingly, the positive-polarity voltage Vs1 from the first D/A converter 411 is supplied to the output terminal P2 through the transfer gate 417*c*, and the negative-polarity voltage Vs2 from the second D/A converter 412 is supplied to the output terminal P1 through the transfer gate 417*b*.

When the number of pixels selection signal S2 has a H level, the transfer gate 428*b* is conductively connected and the transfer gate 428*a* is not conductively connected. In this case, the polarity switching signal S1 is supplied to the node N1 through the inverter circuit 429*a*, transfer gate 428*a*, and inverter circuit 429*b*. Then, when the polarity switching signal S1 has a H level, the transfer gates 417*b* and 417*c* are conductively connected and the transfer gates 417*a* and 417*d* are not conductively connected. Accordingly, the positive-polarity voltage Vs1 from the first D/A converter 411 is supplied to the output P2 through the transfer gate 417*c*, and the negative-polarity voltage Vs2 from the second D/A converter 412 is supplied to the output terminal P1 through the transfer gate 417*b*.

Further, when the polarity switching signal S1 has a L level, the transfer gates 417*a* and 417*d* are conductively connected and the transfer gates 417*b* and 417*c* are not conductively connected. Accordingly, the positive Vs1 from the first D/A converter 411 is supplied to the output terminal P1 through the transfer gate 417*a* and the negative-polarity voltage Vs2 from the second D/A converter 412 is supplied to the output terminal P2 through the transfer gate 417*d*.

The polarity switching signal S1 is switched to the H level or L level each horizontal scanning period. However, the polarity switching signal S1 is inverted every two or more horizontal scanning periods. The number of pixels selection signal S2 is preferably set to the L level to perform the polarity reverse control in a unit of a dot (one pixel cell), and when a flicker occurs in the picture on the liquid-crystal display panel, it is set to the H level to perform the polarity reverse control in a unit of two dots (two pixel cells). In other words, when the polarity is reversed in a unit of two dots, it ensures that the brightness unevenness of the pixel cell, that is, the picture flicker, is reduced. The level of the number of pixels selection signal S2 is set by the control circuit 400 in accordance with a setting signal from an external device.

[1-Dot Reverse Control]

Figure 29:
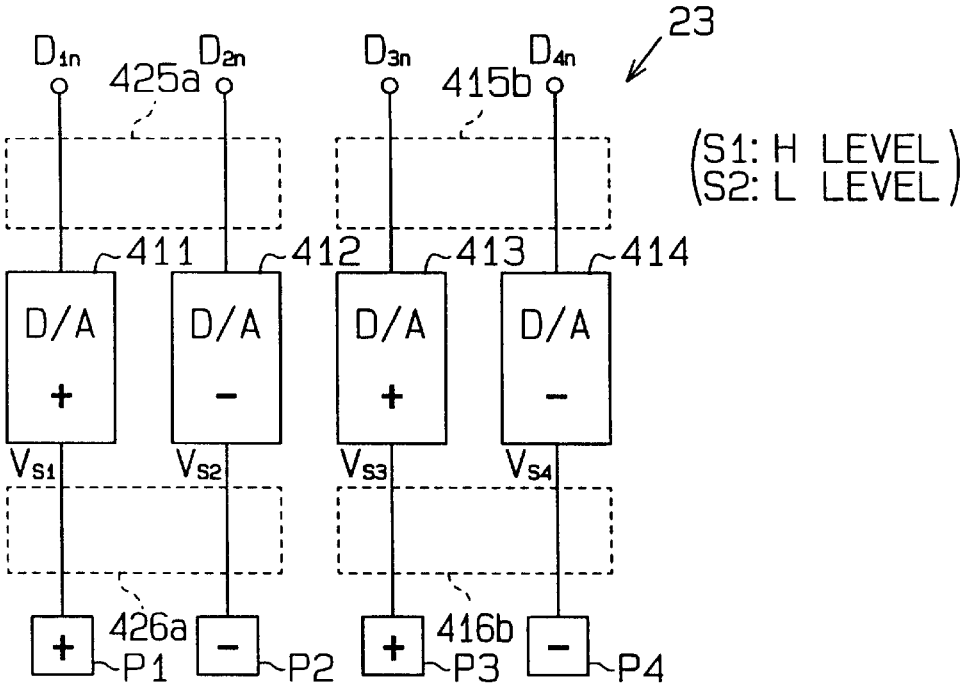
FIGS. 29 and 30 are diagrams illustrating the voltage reverse operation in a one-pixel unit of the data driver of FIG. 27.

As shown in FIG. 29, the input switching circuit 425*a* supplies the picture signals D1n and D2n to the first and second D/A converters 411 and 412 in response to the polarity switching signal S1 having a H level and the number of pixels selection signal S2 having a L level, respectively. The input switching circuit 415*b* supplies the picture signals D3n and D4n to the third and fourth D/A converters 413 and 414 in response to the polarity switching signal S1 having a H level, respectively.

The output switching circuit 426*a* supplies the positive-polarity and negative-polarity voltages Vs1 and Vs2 to the output terminals P1 and P2 in response to the polarity switching signal S1 having a H level and the number of pixels selection signal S2 having a L level, respectively. The output switching circuit 416*b* supplies the positive-polarity and negative-polarity voltages Vs3 and Vs4 to the output terminals P3 and P4 in response to the polarity switching signal S1 having a H level, respectively.

Figure 30:
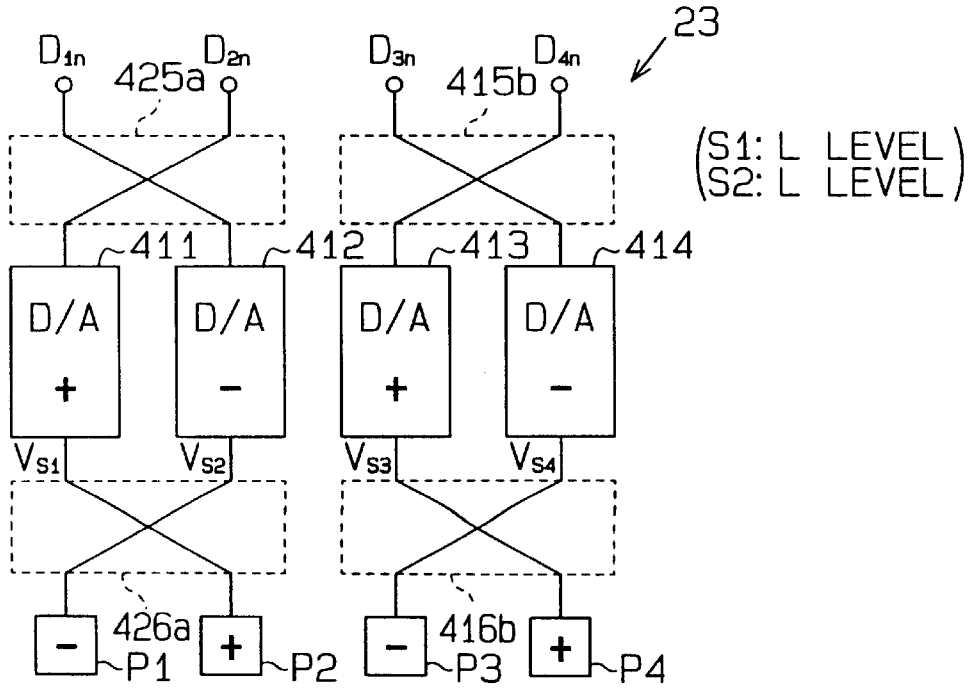

As shown in FIG. 30, the input switching circuit 425*a* supplies the picture signals D1n and D2n to the second and first D/A converters 412 and 411 in response to the polarity switching signal S1 having a L level and the number of pixels selection signal S2 having a L level, respectively. The input switching circuit 415*b* supplies the picture signals D3n and D4n to the fourth and third D/A converters 414 and 413 in response to the polarity switching signal S1 having a L level, respectively.

The output switching circuit 426*a* supplies the positive-polarity and negative-polarity voltages Vs1 and Vs2 to the output terminals P2 and P1 in response to the polarity switching signal S1 having a L level and the number of pixels selection signal S2 having a L level, respectively. The output switching circuit 416*b* supplies the positive-polarity and negative-polarity voltages Vs3 and Vs4 to the output terminals P4 and P3 in response to the polarity switching signal S1 having a L level, respectively.

As described above, the data driver 423 alternately supplies the positive-polarity and negative-polarity voltages to a pair of output terminals P1 and P2 or P3 and P4 every one horizontal scanning period so that the voltage supplied to adjacent output terminals can have mutually different polarities. In other words, the polarity of the picture voltage is reversed in a unit of a pixel cell.

[2-Dot Reverse Control]

Figure 31:
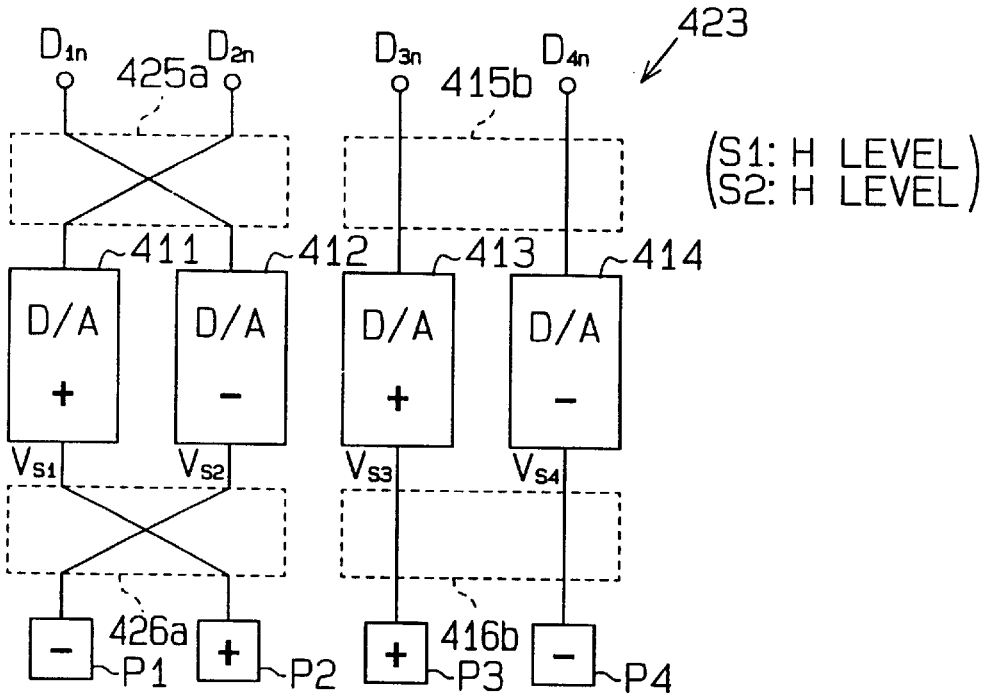
FIGS. 31 and 32 are diagrams illustrating the voltage reverse operation in a two-pixel unit of the data driver of FIG. 27.

As shown in FIG. 31, the input switching circuit 425*a* supplies the picture signals D1n and D2n to the second and first D/A converters 412 and 411 in response to the polarity switching signal S1 having a H level and the number of pixels selection signal having a H level, respectively. The input switching circuit 415*b* supplies the picture signals D3n and D4n to the third and fourth D/A converters 413 and 414 in response to the polarity switching signal S1 having a H level, respectively.

The output switching circuit 426*a* supplies the positive-polarity and negative-polarity voltages Vs1 and Vs2 in response to the polarity switching signal S1 having a H level and the number of pixels selection signal S2 having a H level, respectively. The output switching circuit 416*b* supplies the positive-polarity and negative-polarity voltages Vs3 and Vs4 to the output terminals P3 and P4 in response to the polarity signal S1 having a H level, respectively.

The polarity voltage is also applied to the two pairs of output terminals (not illustrated) adjacent to two pairs of the output terminals P1 to P4 in the same way as shown in FIG. 31.

Figure 32:
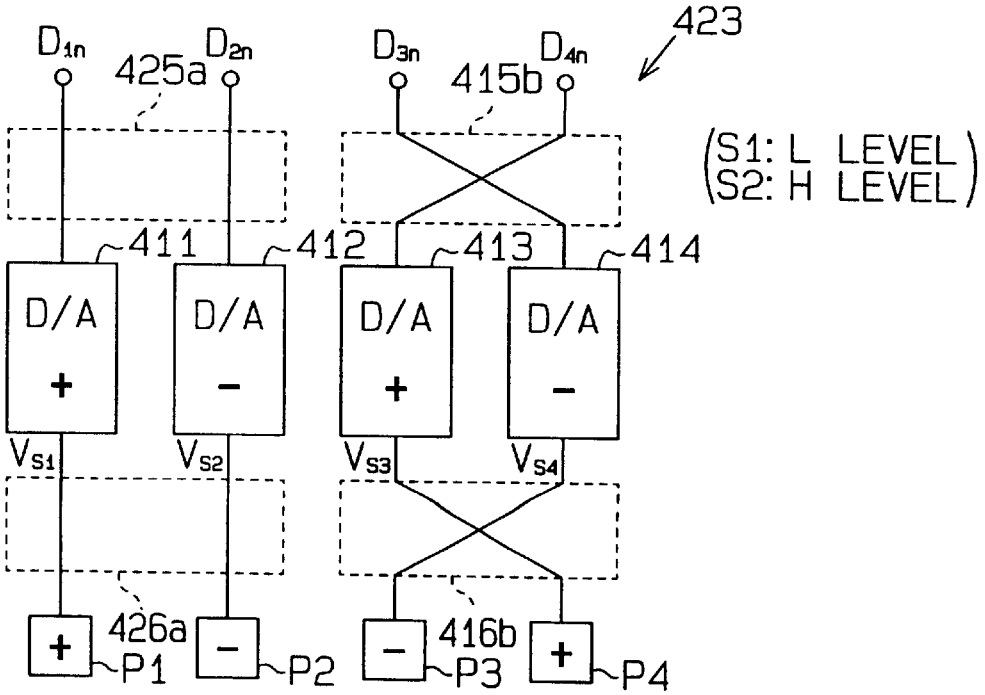

As shown in FIG. 32, the input switching circuit 425*a* supplies the picture signals D1n and D2n to the first and second D/A converters 411 and 412 in response to the polarity switching signal S1 having a L level and the number of pixels selection signal S2 having a H level, respectively. The input switching circuit 415*b* supplies the picture signals D3n and D4n to the fourth and third D/A converters 414 and 413 in response to the polarity switching signal S1 having a L level.

The output switching circuit 426*a* supplies the positive-polarity and negative-polarity voltages Vs1 and Vs2 to the output terminals P1 and P2 in response to the polarity switching signal S1 having a L level and the number of pixels selection signal S2 having a H level, respectively. The output switching circuit 416*b* supplies the positive-polarity and negative-polarity voltages Vs3 and Vs4 to the output terminals P4 and P3 in response to the polarity switching signal S1 having a L level, respectively.

The polarity voltage is also applied to the two pairs of output terminals (not illustrated) adjacent to two pairs of output terminals P1 to P4 in the same way as shown in FIG. 32.

As described above, the data driver 423 alternately supplies the positive-polarity and negative-polarity voltages to a pair of output terminals P1 and P2 or P3 and P4 every horizontal scanning period so that the polarity of the voltage supplied to the adjacent two output terminals among the four output terminals is equal. In other words, the input and output switching circuits 425*a* and 426*a* and the input and output switching circuits 415*b* and 416*b* perform a reverse switching operation so that the polarity of the picture voltage is inverted in units of two pixel cells.

Fifth Embodiment

Figure 33:
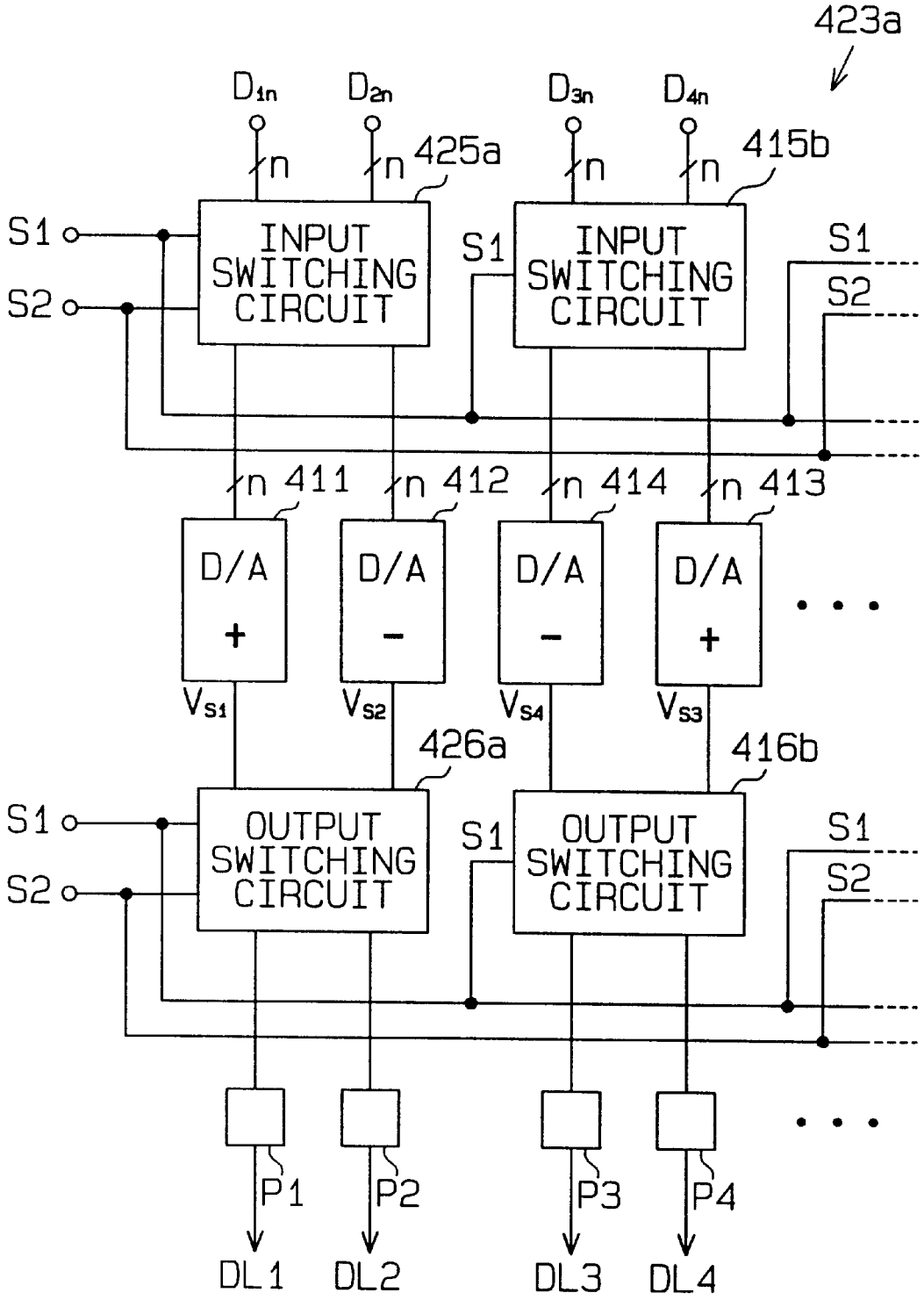
FIG. 33 is a block diagram of a data driver according to a fifth embodiment of the present invention.

FIG. 33 is a block diagram of a data driver 423*a* according to a fifth embodiment of the present invention. The data driver 423*a* differs from the fourth embodiment in the arrangement of the D/A converters 411 to 413. In other words, the second and third D/A converters 412 and 414 which generate the negative-polarity voltage are adjacent. The third D/A converter 413 for generating the positive-polarity voltage and the D/A converter (not illustrated) for generating the positive-polarity voltage are adjacent to each other. In the fifth embodiment, the logic level of the number of pixels selection signal S2 is set in similar to the fourth embodiment. Thus, the data driver 423*a* according to the fifth embodiment operates in the same way as the fourth embodiment.

The fifth embodiment adjacently arranges the D/A converters which generate the same polarity voltage, which allows the D/A converter for generating the positive-polarity voltage to be formed in the n-well region and the D/A converter for generating the negative-polarity voltage to be formed in the P-substrate region. When the D/A converters 411 and 413 for generating the positive-polarity voltage and the D/A converters 412 and 414 for generating the negative-polarity voltage are alternately arranged, a separate region separating the n-well region and P-substrate region is required between the D/A converters 411 and 414. However, in the adjacent arrangement, no separate area is required between the D/A converters. Accordingly, the formed region of the D/A converters 411 to 414, that is, the circuit area of the data driver 423*a*, is reduced.

Sixth Embodiment

Figure 34:
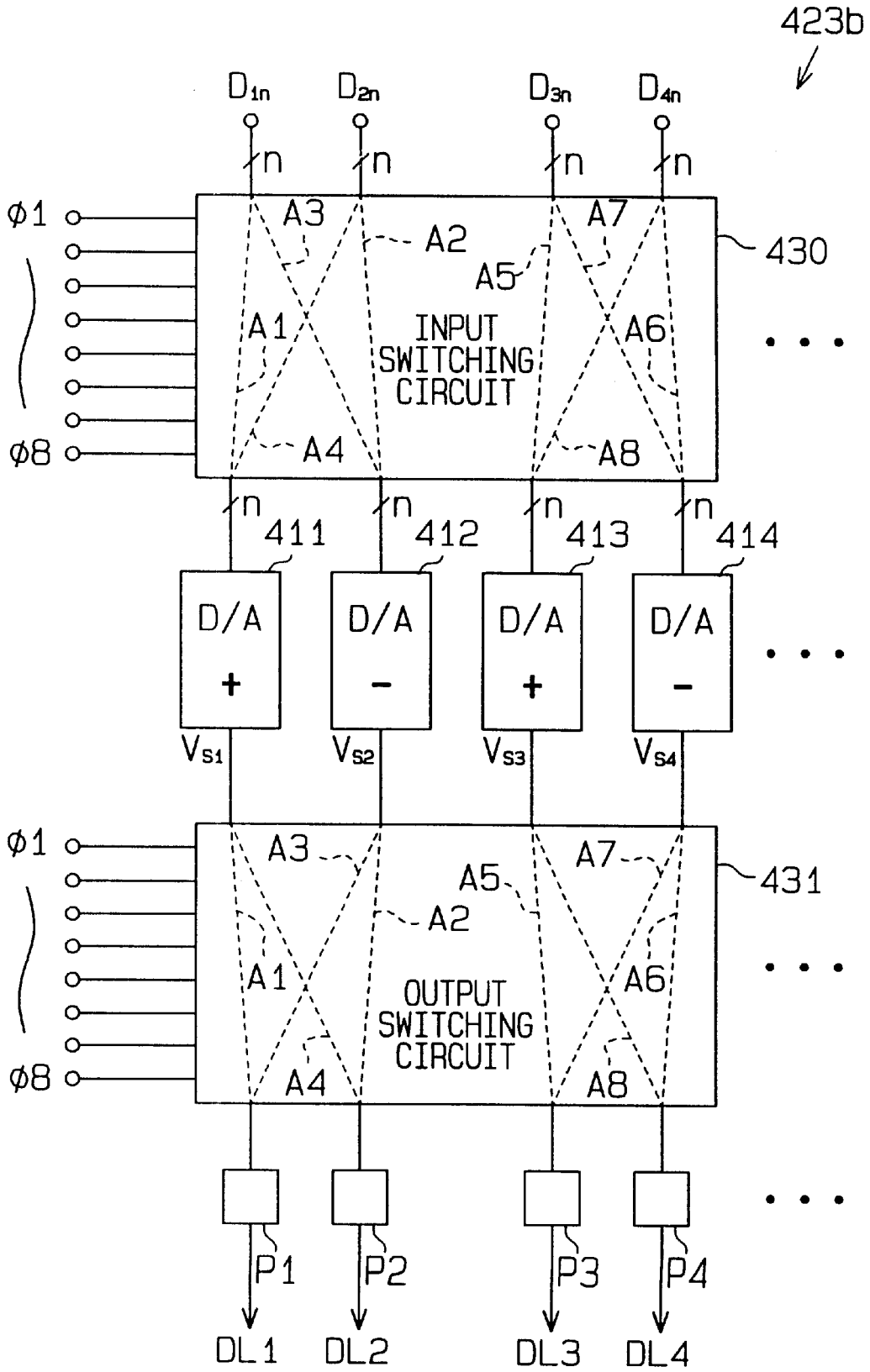
FIG. 34 is a block diagram of a data driver according to a sixth embodiment of the present invention.

FIG. 34 is a block diagram of a data driver 423*b* according to a sixth embodiment of the present invention. The data driver 423*b* is equipped with a pair of input and output switching circuits 430 and 431 assigned to the first to fourth D/A converters 411 to 414.

The input switching circuit 430 selectively supplies the picture signals D1n and D2n to the first and second D/A converters 411 and 412 and selectively supplies the picture signals D3n and D4n to the third and fourth D/A converters 413 and 414.

The output switching circuit 431 selectively supplies the polarity voltages Vs1 and Vs2 from the first and second D/A converters 411 and 412 to the output terminals P1 and P2 and selectively supplies the polarity voltages Vs3 and Vs4 from the third and fourth D/A converters 413 and 414 to the output terminals P3 and P4.

There are eight connection patterns A1 to A8 in the input and output switching circuits 430 and 431. The input and output switching circuits 430 and 431 perform the switching operation shown in FIGS. 29 to 31 according to a combination of the eight connection patterns A1 to A8 in accordance with control signals $\phi$1 to $\phi$8.

The input and output switching circuits 430 and 431 may also be connected to three or more D/A converters. In other words, the polarities of the voltages supplied to the three or more output terminals are controlled so that the polarities of the voltages supplied to the adjacent three or more output terminals are equal with each other. Hence, the polarity of the picture voltage is reversed in units of three dots (three pixel cells) or more.

Figure 35:
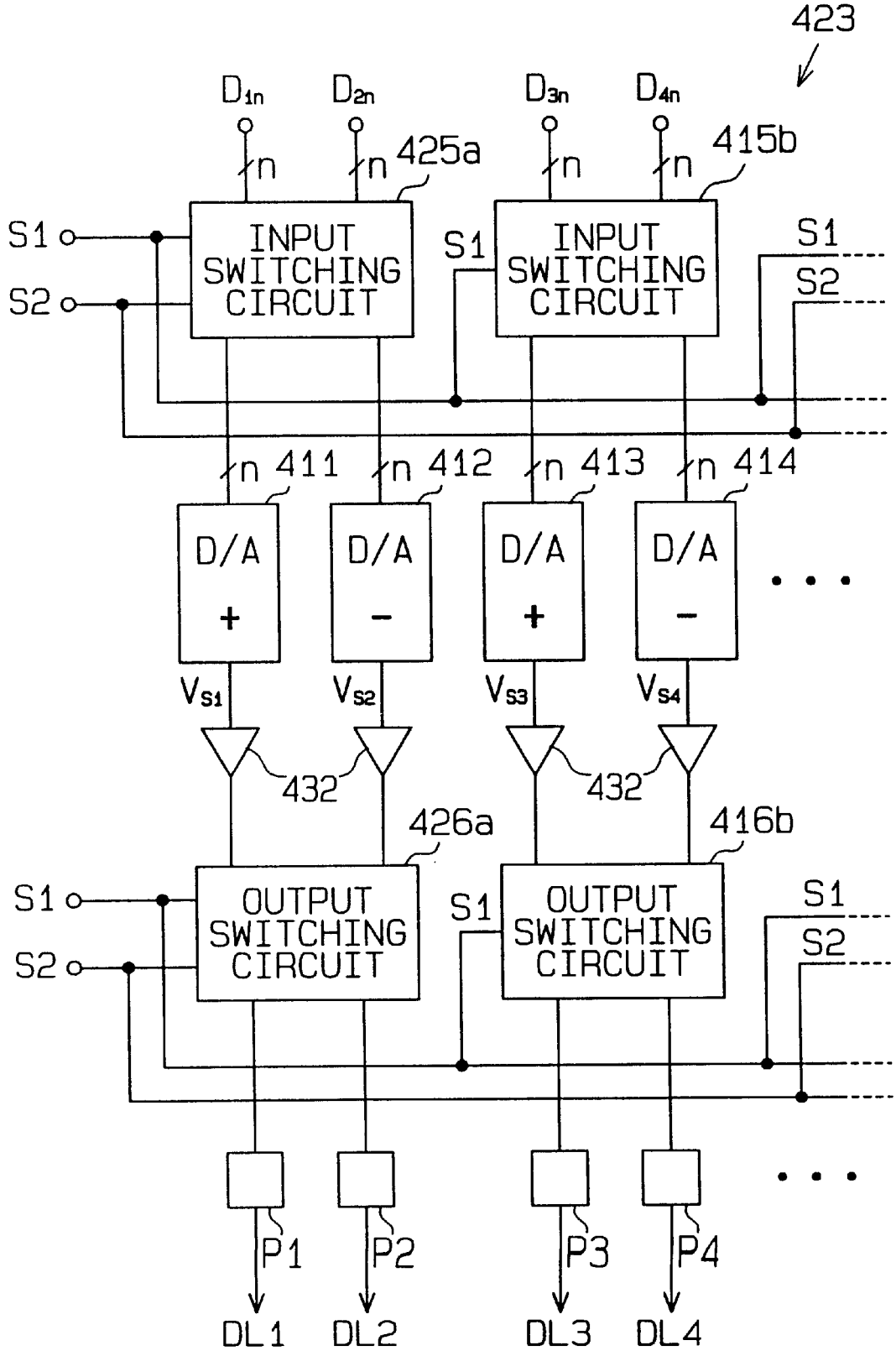
FIG. 35 is a block diagram of a data driver according to a seventh embodiment.

FIG. 35 is a block diagram of the data driver 423 according to a seventh embodiment. The data driver 423 is equipped with a buffer circuit 432 connected between the output terminals of the first and fourth D/A converters 411 to 414 and the output switching circuits 426*a* and 416*b*, respectively.

Figure 36:
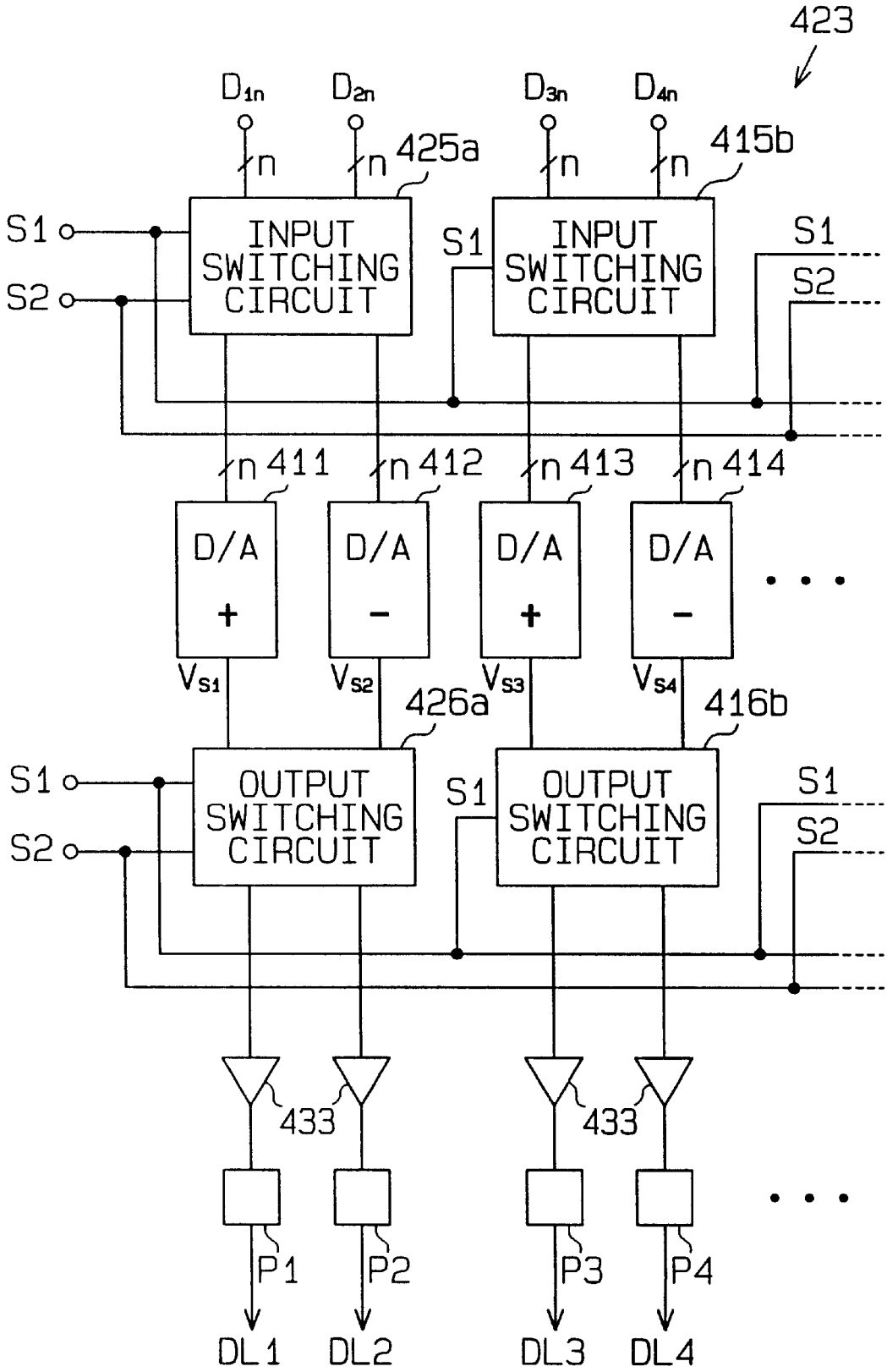
FIG. 36 is a block diagram of a data driver according to an eighth embodiment.

FIG. 36 is a block diagram of the data driver 423 according to an eighth embodiment. The data driver 423 is equipped with a buffer circuit 433 connected between the output switching circuits 426*a* and 416*b* and the output terminals P1 to P4, respectively. The buffer circuit 432 or 433 improves the drive performance of the pixel element. The data driver 423 may also be equipped with the buffer circuits 432 and 433.

It should be apparent to those skilled in the art that the present invention may be embodied in many other specific forms without departing from the spirit or scope of the invention. Particularly, it should be understood that the invention may be embodied in the following forms.

Figure 37:
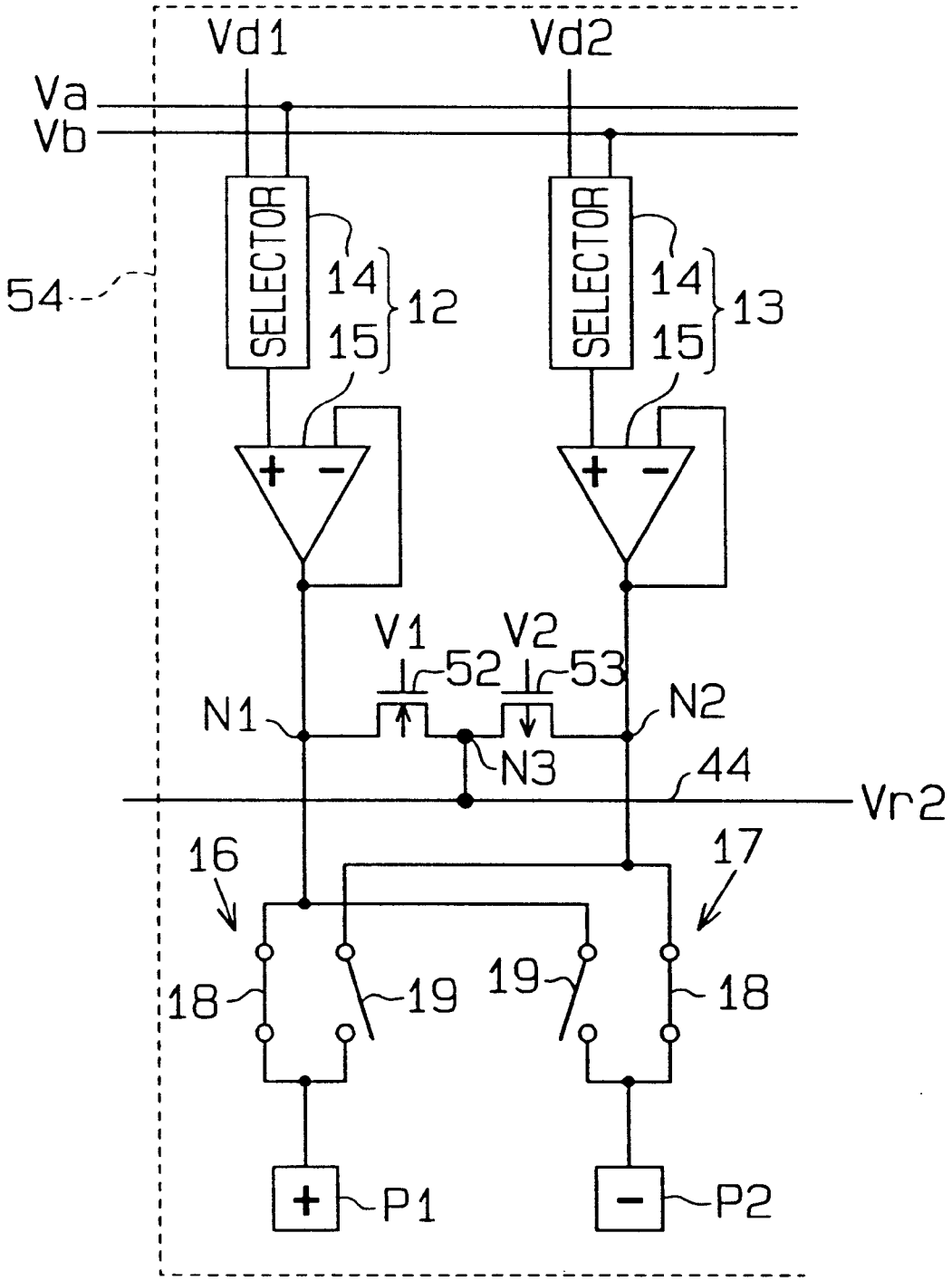
FIG. 37 is a block diagram of an eighth modification example of the data driver of FIG. 10.

FIG. 37 is a block diagram of an eighth modification example of a data driver 54. The data driver 54 is equipped with an N-channel MOS transistor 52 and a P-channel MOS transistor 53 connected in series between the output terminals (i.e., nodes N1 and N2) of the first and second D/A converters 12 and 13. A node N3 between the N-channel and P-channel MOS transistors 52 and 53 is connected to a wire 44 to which the predetermined voltage Vr2 is applied. The first voltage V1 is supplied to the gate of the N-channel MOS transistor 52, and the second voltage V2 is supplied to the gate of the P-channel MOS transistor 53. The first voltage V1 is set to the minimum of the first positive-polarity segment voltage VS1, and the second voltage V2 is set to the maximum of the second positive-polarity segment voltage VS2. The predetermined voltage is set to the voltage between the first and second voltages V1, V2. The N-channel MOS transistor 52 goes off when the voltage at the node N1 rises to the first voltage V1. The P-channel transistor 53 goes off when the voltage at the node N2 drops to the second voltage V2. Accordingly, the first D/A converter 12 supplies only the remaining charge amount from which the charge amount that corresponds to the difference voltage between the predetermined voltage Vr1 and the common voltage Vcom is subtracted. As a result, the time to charge up to the desired positive-polarity segment voltage is decreased, and the power consumption is reduced.

It is preferable that the predetermined voltage Vr2 is set to be equal or smaller than the minimum of the first positive-polarity segment voltage VS1 when the first transistor 52 is turned off and to be equal or greater than the maximum of the second negative-polarity segment voltage VS2 when the second transistor 53 is turned off. This allows the first and second D/A converters 12, 13 to surely charge and discharge the data lines connected to the output terminals P1, P2 to the first and second gradation voltages Va1–Va64, Vb1–Vb64.

Furthermore, when the transistor 52 is turned off earlier than the transistor 53, the charge is provided to an any node N1 via the transistor 53, the wire 44 and an any transistor 52 which maintains an ON action. In other words, residue charge resulting from the node N2 discharge is used for charging the any node N1 via the wire 44. Accordingly, the first D/A converter 12 may start charging from the first voltage V1. When the transistor 53 is turned off earlier than the transistor 52, the charge is provided to the node N1 connected to the transistor 52 maintaining an ON action via an any node N2 connected to an any transistor 53 maintaining an ON action and the wire 44. Accordingly, the second D/A converter 13 may start discharging from the second voltage V2. At the result, a charge provision efficiency is improved.

The present invention may be embodied in a built-in driver liquid-crystal display panel whose data driver is incorporated in the liquid-crystal display panel. The present invention may also be embodied in a display device equipped with a plasma display panel (PDP) or an electroluminescence (EL) panel.

Therefore, the present examples and embodiments are to be considered as illustrative and not restrictive and the invention is not to be limited to the details given herein, but may be modified within the scope and equivalence of the appended claims.

What is claimed is:

1. A driver for a display panel, comprising:

a plurality of pairs of first and second D/A converters, each of the first and second D/A converters having an output terminal, wherein each of the first D/A converters receives a picture signal and outputs a positive-polarity voltage, and each of the second D/A converters receives the picture signal and outputs a negative-polarity voltage;

a plurality of pairs of first and second polarity changeover switches, wherein each of the first polarity changeover switches is connected to the output terminals of the first and second D/A converters and alternately outputs the positive-polarity voltage and negative-polarity voltage in response to a polarity changeover signal, and each of the second polarity changeover switches is connected to the output terminals of the first and second D/A converters and alternately outputs a reverse polarity voltage in contrast with the first polarity changeover switch in response to the polarity changeover signal; and a plurality of switching elements, wherein each of the plurality of switching elements is respectively connected between a first node, located between the output terminal of the first D/A converter and the first polarity changeover switch, and a second node located between the output terminal of the second D/A converter and the second polarity changeover switch, and wherein each of the switching elements is actuated until the voltages at the first and second nodes become substantially equal.

2. The driver of claim 1, wherein each of the switching elements comprises a MOS transistor having a gate connected to one of the first node and the second node.

3. The driver of claim 2, wherein the MOS transistor is an N-channel MOS transistor having a source and a drain connected to the first and second nodes and a gate connected to the second node.

4. The driver of claim 2, wherein the MOS transistor is a P-channel MOS transistor having a source and a drain connected to the first and second nodes and a gate connected to the first node.

5. The driver of claim 1, wherein each of the switching elements comprises first and second N-channel MOS transistors connected in series between the first and second nodes, the first N-channel MOS transistor gate is connected to a node between the first and second N-channel MOS transistors, and the second N-channel MOS transistor gate receives a predetermined voltage.

6. The driver of claim 1, wherein each of the switching elements comprises first and second N-channel MOS transistors connected in series between the first and second nodes, the first N-channel MOS transistor gate is connected to a node between the first and second N-channel MOS transistors, the second N-channel MOS transistor gate is connected to the second node, and a predetermined voltage is applied to the node between the first and second N-channel MOS transistors.

7. The driver of claim 1, wherein each of the switching elements comprises an N-channel MOS transistor and a P-channel MOS transistor connected in series between the first and second nodes, a first predetermined voltage is applied to the P-channel transistor gate, and a second predetermined voltage is applied to the N-channel MOS transistor gate.

8. The driver of claim 1, wherein each of the switching elements comprises an N-channel MOS transistor and a P-channel MOS transistor connected in series between the first and second nodes, a first predetermined voltage is applied to the P-channel transistor gate, a second predetermined voltage is applied to the N-channel MOS transistor gate, and a predetermined voltage is applied to the node between the N-channel and P-channel MOS transistors.

9. The driver of claim 1, wherein each of the switching elements comprises a diode having an anode connected to the second node and a cathode connected to the first node.

10. A driver for a display panel comprising:

a plurality of pairs of first and second D/A converters, each of the first and second D/A converters having output terminals, wherein each of the first D/A converters receives a picture signal and alternately outputs a positive-polarity voltage and a negative-polarity voltage, and each of the second D/A converters receives the picture signal and alternately outputs the negative-polarity voltage and the positive-polarity voltage in contrast with the first D/A converter; and a plurality of pairs of first and second switching circuits, wherein each of the first and second switching circuits is connected between the output terminals of the first and second D/A converters, wherein each of the first and second switching circuits is conductively connected so that the voltages of the output terminals of the first and second D/A converters become substantially equal to each other based on the output voltage of the first D/A converter, and wherein each of the first and second circuits is connected between the output terminals of the first and second D/A converters and conductively connected so that the voltages of the output terminals of the first and second D/A converters become substantially equal to each other based on the output voltage of the second D/A converter.

11. The driver of claim 10, wherein the first switching circuit comprises a first MOS transistor connected between the output terminals of the first and second D/A converters, a second MOS transistor connected between the first MOS transistor gate and the output terminal of the first D/A converter and whose gate receives a polarity switching signal, and a third MOS transistor connected between the first MOS transistor gate and a low potential power supply and whose gate receives the polarity switching signal; and wherein the second switching circuit comprises a fourth MOS transistor connected between the output terminals of the first and second D/A converters, a fifth MOS transistor connected between the fourth MOS transistor gate and the output terminal of the second D/A converter and whose gate receives the polarity switching signal, and a sixth MOS transistor connected between the fourth MOS transistor gate and a low potential power supply and whose gate receives the polarity switching signal.

12. The driver of claim 10, wherein the first switching circuit comprises a first MOS transistor, connected between the output terminals of the first and second D/A converters, and a second MOS transistor connected between the first MOS transistor gate and the output terminal of the first D/A converter and whose gate receives a polarity switching signal, and wherein the second switching circuit comprises a third MOS transistor connected between the first MOS transistor gate and the output terminal of the second D/A converter and whose gate receives the polarity switching signal.

13. A liquid crystal display device comprising:

a liquid crystal display panel having a plurality of pairs of first and second data lines; and a driver connected to the plurality of pairs of the first and second data lines, the driver including, a plurality of pairs of first and second D/A converters having output terminals, wherein each of the first D/A converters receives a picture signal and outputs a positive-polarity voltage and each of the second D/A converters receives the picture signal and outputs a negative-polarity voltage, a plurality of pairs of first and second polarity changeover switches, wherein each of the first polarity changeover switches is connected between the output terminals of the first and second D/A converters and the first data line and alternately outputs positive-polarity and negative-polarity voltages to the first data line in response to a polarity switching signal, and each of the second polarity changeover switches is connected between the output terminals of the first and second D/A converters and the second data line and alternately outputs a reverse voltage in contrast with the first polarity changeover switch to the second data line in response to the polarity switching signal, and a plurality of switching elements, wherein each is connected between a first node, located between the output terminals of the first D/A converter and the first data line, and a second node located between the output terminals of the second D/A converter and the second polarity changeover switch, and wherein each switching element is actuated until the voltages of the first and second nodes become substantially equal with each other.

14. The liquid crystal display panel of claim 13, wherein each of the switching elements comprises an N-channel MOS transistor having a source and a drain connected to the first and second nodes and a gate connected to the second node.

15. A driver of a display panel comprising:

a plurality of D/A converters for receiving picture signals and outputting display voltages;

a plurality of groups of output terminals assigned to the plurality of the D/A converters; and a plurality of time-division switches, wherein the switches are respectively connected between the D/A converters and the groups of output terminals, and wherein the switches are actuated by a time-division control signal such that the switches time divisionally supply the display voltage from the D/A converter to the groups of the output terminals.

16. The driver of claim 15, wherein the number of the plurality of groups of output terminals corresponds to the number of pixels during one horizontal scanning period of the display panel.

17. The driver of claim 15, wherein a plurality of D/A converters comprise a first plurality of D/A converters corresponding to a first display color, a second plurality of D/A converters corresponding to a second display color, and a third plurality of D/A converters corresponding to a third display color, and the plurality of groups of output terminals comprise a first plurality of groups of the output terminals corresponding to the first plurality of D/A converters, a second plurality of groups of the output terminals corresponding to the second plurality of D/A converters, and a third plurality of groups of output terminals corresponding to a third plurality of D/A converters.

18. The driver of claim 15, further comprising a time-division signal generation circuit that generates the time-division control signal in response to a latch control pulse signal.

19. The driver of claim 18, wherein the time-division signal generation circuit comprises a time-division setting circuit that receives the latch control pulse signal and generates a timing signal; and a control circuit that receives the timing signal and generates the time-division control signal.

20. The driver of claim 19, wherein the time-division control signal has a predetermined pulse width determined by dividing one horizontal scanning period by the number of the output terminals of one group.

21. A system for supplying a timing signal to a plurality of display panel drivers including first and second drivers, each driver comprising a semiconductor integrated circuit, the system comprising:

a wire that connects the first and second drivers in series, and wherein the first driver includes, a plurality of D/A converters that receive a picture signal and output a display voltage, a plurality of groups of output terminals assigned to the plurality of D/A converters, a plurality of time-division switches, wherein each of the switches is connected between each D/A converter and each group of output terminals and time divisionally supplies the display voltage from the D/A converter to each group of the output terminals in accordance with a time-division control circuit, a time-division setting circuit that generates a timing signal in response to a latch control pulse signal and supplies the timing signal to the wire, and a control circuit that receives the timing signal and generates the time-division control signal, and wherein the second driver includes, a plurality of D/A converters that receive the picture signal and output the display voltage;

a plurality of groups of output terminals assigned to the plurality of D/A converters, a plurality of time-division switches, wherein each of the switches is connected between each D/A converter and each group of the output terminals and time divisionally supplies the display voltage from the D/A converter to each of the output terminals of each group in accordance with the time-division control signal, and a control circuit that receives the timing signal from the first driver by way of the wire and generates the time-division control signal.

22. The system of claim 21, wherein each of the time-division setting circuits comprises a transfer gate that is maintained in a conductive state and transfers the latch control pulse signal to the wire and the control circuit.

23. The system of claim 21, wherein the time-division setting circuit of the first driver comprises a transfer gate that is always conductive and transfers the latch control pulse to the wire and the control circuit; and wherein the second driver time-division setting circuit includes a transfer gate that is always nonconductive, and the second driver time-division setting circuit is configured to supply the timing signal supplied from the first driver through the wire to the second driver control circuit.

24. The system of claim 21, wherein the time-division control signal has a predetermined pulse width determined by dividing one horizontal scanning period by the number of output terminals of one group.

25. The system of claim 24, wherein the first driver is arranged so that the timing of the latch control pulse signal to the time-division setting circuit substantially coincides with a point where the time-division control signal pulse switches.

26. A driver for a display panel comprising:

a first plurality of D/A converters that receive picture signals and output positive-polarity display voltages;

a second plurality of D/A converters that receive picture signals and output negative-polarity display voltages;

a first plurality of pairs of intermediate terminals assigned to the first plurality of D/A converters;

a second plurality of pairs of intermediate terminals assigned to the second plurality of D/A converters;

a first plurality of time-division switches, wherein each is connected between each of the first plurality of D/A converters and each pair of the first plurality of pairs of intermediate terminals and time divisionally supplies the positive-polarity display voltage from the D/A converters to each pair of the first plurality of pairs of intermediate terminals in accordance with a time-division control signal;

a second plurality of time-division switches, wherein each is connected between each of the second plurality of D/A converters and each pair of the second plurality of pairs of intermediate terminals and time divisionally supplies the negative-polarity display voltage from the D/A converters to each pair of the second plurality of pairs of intermediate terminals in accordance with the time-division control signal;

a plurality of pairs of output terminals including first and second pairs of output terminals assigned to the first and second plurality of pairs of intermediate terminals;

a first plurality of pairs of polarity changeover switches, wherein each selectively connects a pair of the first plurality of pairs of intermediate terminals and the first and second pairs of the plurality of pairs of output terminals in accordance with a polarity switching signal; and a second plurality of pairs of polarity changeover switches, wherein each selectively connects a pair of the second plurality of pairs of intermediate terminals and the first and second pairs of the plurality of output terminals in accordance with the polarity switching signal.

27. A liquid crystal display device comprising:

a liquid crystal display panel having a plurality of groups of data lines; and a driver that drives the liquid crystal display panel, the driver including, a plurality of D/A converters that receive picture signals and output display voltages;

a plurality of groups of output terminals assigned to the plurality of D/A converters and connected to the plurality of groups of data lines, respectively; and a plurality of time-division switches, wherein each is connected between each D/A converter and the output terminals of each group and time divisionally supplies the display voltage from the D/A converter to the output terminals of each group in accordance with a time-division control signal.

28. A driver for a display panel comprising:

a plurality of pairs of first and second D/A converters, wherein each first D/A converter receives a picture signal and outputs a positive-polarity voltage and each second D/A converter receives the picture signal and outputs a negative-polarity voltage;

a plurality of pairs of first and second input switching circuits, wherein each switching circuit is connected to each pair of the first and second D/A converters, respectively and selectively provides the picture signal to the first and second D/A converters;

a plurality of pairs of first and second output terminals that correspond to the plurality of pairs of the first and second D/A converters;

a plurality of pairs of first and second output switching circuits, wherein each switching circuit is connected between each pair of the first and second D/A converters and each pair of the first and second output terminals and selectively supplies the positive-polarity and negative-polarity voltages from the first and second D/A converters to the first and second output terminals; and a plurality of control circuits, each provided in the respective first input and first output switching circuits, for controlling the plurality of first input and output switching circuits so that voltages having different polarities are supplied to adjacent output terminals of adjacent pairs of output terminals in a first mode, and voltages having identical polarities are supplied to adjacent output terminals of adjacent pairs of output terminals in a second mode.

29. The driver of claim 28, wherein each control circuit controls the respective first input and first output switching circuits in a unit of one or more horizontal scanning period in the second mode.

30. The driver of claim 28, wherein the first and second D/A converters are alternately arranged.

31. The driver of claim 30, wherein each control circuit controls the respective first input and first output switching circuits so that the first input and first output switching circuits and the second input and second output switching circuits perform the same switching operations in response to a first switching signal indicating the first mode, and the first input and first output switching circuits and the second input and second output switching circuits perform reverse switching operations in response to a second switching signal indicating the second mode.

32. The driver of claim 28, wherein the two first and second D/A converters are alternately arranged.

33. The driver of claim 32, wherein each control circuit controls the respective first input and first output switching circuits so that the first input and first output switching circuits and the second input and second output switching circuits perform reverse switching operations in response to a first switching signal indicating the first mode and the first input and output switching circuits, and the second input and output switching circuits perform the same switching operations in response to a second switching signal indicating the second mode.

34. The driver of claim 28, further comprising:

a first plurality of pairs of buffers, wherein each pair is connected between each pair of the first and second D/A converters and each pair of the first output switching circuits; and a second plurality of pairs of buffers, wherein each pair is connected between each pair of the first and second D/A converters and each pair of the second output switching circuits.

35. The driver of claim 28, further comprising:

a first plurality of pairs of buffers, wherein each pair is connected between each pair of the first output switching circuits and each pair of the first and second output terminals; and a second plurality of pairs of buffers, wherein each pair is connected between each pair of the second output switching circuits and each pair of the first and second output terminals.

36. A liquid crystal display device comprising:

a liquid crystal display panel having a plurality of pairs of first and second data lines; and a driver that drives the liquid crystal display panel, the driver including, a plurality of pairs of first and second D/A converters, wherein each first D/A converter receives a picture signal and outputs a positive-polarity voltage, and each second D/A converter receives the picture signal and outputs a negative-polarity voltage;

a plurality of pairs of first and second input switching circuits, wherein each switching circuit is connected to each pair of the first and second D/A converters and selectively provides the picture signal to the first and second D/A converters;

a plurality of pairs of first and second output terminals, connected to the plurality of pairs of the first and second data lines, and corresponding to the plurality of pairs of first and second D/A converters;

a plurality of pairs of first and second output switching circuits, wherein each output switching circuit is connected between each pair of the first and second D/A converters and each pair of the first and second output terminals and selectively supplies the positive-polarity and negative-polarity voltages from the first and second D/A converters to the first and second output terminals; and a plurality of control circuits, each provided in a respective one of the first input and first output switching circuits, for controlling the plurality of first input and output switching circuits so that voltages having different polarities are supplied to adjacent output terminals of adjacent pairs of output terminals in a first mode, and voltages having the same polarity are supplied to adjacent output terminals of adjacent pairs of output terminals in a second mode.

37. A method for driving a display panel, comprising the steps of:

providing a plurality of pairs of first and second D/A converters, wherein each first D/A converter receives a picture signal and outputs a positive-polarity voltage and each second D/A converter receives the picture signal and outputs a negative-polarity voltage;

providing a plurality of pairs of the first and second input switching circuits, wherein each switching circuit is connected to each pair of the first and second D/A converters and selectively provides the picture signal to the first and second D/A converters;

providing a plurality of pairs of first and second output terminals that correspond to the plurality of pairs of first and second D/A converters;

providing a plurality of pairs of the first and second output switching circuits, wherein each is between each pair of the first and second D/A converters and each pair of the first and second output terminals and selectively supplies the positive-polarity and negative-polarity voltages from the first and second D/A converters to the first and second output terminals;

controlling the respective first input and output switching circuits so that voltages having different polarities are supplied to the adjacent output terminals of adjacent pairs of the output terminals in a first mode; and controlling the respective first input and output switching circuits so that voltages having the same polarity are supplied to adjacent output terminals of adjacent pairs of output terminals in a second mode.

38. The method of claim 37, wherein the respective first input and output switching circuits are controlled in a unit of one or more horizontal scanning periods in the second mode.

* * * * *